US008571449B2

(12) United States Patent
Miyoshi et al.

(10) Patent No.: US 8,571,449 B2
(45) Date of Patent: Oct. 29, 2013

(54) DEVELOPMENT DEVICE, PROCESS CARTRIDGE, AND IMAGE FORMING APPARATUS

(75) Inventors: Yasuo Miyoshi, Yokohama (JP); Norio Kudo, Kawasaki (JP); Yoshihiro Fujiwara, Yokohama (JP); Tsukuru Kai, Fujisawa (JP); Hiroshi Hosokawa, Yokohama (JP); Hiroaki Okamoto, Zama (JP)

(73) Assignee: Ricoh Company, Limited, Tokyo (JP)

( * ) Notice: Subject to any disclaimer, the term of this patent is extended or adjusted under 35 U.S.C. 154(b) by 463 days.

(21) Appl. No.: 12/700,834

(22) Filed: Feb. 5, 2010

(65) Prior Publication Data

US 2010/0202805 A1 Aug. 12, 2010

(30) Foreign Application Priority Data

Feb. 6, 2009 (JP) ..... 2009-025834
Dec. 28, 2009 (JP) ..... 2009-298609

(51) Int. Cl.
*G03G 15/09* (2006.01)

(52) U.S. Cl.
USPC ..... 399/277

(58) Field of Classification Search
USPC ..... 399/277, 267, 275
See application file for complete search history.

(56) References Cited

U.S. PATENT DOCUMENTS 4,601,259 A * 7/1986 Yamashita
4,705,383 A * 11/1987 Hiraga et al. ..... 399/275
6,021,295 A * 2/2000 Ochiai et al. ..... 399/275
6,385,423 B1 5/2002 Kai
6,442,364 B2 8/2002 Kai et al.
6,449,452 B1 9/2002 Kai
6,597,885 B2 7/2003 Kai et al.
6,671,484 B2 12/2003 Miyoshi et al.
6,701,114 B2 3/2004 Sekine et al.

(Continued)

FOREIGN PATENT DOCUMENTS

CN 1425959 A 6/2003
CN 1453660 A 11/2003

(Continued)

OTHER PUBLICATIONS

Office Action issued Mar. 12, 2012 in Chinese Patent Application No. 201010108379.X.

(Continued)

*Primary Examiner* — Susan Lee
(74) *Attorney, Agent, or Firm* — Oblon, Spivak, McClelland, Maier & Neustadt, L.L.P.

(57) ABSTRACT

A development device includes a developer containing part containing two-component developer, a cylindrical developer carrier to carry by rotation the developer to a development range, a first developer transport member disposed in the developer containing part, to supply the developer to the developer carrier while transporting the developer in an axial direction of the developer carrier, and a magnetic field generator disposed inside the developer carrier, having three developer-carrying magnetic poles, consisting of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, to transport the developer to a release position where the developer is separated from the developer carrier.

58 Claims, 59 Drawing Sheets

(56) References Cited

U.S. PATENT DOCUMENTS

| | | | | |
|---|---|---|---|---|
| 6,757,511 | B2 | 6/2004 | Sugimoto et al. | |
| 6,792,234 | B2 | 9/2004 | Ikeguchi et al. | |
| 6,823,163 | B2 | 11/2004 | Sugimoto et al. | |
| 6,973,281 | B2 | 12/2005 | Hirobe et al. | |
| 7,035,575 | B2 | 4/2006 | Ikeguchi et al. | |
| 7,054,583 | B2 * | 5/2006 | Hirobe | 399/277 |
| 7,132,211 | B2 * | 11/2006 | Sugimoto et al. | 399/275 |
| 7,536,141 | B2 | 5/2009 | Miyoshi | |
| 7,599,649 | B2 | 10/2009 | Miyoshi | |
| 7,650,101 | B2 | 1/2010 | Hosokawa et al. | |
| 7,653,336 | B2 * | 1/2010 | Akashi et al. | 399/277 |
| 8,135,314 | B2 * | 3/2012 | Miyoshi et al. | 399/267 |
| 2003/0031482 | A1 * | 2/2003 | Nagai et al. | 399/267 |
| 2003/0099481 | A1 * | 5/2003 | Sampe et al. | 399/267 |
| 2003/0099489 | A1 * | 5/2003 | Meyer et al. | 399/267 |
| 2003/0156859 | A1 | 8/2003 | Tamai | |
| 2004/0114967 | A1 * | 6/2004 | Godlove et al. | 399/267 |
| 2005/0053856 | A1 * | 3/2005 | Sugimoto et al. | 399/267 |
| 2007/0154242 | A1 | 7/2007 | Matsumoto et al. | |
| 2008/0056747 | A1 | 3/2008 | Miyoshi | |
| 2008/0145107 | A1 | 6/2008 | Miyoshi | |
| 2009/0169264 | A1 * | 7/2009 | Miyoshi et al. | |
| 2009/0232558 | A1 | 9/2009 | Kudo et al. | |
| 2009/0238610 | A1 | 9/2009 | Miyoshi et al. | |

FOREIGN PATENT DOCUMENTS

| | | |
|---|---|---|
| CN | 101281383 A | 10/2008 |
| JP | 11-184249 | 7/1999 |
| JP | 2003-173086 | 6/2003 |
| JP | 2003-263012 | 9/2003 |
| JP | 2006-293199 | 10/2006 |
| JP | 2007-121596 | 5/2007 |
| JP | 2008-102208 | 5/2008 |
| JP | 4132328 | 6/2008 |
| JP | 2008-268576 | 11/2008 |

OTHER PUBLICATIONS

Office Action mailed May 24, 2013, in corresponding Japanese Patent Application No. 2009-298609.

* cited by examiner

DEVELOPMENT DEVICE, PROCESS CARTRIDGE, AND IMAGE FORMING APPARATUS

CROSS-REFERENCE TO RELATED APPLICATIONS

This patent specification is based on and claims priority from Japanese Patent Application Nos. 2009-025834, filed on Feb. 6, 2009, and 2009-298609, filed on Dec. 28, 2009 in the Japan Patent Office, each of which is hereby incorporated by reference herein in its entirety.

BACKGROUND OF THE INVENTION

1. Field of the Invention

The present invention generally relates to a development device, a process cartridge, and an image forming apparatus such as a copier, a printer, a facsimile machine, or a multifunction machine capable of at least two of these functions that includes the development device.

2. Discussion of the Background Art

In general, electrophotographic image forming apparatuses, such as copiers, printers, facsimile machines, or multifunction devices including at least two of those functions, etc., include a latent image carrier on which an electrostatic latent image is formed and a development device to develop the latent image with developer.

There are two types of developer used in electrophotographic images forming apparatuses, namely, one-component developer consisting of magnetic or non-magnetic toner and two-component developer including toner and carrier particles. Recently, two-component developer has come to be widely used because its durability and image quality are better than those of one-component developer. Development devices using two-component developer (hereinafter "two-component development devices") typically include a rotary cylindrical developer carrier (e.g., development sleeve) inside which a stationary magnetic field generator having multiple magnetic poles is provided to carry the developer on the development sleeve.

In certain known development devices, the magnetic field generator has five magnetic poles that can generate magnetic fields of sufficient strength for the development sleeve to carry the developer. The five magnetic poles include an attraction pole, a pre-development transport pole, a development pole, a release pole, and a post-development transport pole. The developer is attracted to a circumferential surface of the development sleeve at a position corresponding to the attraction pole (hereinafter "attraction portion"), and the pre-development pole generates a magnetic field for the development sleeve to transport the developer carried on the development sleeve to a development area or range facing the latent image carrier. The development pole contributes to latent image development in the development range, and the release pole contributes to separating the developer that has passed through the development range from the development sleeve. In this known configuration, the post-development transport pole is disposed between the development pole and the release pole and generates a magnetic field for the development sleeve to reliably transport the developer that has passed through the development range to the release position. In addition, in this known configuration, a developer regulator (e.g., doctor blade) is disposed facing the development sleeve between the attraction pole and the pre-development pole to adjust the amount of the developer carried to the development range.

With this configuration, processes of attracting the developer to the circumferential surface of the development sleeve, transporting the developer to the development range, developing the latent image with the developer, and releasing the developer from the development sleeve can be performed reliably. Alternatively, in certain known development devices, the magnetic field generator further includes a developer regulation pole disposed between the attraction pole and the pre-development pole, facing the developer regulator, and does not include the post-development transport pole.

At present, it is preferred that the development devices be more compact due to an increasing demand for more compact image forming apparatuses. The development devices can be more compact by using a development sleeve of reduced diameter.

However, in the known development devices, there in a practical limit to how much the diameter of the development sleeve can be reduced because it becomes difficult to reliably attract the developer to the development sleeve, transport the developer to the development range, develop the latent image with the developer, and release the developer from the development sleeve. Although magnets capable of generating a magnetic field of sufficient intensity are required to perform these processes reliably, the size of magnets increases as the intensity increases and therefore, it is difficult to reduce the diameter of the development sleeve inside which such large magnets are provided.

In view of the foregoing, there is a need to reduce the diameter of the developer carrier to make the development devices more compact while performing the above-described processes reliably, which the known image forming apparatuses fail to do.

SUMMARY OF THE INVENTION

In view of the foregoing, one illustrative embodiment of the present invention provides a development device.

The development device includes a developer containing part containing two-component developer including toner and magnetic carrier particles, a cylindrical developer carrier to carry by rotation the developer supplied from the developer containing part to a development range where the developer carrier faces an image carrier, a first developer transport member disposed in the developer containing part, to supply the developer to the developer carrier while transporting the developer in an axial direction of the developer carrier, and a magnetic field generator disposed inside the developer carrier, having three developer-carrying magnetic poles each capable of generating a magnetic field to keep the developer on a circumferential surface of the developer carrier.

The three developer-carrying magnetic poles consist of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, to transport the developer that has passed the development range to a release position where the developer is separated from the circumferential surface of the developer carrier. The second magnetic field causes the developer supplied from the developer containing part to be attracted to the circumferential surface of the developer carrier at a developer attraction position. The first magnetic field and the second magnetic field together keep the developer on the circumferential surface of the developer carrier from the developer attraction position to the development range. The first magnetic field and the third magnetic field together keep the developer on the circumferential surface of the developer carrier from the development range to the release position.

Another illustrative embodiment of the present invention provides a process cartridge that is removably installable to an image forming apparatus. The process cartridge includes the development device described above and at least one of an image carrier on which a latent image is formed, a charging member disposed adjacent to the image carrier, to charge a surface of the image carrier, and a cleaning member to remove any toner remaining on the surface of the image carrier after the toner image is transferred from the image carrier.

Yet another illustrative embodiment of the present invention provides a image forming apparatus including an image carrier on which a latent image is formed, a charging member disposed adjacent to the image carrier, to charge a surface of the image carrier, the development device described above, a transfer member to transfer the toner image onto a sheet of recording media, and a cleaning member to remove any toner remaining on the surface of the image carrier after the toner image is transferred from the image carrier.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
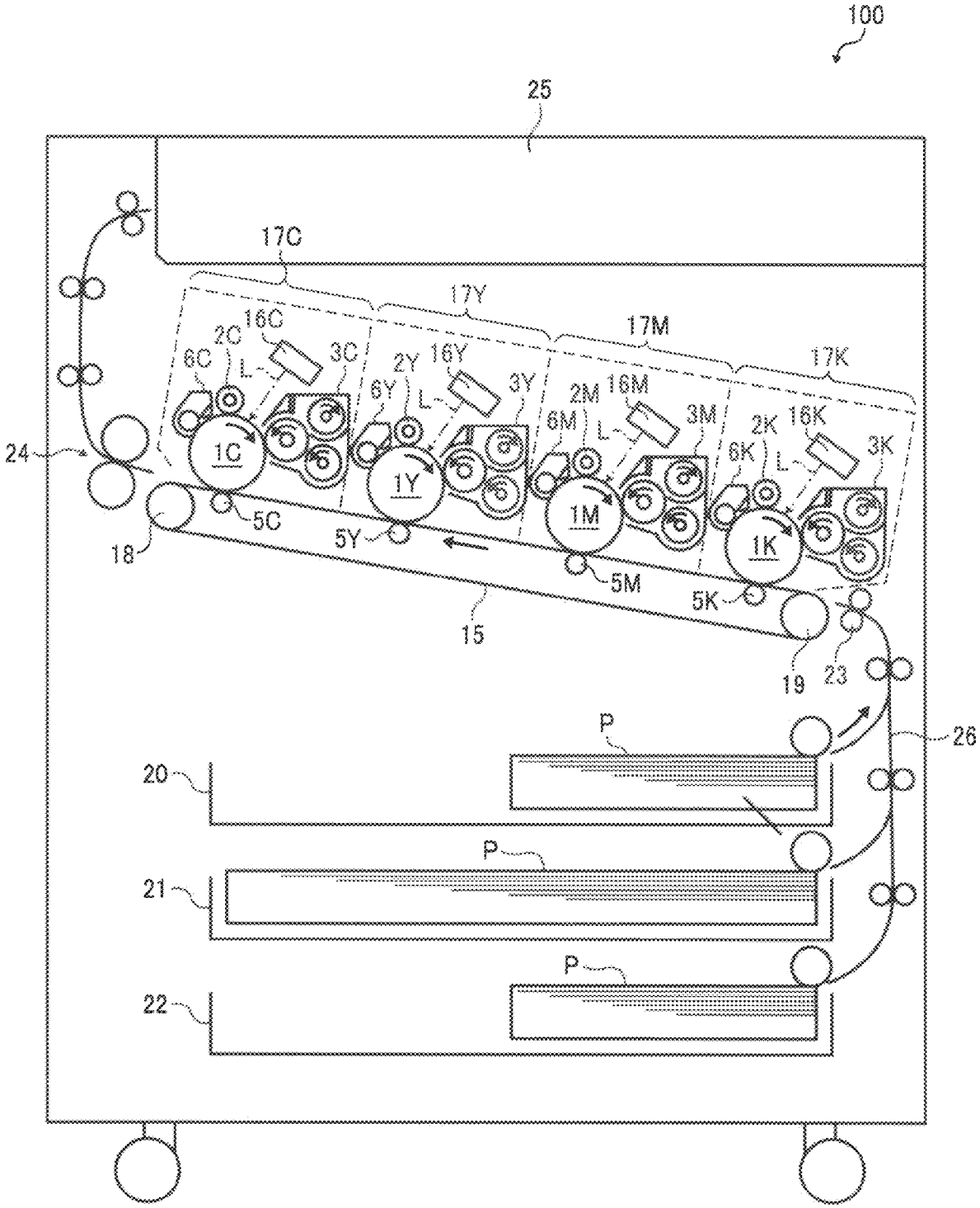
FIG. 1 illustrates an example of a schematic configuration of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result. Referring now to the drawings, wherein like reference numerals designate identical or corresponding parts throughout the several views thereof, and particularly to FIG. 1, a color image forming apparatus according to an illustrative embodiment of the present invention is described.

FIG. 1 is a schematic diagram illustrates a configuration of an image forming apparatus 100 that in the present embodiment is a printer (hereinafter "printer 100"). The printer 100 is a tandem multicolor image forming apparatus and includes four image forming units 17K, 17M, 17Y, and 17C for forming yellow (Y), cyan (C), magenta (M), and black (K) single-color toner images, respectively. It is to be noted that the subscripts Y, M, C, and K attached to the end of each reference numeral indicate only that components indicated thereby are used for forming Y, M, C, and K images, respectively, and hereinafter may be omitted when color discrimination is not necessary.

An endless transfer-transport belt 15 wound around support rollers 18 and 19 is provided beneath the image forming units 17. The support rollers 18 and 19 are respectively disposed on a downstream side and an upstream side in the belt transport direction. An upper side of the transfer-transport belt 15 rotates in a direction indicated by an arrow shown in FIG. 1 (hereinafter "belt transport direction") while carrying a sheet P (recording medium) thereon. Transfer bias rollers 5K, 5M, 5Y, 5C are provided facing the respective image forming units 17K, 17M, 17Y, and 17C via the transfer-transport belt 15.

The printer 100 further includes a fixing device 24 disposed downstream from the downstream support roller 18 in the belt transport direction and a discharge tray 25 provided on an upper portion of a main body of the printer 100. The fixing device 24 fixes a toner image on the sheet P after the sheet P is separated from the transfer-transport belt 15, after which the sheet P is discharged onto the discharge tray 25.

The printer 100 further includes sheets cassettes 20, 21, and 22 each containing multiple sheets P, a feed unit 26 to feed the sheets P from the sheets cassettes 20, 21, and 22 to the image forming units 17, and a pair of registration rollers 23. The registration rollers 23 forward the sheet P sent from the sheet cassettes 20 through 22 to a transfer positions where the transfer-transport belt 15 faces the respective image forming units 17.

It is to be noted that in the configuration shown in FIG. 1, the transfer-transport belt 15 is disposed obliquely to reduce the width, that is, the length of the printer 100 in the lateral direction in FIG. 1, and accordingly the belt transport direction indicated by the arrow is oblique. With this configuration, the width of the printer 100 can be only a length slightly greater than the length of A3 sheets in their longitudinal direction. In other words, the width of the printer 100 can be significantly reduced to a length only necessary to contain the sheets.

Each image forming unit 17 includes a drum-shaped photoconductor 1 serving as a latent image carrier. A charger 2 serving as a charging member to charge a surface of the photoreceptor 1, a developing device 3 to develop an electrostatic latent image formed on the photoconductor 1, and a cleaner 6 to clean the surface of the photoconductor 1 are provided around the photoreceptor 1. An exposure unit 16 directs writing light (e.g., writing beam) L onto the surface of each photoconductor 1 between the charger 2 and the development device 3. Thus, each image forming unit 17 has a known configuration. The photoconductor 1 may be a belt instead of a drum.

In the present embodiment, at least the developing device 3 and the photoconductor 1 are integrated into a single process cartridge that is removably installed in the body of the image forming apparatus 100.

In the above-described printer 100, when users instructs the printer to start image formation, each image forming unit 17 stars to form a single color toner image. More specifically, in each image forming unit 17, the photoconductor 1 is rotated by a main motor, not shown, and is charged uniformly at a portion facing the charger 2 as the charging process. Then, the exposure unit 16 directs writing beams L onto the respective photoconductors 1 according to yellow, cyan, magenta, and black image data decomposed from multicolor image data, thus forming electrostatic latent images thereon. Each latent image is then developed by the development device 3, and thus single-color toner images are formed on the respective photoconductors 1. While the processes described above are performed, the sheets P are fed one by one from one of the sheet cassettes 20 through 22 by the feed unit 26 to the registration rollers 23, which forward the sheet P to the transfer-transport belt 15, timed to coincide with the arrival of the toner images formed on the respective photoconductors 1. Then, the transfer-transport belt 15 transports the sheet P to the respective transfer positions.

When the surface of each photoconductor drum 1 carrying the toner image reaches a portion facing the transfer bias roller 5 via the transfer-transport belt 15, the toner image is transferred by the bias applied by the transfer bias roller 5 from the photoconductor 5 onto the transfer-transport belt 15. Thus, the K, M, Y, and C toner images are sequentially transferred from the respective photoconductors 1 and superimposed one on another on the sheet P, forming a multicolor toner image on the sheet P. The sheet P on which the multicolor toner image is formed is then separated from the transfer-transport belt 15, and then the fixing device 54 fixes the image on the sheet P thereon, after which the sheet P is discharged onto the discharge tray 25.

After the toner image is transferred from each photoconductor 1, the cleaner 6 removes any toner remaining thereon, and a discharge lamp, not shown, removes electrical potentials remaining on the photoconductor 1 as required. Then, the charger 2 again charges the surface of the photoconductor 1.

Descriptions are given below of the development devices 3K, 3M, 3Y, and 3C according to a first embodiment, which have a similar configuration except that the color of the toner used therein is different.

First Embodiment

Figure 2:
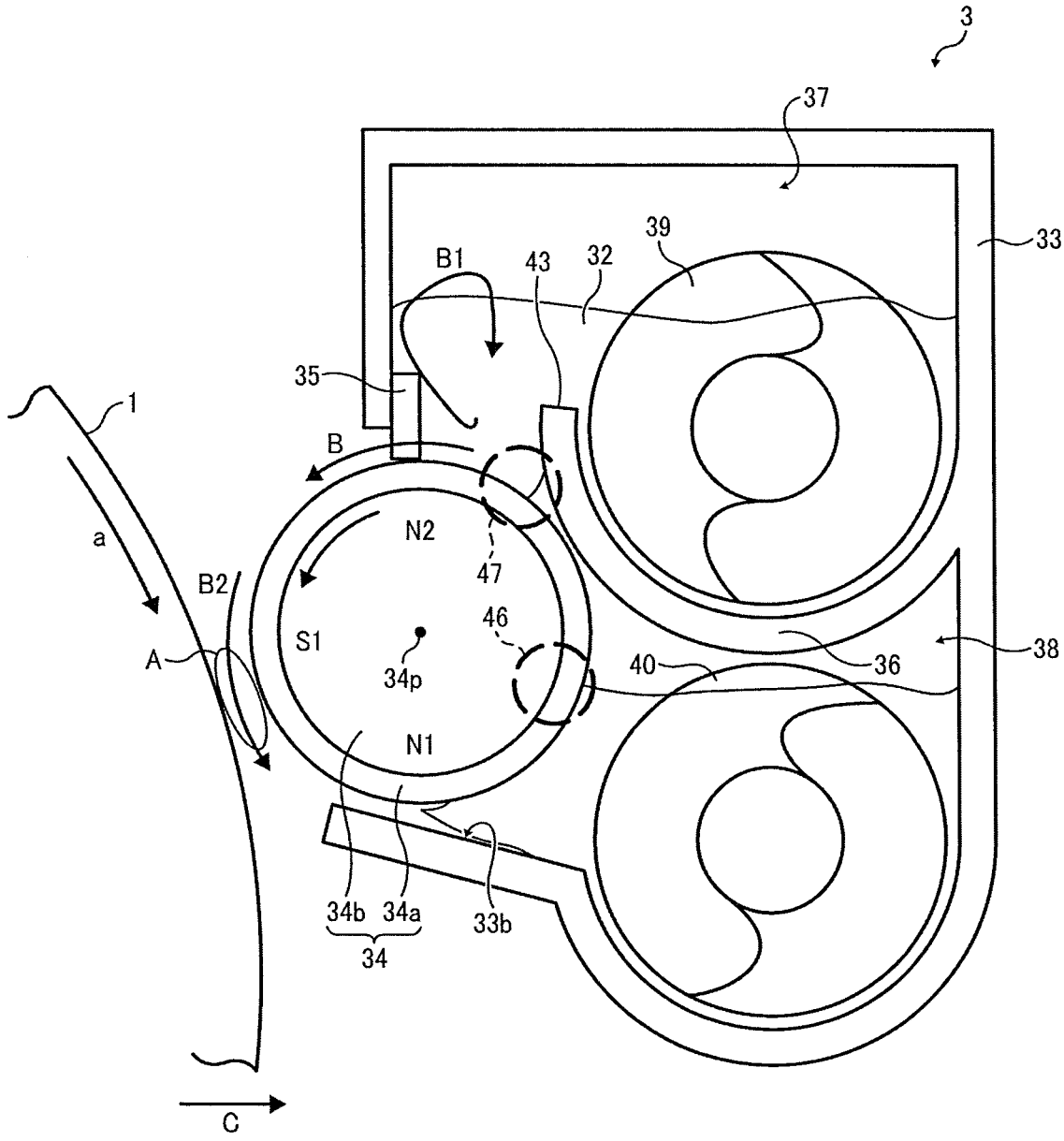
FIG. 2 is a schematic diagram illustrating a configuration of a development device according to an illustrative embodiment.

FIG. 2 illustrates a schematic configuration of the development device 3 according to a first embodiment of the present invention. The development device 3 is disposed facing the photoconductor 1 that rotates clockwise, that is, in a direction indicated by arrow a in FIG. 2. A casing 33 of the development device 3 contains two-component powder developer 32 including magnetic carrier particles and organic or inorganic toner particles. The development device 3 includes a development roller 34 formed with a development sleeve 34*a* and a magnet roller 34*b* disposed inside the development sleeve 34*a*. The development sleeve 34*a*, serving as a developer carrier, carries the developer 32 supplied from the casing 33 on a circumferential surface thereof and transports by rotation the developer to a development range A. In the development range A, the developer 32 is supplied to the latent image formed on the photoconductor 1, thus developing the latent image into a toner image. The magnet roller 34*b* includes multiple magnets whose positions are fixed relative to the development device 3. The development device 3 further includes a developer regulator 35 to adjust the amount (e.g., layer thickness) of the developer 32 carried on the development sleeve 34*a*.

It is to be noted that reference characters 34*p* represents a center of rotation of the development sleeve 34*a*, 46 represents a release portion where the developer 32 leaves the circumferential surface of the development sleeve 34*a*, and 47 represents a attraction portion (developer attraction position) where the developer 32 is carried onto the development sleeve 34*a* from a supply path 37.

Figure 3:
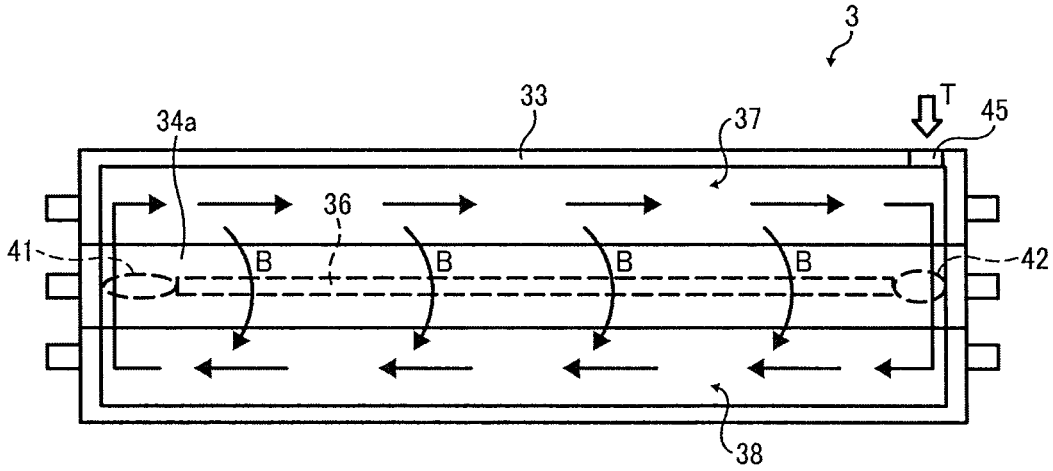
FIG. 3 illustrates a flow of developer in a developer containing part in the development device shown in FIG. 2.
Figure 5:
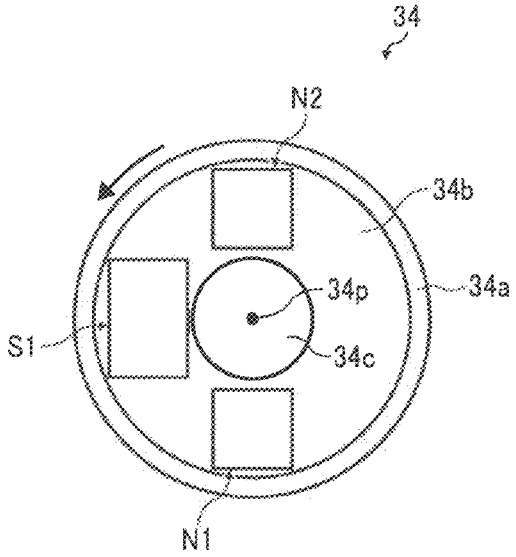
FIG. 5 is a cross-sectional diagram illustrating an arrangement of magnets in a development roller in the development device shown in FIG. 2.

The development device 3 further includes two developer transport members, namely, a supply screw 39 and a circulation screw 40, both disposed in substantially parallel to a roller shaft 34*c* shown in FIG. 5 (axial direction) of the development roller 34. Each of the supply screw 39 and the circulation screw 40 includes a shaft and a bladed spiral provided on the shaft and transports the developer unidirectionally along the shaft (hereinafter "developer transport direction") while rotating. Thus, the development device 3 is unidirectional circulation type that transports the developer unidirectionally. An inner wall of the development casing 33 as well as a partition 36 divide the space inside the casing 33 into the supply path 37 in which the supply screw 39 is disposed and a circulation path 38 in which the circulation screw 40 is disposed that are arranged vertically via the partition 36. A port 41 (first communication port) and a port 42 (second communication port), both shown in FIG. 3, are respectively formed in both end portions of the partition 36 in a direction perpendicular to the surface of the paper on which FIG. 2 is drawn, and the supply path 37 and the circulation path 38 communicate each other through the ports 41 and 42.

Additionally, an end portion of the partition 36 on the side of the development sleeve 34*a* stands vertically in FIG. 2 to enclose the supply screw 39 and thus forms a barrier 43. The barrier 43 and the inner wall of the casing 33 together form an opening that opens toward the development sleeve 34*a*, and the developer 32 is supplied from the supply path 37 through this opening to the development sleeve 34*a*. This opening extends in a longitudinal direction, that is, the axial direction, of the development roller 34 so that the developer 32 can be supplied to the development sleeve 34*a* across the entire width of an image range to be developed.

It is to be noted that, in the present embodiment, because the amount of the developer 32 in the supply path 37 decreases as the developer 32 flows downstream in the developer transport direction in the supply path 37, the height of the barrier 43 decreases toward downstream in the developer transport direction.

As shown in FIG. 2, each of the supply path 32 and the circulation path 38 contain the developer 32. The circulation screw 40 is in substantially parallel to the supply screw 39 and transports the developer 32 in a direction opposite the direction in which the supply screw 39 transports the developer 32. The developer 32 is circulated in the casing 33 through the ports 41 and 42 (shown in FIG. 3) formed in the both end portions of the partition 36 as the supply screw 39 and the circulation screw 40 rotate. In FIG. 2, the supply screw 39 rotates clockwise, and the circulation screw 40 rotates counterclockwise similarly to the development sleeve 34*a*.

The developer 32 contained in the supply path 37 is supplied onto a circumferential surface of the development sleeve 34*a* while transported by the supply screw 39. More specifically, the developer 32 overstrides the barrier 43 as the supply screw 39 rotates or is attracted by the magnetic force exerted by the magnetic roller 34*b* provided inside the development sleeve 34*a*. The developer 32 sent from the supply path 37 is carried on the development roller 34*a* in the attraction portion 47, attracted by the magnetic force exerted by the magnetic roller 34*b* and is transported in a direction indicate by arrow B as the development sleeve 34*a* rotates. While the developer 32 carried on the development sleeve 34*a* passes a portion facing the developer regulator 35 (hereinafter "developer regulation portion"), the developer regulator 35 scrapes off excessive developer 32 from the development sleeve 34*a* as indicated by arrow B1. Thus, only a predetermined or given amount of the developer 32 passes the portion facing the developer regulator 35 in the direction indicated by arrow B.

Then, the predetermined amount of the developer 32 passes through the development range A as indicated by arrow B2, after which the developer 32 leaves the development sleeve 34*a* and flows to a bottom portion 33*b* of the casing 33 and thus enters the circulation path 38. Thus, the developer 32 that is not supplied to the photoconductor 1 but remains on the development sleeve 34*a* after passing through the development range A is collected in the circulation path 38 instead of being transported to the supply path 37 immediately as the development sleeve 34*a* rotates. In the circulation path 38, the collected developer 32 is mixed with fresh toner supplied thereto and then again sent to the supply path 37. Therefore, only sufficiently agitated developer 32 can be present in the supply path 37. The developer that reaches a downstream end portion in the developer transport direction in the supply path 37 as well as the developer that has left the development sleeve 34*a* after passing the development range A are transported through the circulation path 38 and then sent to an upstream end portion of the supply path 37. The developer 32 in the circulation path 38 includes the developer 32 whose toner concentration is decreased while it passes through the development range A. Therefore, fresh toner is supplied to the circulation path 38 according to toner consumption calculated based on data of latent images or a detected toner concentration in the circulation path 38. Thus, the developer 32 having a proper toner concentration can be supplied to the supply path 37.

Figure 4:
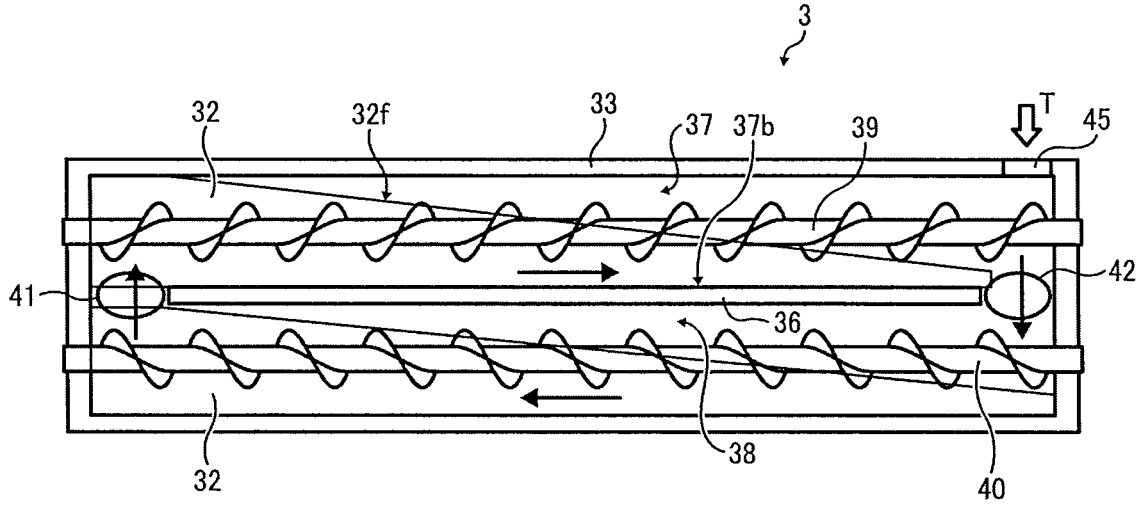
FIG. 4 is a cross-sectional diagram illustrating the development device shown in FIG. 2.

FIG. 3 illustrates a flow of the developer 32 in the casing 33 viewed in the direction indicated by arrow C in FIG. 2. FIG. 4 is a cross-sectional view illustrating the supply screw 39 and the circulation screw 40 viewed in the direction indicated by arrow C in FIG. 2. In FIGS. 3 and 4, arrows indicate the flow of the developer 32 in the development device 3.

As shown in FIGS. 2, 3, and 4, because the supply path 37 and the circulation path 38 are arranged vertically, the developer 32 flows down through the port 42 serving as the second communication port (hereinafter also "falling port 42") disposed on the right in the drawings, connecting the downstream end portion of the supply path 37 to the upstream end portion of the circulation path 38 in the developer transport direction. By contrast, the developer 32 is brought up through the port 41 serving as the first communication port (hereinafter also "bring-up port 41") disposed on the left in the drawings, connecting the downstream end portion of the circulation path 38 to the upstream end portion of the supply path 37 in the developer transport direction. The developer 32 is pumped up by the pressure of the developer 32 accumulated in the downstream end portion of the circulation path 38 through the bring-up port 41 to the supply path 37. As shown in FIGS. 3 and 4, a toner supply port 45 through which fresh toner is supplied to the development device 3 is formed in an upper portion of the casing 33. The toner supply port 45 correspond to the position of the falling port 42 formed in the partition 36, and the toner supplied through it flows down therethrough to an upstream portion of the circulation path 38.

Not all of the developer 32 sent from the circulation path 38 to the supply path 37 reaches the downstream end of the supply path 37 in the developer transport direction of the supply screw 39. As indicated by arrow B shown in FIG. 3, a certain amount of the developer 32 is supplied to the development sleeve 34*a* in mid-course of transportation in the supply path 37, passes through the development range A, and then collected in the circulation path 38. Thus, the developer 32 can be supplied onto the circumferential surface of the development sleeve 34*a* across a substantially entire axial length of the development sleeve 34*a*. Therefore, the amount of the developer 32 transported by the supply screw 39 in the supply path 37 decreases gradually as the developer 32 flows downstream in the supply path 37. By contrast, as the developer 32 flows downstream in the circulation path 38, the amount of the developer 32 transported by the circulation screw 40 in the circulation path 38 increases gradually and is not uniform in the circulation path 38.

In the present embodiment, as described above, the developer leaves the development sleeve 34*a* after passes through the development range A and is collected in the circulation path 38. The developer whose toner concentration is decreased is not immediately supplied to the supply path 37, but the toner concentration thereof is adjusted in the circulation path 38, and thus the toner concentration can be kept constant across the supply path 37.

(Development Roller)

The development roller 34 is described in further detail below.

As shown in FIG. 2, the magnet roller 34*b* has three magnetic poles each generating a magnetic field sufficiently strong to keep the developer 32 on the circumferential surface of the development sleeve 34*a* (hereinafter "developer-carrying magnetic pole"), namely, two north poles N1 and N2, and a south pole S1. FIG. 5 is a cross-sectional diagram illustrating an arrangement of the magnets of the magnet roller 34*b* inside the development sleeve 34*a*. In the first embodiment, the magnet forming the pole S1 (hereinafter also "magnet S1") of the magnet roller 34*b* is 3 mm in height and 2 mm in width in its cross section. The magnets respectively forming the poles N1 and N2 (hereinafter also "magnets N1 and N2") are 2 mm in height and 2 mm in width in there cross sections.

In the present embodiment, the maximum magnetic flux density of the north poles N1 and N2, and the south pole S1 in the normal direction to the development sleeve 34*a* is not less than 10 mT. When this maximum magnetic flux density is not less than 10 mT, the strength of the magnetic fields generated by these developer-carrying magnetic poles is sufficient for keeping the developer 32 on the circumferential surface of the development sleeve 34*a*.

As shown in FIG. 5, the development roller 34 includes the roller shaft 34*c* disposed at the center of rotation 34*p* of the development sleeve 34*a*, and the three magnets S1, N1, and N2 are disposed around the roller shaft 34*c*. In the present embodiment, when the diameter of the roller shaft 34*c* is 3 mm and the development sleeve 34*a* has a sleeve thickness of 0.5 mm and a diameter of 9 mm, these magnets can be provided inside the development sleeve 34*a*. It is to be noted that the sides of the cross section of each magnet is preferably not less than 2 mm because accuracy in processing is lower if it is extremely short.

Figure 6:
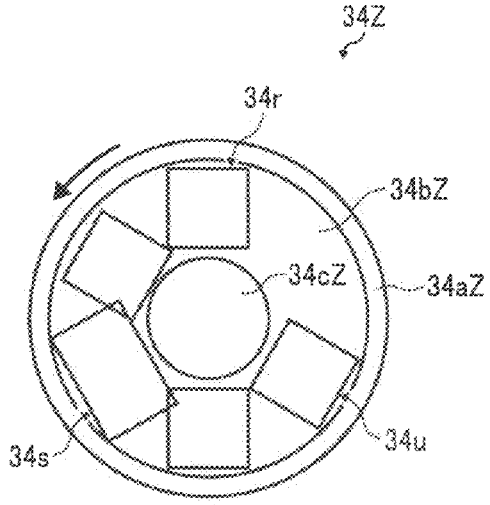
FIG. 6 is a cross-sectional diagram illustrating an arrangement of magnets in a development roller in a comparative example.

FIG. 6 illustrates, as an example, disposing five developer-carrying magnetic poles inside a development roller 34Z (hereinafter also "five-pole configuration"). Sizes of the development sleeve 34*a*Z and a roller shaft 34*c*Z are identical to those in the development roller 34 shown in FIG. 5. A magnet roller 34*b*Z includes a magnet 34*s* forming a development pole, a magnet 34*r* forming a attraction pole, a magnet 34*u* forming a release pole, and other two magnets. When the magnet 34*s* has the identical size to that of the magnet S2 shown in FIG. 5, and the other four magnets have the identical size to that of the magnets N1 and N2 shown in FIG. 5, the magnets overlap as shown in FIG. 6, and thus the five magnets cannot be provided inside the development sleeve 34*a*Z.

Therefore, the present embodiment uses the development roller 34*b* that is a "three-pole development roller" inside which three magnets are provided (hereinafter "three-pole configuration"). Thus, by reducing the number of the magnets provided in the magnet roller 34*b*, the space inside the development sleeve 34*a* necessary for the magnet roller 34*b* can be reduced, that is, the diameter of the development sleeve 34*a* can be reduced. When the diameter of the development sleeve 34*a* is the same, the space for each magnet forming a single developer-carrying magnetic pole can be increased in the three-pole configuration from that in the five-pole configuration. Therefore, even when the diameter of the development sleeve 34*a* is so small that the each magnet in the five-pole configuration cannot generate a magnetic field of sufficient strength, each magnet in the three-pole configuration can generate a magnetic field of sufficient strength.

It is to be noted that the magnetic field generator is not limited to the magnet roller 34*b* in which magnets are embedded. Alternatively, magnetic poles similar to those generated by the magnet roller 34*b* can be generated by forming a cylindrical member with a mixture of resin and magnetic powder, and disposing a magnetizing yoke around the cylindrical member to magnetize it. Although the space for the magnetic yoke inside the development sleeve is limited when the diameter of the development sleeve is smaller, the space can be larger in the three-pole configuration.

Thus, in the present embodiment, by reducing the diameter of the development sleeve 34*a*, the size of the development device 3 can be reduced, and accordingly the process cartridge (image forming unit 17) including development device 3 can be more compact. Further, the image forming apparatus 100 that includes multiple process cartridges can be more compact.

(Release of Developer from the Development Sleeve)

Next, release of the developer 32 from the development sleeve 34*a* (hereinafter simply "release of developer") in the first embodiment is described below.

As shown in FIG. 2, the pole S1 is disposed facing the photoconductor 1 and serves as a development pole (hereinafter also "development pole S1") to generate a first magnetic field in the development range A.

The pole N2 is disposed upstream from the development pole S1 in the rotational direction of the development sleeve 34*a* and functions as both the attraction pole and the pre-development transport pole (hereinafter also "pre-development pole N2"). The pre-development pole N2 generates a second magnetic field to cause the developer supplied from the developer containing part (supply path 37) to be attracted to the circumferential surface of the development sleeve 34*a*. The pre-development pole N2 also serves as a developer regulation pole that generates a magnetic field in a developer regulation area where the development sleeve 34*a* faces the developer regulator 35.

The developer is kept on the circumferential surface of the development sleeve 34*a* (hereinafter simply "surface of the development sleeve 34*a*") by the second magnetic field generated by the pre-development pole N2 and the first magnetic field development pole S1 from the attraction portion 47 to the development range A.

The pole N1 is disposed downstream from the development pole S1 in the rotational direction of the development sleeve 34*a* and functions as both the post-development transport pole and the release pole (hereinafter also "post-development pole N1") to generate a third magnetic field disposed between the first magnetic field and the second magnetic field, to transport the developer that has passed the development range A to the release portion 46 (release position) where the developer leaves the circumferential surface of the development sleeve 34*a*. From the development range A to the developer release position 46, the developer is kept on the surface of the development sleeve 34*a* by the first magnetic field generated by the development pole S1 and the third magnetic field generated by the post-development pole N1 from the development range A to the release portion 46 where the developer is separated from the development sleeve 34*a*.

By contrast, in the five-pole configuration shown in FIG. 6, another pole is provided between the development pole 34*s* and the attraction pole 34*r*, yet another pole is provided between the development pole 34*s* and the release pole 34*u*. In this configuration, when the development roller 34 has a relatively small diameter, the development sleeve 34*a*Z has a shorter interval between the release pole 34*u* and the attraction pole 34*r* disposed downstream from the releaser pole 34*u* in the rotational direction of the development roller 34*a*Z, which can inhibit the developer from leaving the development roller 34*a*Z.

In the three-pole configuration, because both the pre-development pole N2 functioning as the attraction pole and the post-development pole N1 functioning as the release pole are adjacent to the development pole S1, a longer interval can be maintained between the pre-development pole (attraction pole) N2 and the post-development pole (release pole) N1 disposed downstream from the pre-development pole N2 in the rotational direction thereof.

Referring to FIG. 2, the developer 32 that has passed the development range A reaches the portion facing the circulation path 38 as described above, after which the developer leaves the development sleeve 34*a* around the release portion 46. In the first embodiment, the circulation path 38 is disposed beneath the supply path 37, and the development sleeve 34*a* moves upward from the position facing the pose-development pole N1 serving as the release pole to the position facing the post-development pole N2 serving as the attraction pole N2. Therefore, gravity can act on the release of the developer from the development sleeve 34*a* between the release pole (N1) and the attraction pole (N2). Generally, the interval between the release pole and the attraction pole decreases as the diameter of the development sleeve decreases. Accordingly, the developer that has passed the release pole might be attracted to the attraction pole, failing to leave the development sleeve. However, in the present embodiment, because the gravity can act on the release of the developer from the development sleeve 34*a*, such failure can be reduced.

If the developer 32 does not leave the development sleeve 34*a* or the developer that has left the development sleeve 34*a* is again attracted to the development sleeve 34*a* from the circulation path 38, the developer whose toner concentration is lower is supplied to the development range A, decreasing the image density, which is not desirable. Therefore, the developer should leave the development sleeve 34*a* around the release portion 46.

Mechanism of release of the developer is as follows: The developer 32 on the development sleeve 34*a* is transported by the development sleeve 34*a* due to frictional force generated between the surface of the development sleeve 34*a* and the developer 32. Because this frictional force is proportional to a vertical drag applied to the developer 32 on the development sleeve 34*a*, this frictional force increases as the magnetic force in a normal direction acting on the developer 32 is larger in a direction to attract the developer, and accordingly the ability of the development sleeve 34*a* to transport the developer 32 increases.

Hereinafter, the magnetic force generated by the magnet roller 34*b*, acting in the normal direction to the surface of the development sleeve 34*a* and that acting in a direction tangential to the surface of the development sleeve 34*a* are referred to as the "magnetic force in normal direction" and the "magnetic force in tangent direction", respectively. Additionally, the magnetic force in normal direction is also referred to as "magnetic attraction in normal direction" when acting in the direction toward the center of rotation 34*p* of the development sleeve 34*a* and "magnetic repulsion in normal direction" when acting in the direction away from the center of rotation 34*p* of the development sleeve 34*a*.

In other words, when the magnetic attraction in normal direction is larger, the developer 32 can receive a transport force from the development sleeve 34*a* and be transported as the development sleeve 34*a* rotates. By contrast, when the magnetic attraction in normal direction is smaller, the frictional force between the development sleeve 34*a* and the developer 32 is weaker, and the developer 32 is likely to slip on the development sleeve 34*a* and is less likely to be transported by the development sleeve 34*a*.

When the magnetic attraction in normal direction is smaller than the weight of the developer 32 itself, or when the magnetic repulsion in normal direction acts on the developer 32, the developer 32 leaves the development sleeve 34*a*. When the magnetic attraction in normal direction is greater and accordingly the frictional force between the development sleeve 34*a* and the developer 32 is greater, the developer 32 can be transported at a velocity substantially identical to the rotational velocity of the development sleeve 34*a*. In other words, inertial force acts on the developer 32 because the developer 32 rotates at a high velocity similarly to the development sleeve 34*a*.

Therefore, when the magnetic attraction in normal direction is smaller in the release portion 46, the developer 32 can leave the development sleeve 34*a* due to the inertial force in addition to the weight of the developer 32. In other words, to separate the developer 32 from the development sleeve 34*a*, the magnetic attraction in normal direction should be smaller and the inertial force or the weight of the developer 32 should be used. Alternatively, the repulsion in normal direction should be generated to separate the developer 32 from the development sleeve 34*a* magnetically.

(Release of Developer in Respective Magnetic Poles)

Figure 7:
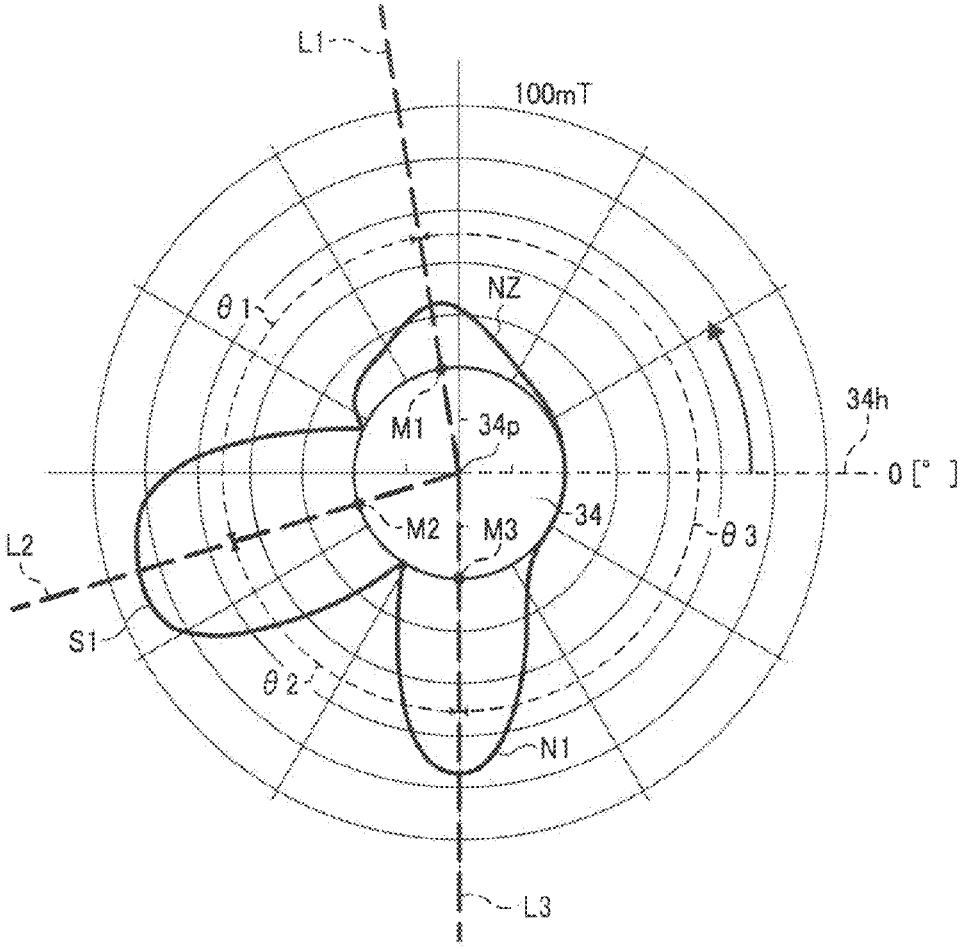
FIG. 7 is a graph illustrating a distribution of magnetic flux density in normal direction in a three-pole configuration.

FIG. 7 is a graph illustrating a distribution of the magnetic flux density in normal direction to the surface of the development sleeve 34*a* in the three-pole configuration.

In FIG. 7, reference characters M1, M2, and M3 respectively represent centers (e.g., pre-development magnetic flux density peak position, development magnetic flux density peak position, and post-development magnetic flux density peak position) of the pre-development pole N2, the development pole S1, and the post-development pole N1 where the magnetic flux density in normal direction therein is maximum. Dotted lines L1, L2, and L3 represent a pore-development center line, a development center line, and a post-development center line connecting the center of rotation 34*p* and the pre-development center M1, the development center M2, and the post-development center M3, respectively.

In FIG. 7, a center angle formed by the pre-development center line L1 and the development center line L2 is referred to as the angle θ1, a center angle formed by the development center line L2 and the post-development center line L3 is referred to as the angle θ2, and a center angle formed by the post-development center line L3 and the pre-development center line L1 is referred to as the angle θ3.

When relative positions of the post-development pole N1 and the pre-development pole N2 are set so that the angle θ3 formed by the post-development center line L3 and the pre-development center line L1 is 180° or greater, the magnetic flux forming the release pole (N1) is more likely to flow to the development pole S1, and thus the magnetic field generated between the release pole (N1) and the attraction pole (N2) can be smaller. Thus, the developer 32 can be separated from the development sleeve 34*a* reliably.

Therefore, in the present embodiment, because the post-development pole N1 and the pre-development pole N2 can be set so that the angle θ3 formed by the post-development center line L3 and the pre-development center line L1 is 180° or greater, the developer can be separated from the development sleeve 34*a* reliably even when the diameter of the development sleeve is relatively small.

Figure 8:
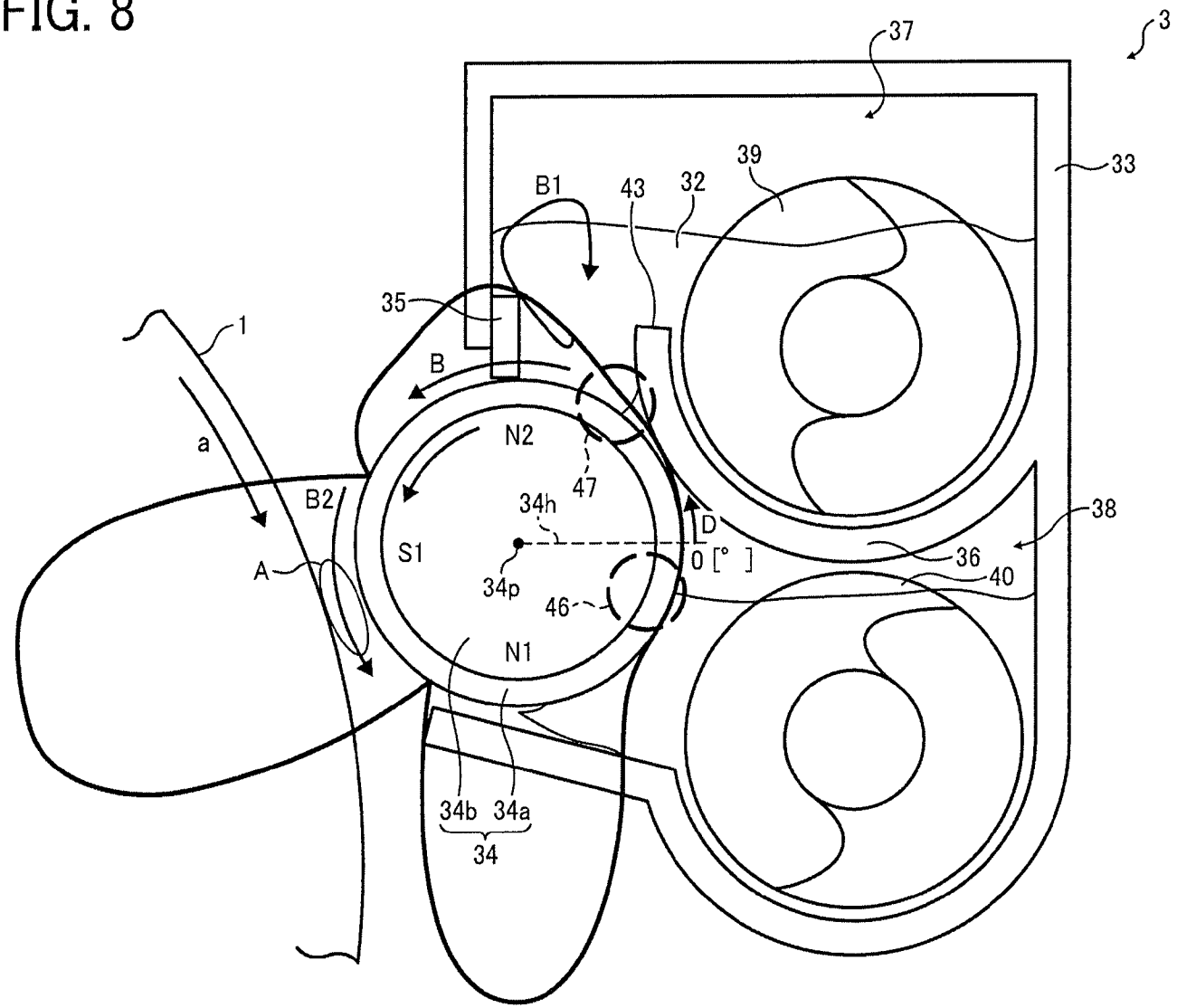
FIG. 8 illustrates the configuration of the development device shown in FIG. 2 together with a waveform of the magnetic fields around the development roller.

FIG. 8 illustrates the configuration of the development device 3 shown in FIG. 2 together with a waveform of the magnetic fields around the development roller 34. It is to be noted that, in FIG. 8, reference character 34*h* represents a horizontal axis passing through the center of rotation 34*p* of the development roller 34.

As in the development device 3 shown in FIGS. 2 and 8, when the number of the magnetic poles is three and the developer 32 in the supply path 37 is poured onto the development sleeve 34*a* and transported unidirectionally, the developer 32 can be reliably supplied to the development sleeve 34*a* and transported thereby. That is, because unidirectional development devices include separate developer transport paths (circulation path 38 and supply path 37) to collect the developer from the development sleeve and supply the developer to the development sleeve, a longer interval can be maintained between the release portion 46 and the attraction portion 47.

In particular, by setting the angle θ3, formed by connecting the magnetic flux peak density M3 (shown in FIG. 7) in the post-development pole N1, the center of rotation 34*p*, and the magnetic flux peak density M1 (shown in FIG. 7) in the pre-development pole N2, to an angle not smaller than 180° (θ3≥180°, the magnetic attraction in normal direction can be smaller in the release portion 46, attaining reliable release of developer.

In the first embodiment, by setting the magnetic flux density at the center M1, where the magnetic flux density is maximum in the pre-development pole N2, in normal direction to the surface of the development sleeve 34*a* to 10 mT or greater, the force to keep the developer on the surface of the development sleeve 34*a* can be greater than the force of the developer to fall under its own weight. Thus, the developer can be prevented from falling to the circulation path 38.

The magnetic fields and the release of developer when the angle θ3 is 180° are described below with reference to FIGS. 9A and 9B.

Figure 9A:
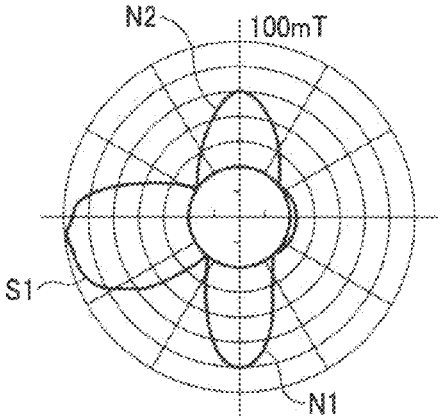
FIG. 9A is a graph illustrating a waveform of magnetic flux density in normal direction when an angle θ3 is 180° in the development device shown in FIG. 2.
Figure 9B:
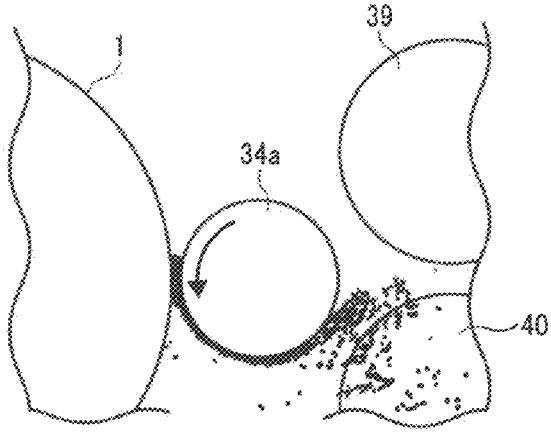
FIG. 9B illustrates movement of the developer calculated using the waveform shown FIG. 9A.

FIG. 9A illustrates a waveform of the magnetic fields representing the degree of the magnetic flux density in the normal direction to the surface of the development sleeve 34*a* when the angle θ3 is 180°. FIG. 9B illustrates movement of the developer based on the result calculated using the waveform shown FIG. 9A. In the calculation, the diameter and the rotational velocity of the development sleeve 34*a* are respectively set to 10 mm and 200 mm/s, and the magnetic moment and the particle size of the particles are respectively set to 75 emu/g and 40 μm. In FIG. 9A, a maximum of the magnetic flux density is 100 mT.

When the angle θ3 is 180°, as shown in FIG. 9A, the peak of the magnetic flux density in normal direction is about 5 mT in an area between the post-development pole N1 serving as the release pole and the pre-development pole N2 serving as the attraction pole, and the magnetic fields generated by the magnets N1 and N2 are not sufficiently strong for the development sleeve 34*a* to carry the developer between the post-development pole N1 and the pre-development pole N2. Additionally, it is can be known form FIG. 9B that, after passing through the portion facing the photoconductor 1, the developer can leave the development sleeve 34*a* at the portion facing the circulation screw 40, that is, the developer can be separated from the developer sleeve 34*a* reliably.

The magnetic fields and the release of developer in a comparative example 1 in which the angle θ3 is 150° are described below with reference to FIGS. 10A and 10B.

Figure 10A:
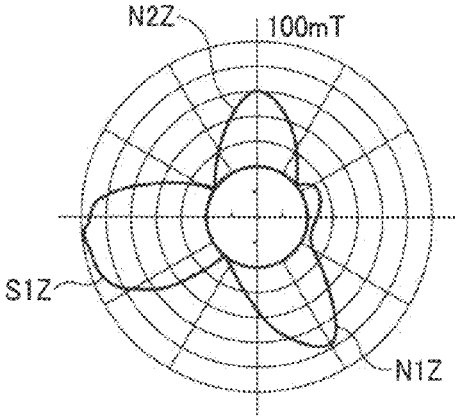
FIG. 10A is a graph illustrating a waveform of magnetic flux density in normal direction when an angle θ3 is 150° in a comparative example.
Figure 10B:
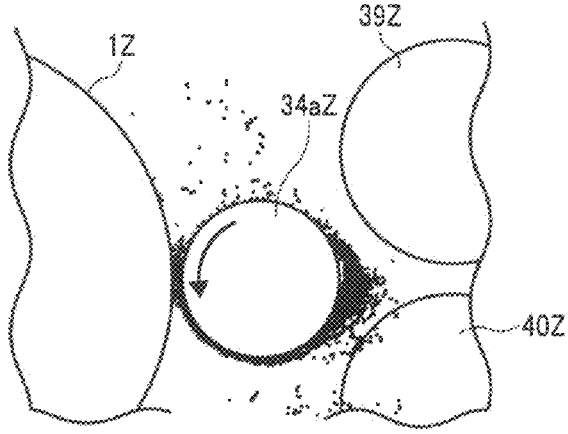
FIG. 10B illustrates movement of the developer based on the result calculated using the waveform shown FIG. 10A.

FIG. 10A illustrates a waveform of the magnetic fields when the angle θ3 is 150°. FIG. 10B illustrates movement of the developer based on the result calculated using the waveform shown FIG. 10A. The conditions in the calculation are similar to those used for the graph shown in FIG. 9A except the value of the angle θ3.

In the comparative example 1, as shown in FIG. 10A, the peak of the magnetic flux density is about 12 mT in an area between a post-development pole N1Z and a pre-development pole N2Z. Additionally, it can be known from FIG. 10B that, after passing through the portion facing a photoconductor 1Z, a certain amount of developer fails to leave the development sleeve 34*a*Z1 (hereinafter "carried-over developer") at the portion facing a circulation screw 40Z, and the developer is transported to a portion facing a supply screw 39Z. Thus, reliable release of developer cannot be attained.

Next, comparison of the three-pole configuration and the five-pole configuration in the development sleeve 34*a* whose diameter is smaller is described below.

Typically, when the number of the developer-carrying magnetic pole is not less than five, the magnetic repulsion in normal direction to the surface of the development sleeve can be sufficiently strong to separate the developer from the development sleeve. When the development sleeve has a relatively large diameter, even when multiple magnets forming the magnet roller are provided inside the development sleeve, a certain amount of space can be maintained between the magnets, and thus flexibility in the arrangement of the magnets is increased. By contrast, when the number of the magnets is smaller, and the space between the magnetic fields generated by the respective magnets is excessively large, vectors of the density of the magnetic flux generated between the magnetic poles are more uneven, and thus it is difficult to transport the developer reliably.

In other words, when the number of the magnets is greater, the magnets are arranged at smaller intervals, and accordingly each magnet can be affected by the magnetic force generated by other magnets, failing to generate a necessary distribution of the magnetic flux density. By contrast, when the number of the magnets is smaller, the space between the magnets is excessively large, and it is difficult to transport the developer reliably. Therefore, the number of the magnets should be determined according to the diameter of the development sleeve 34*a*.

Figure 11:
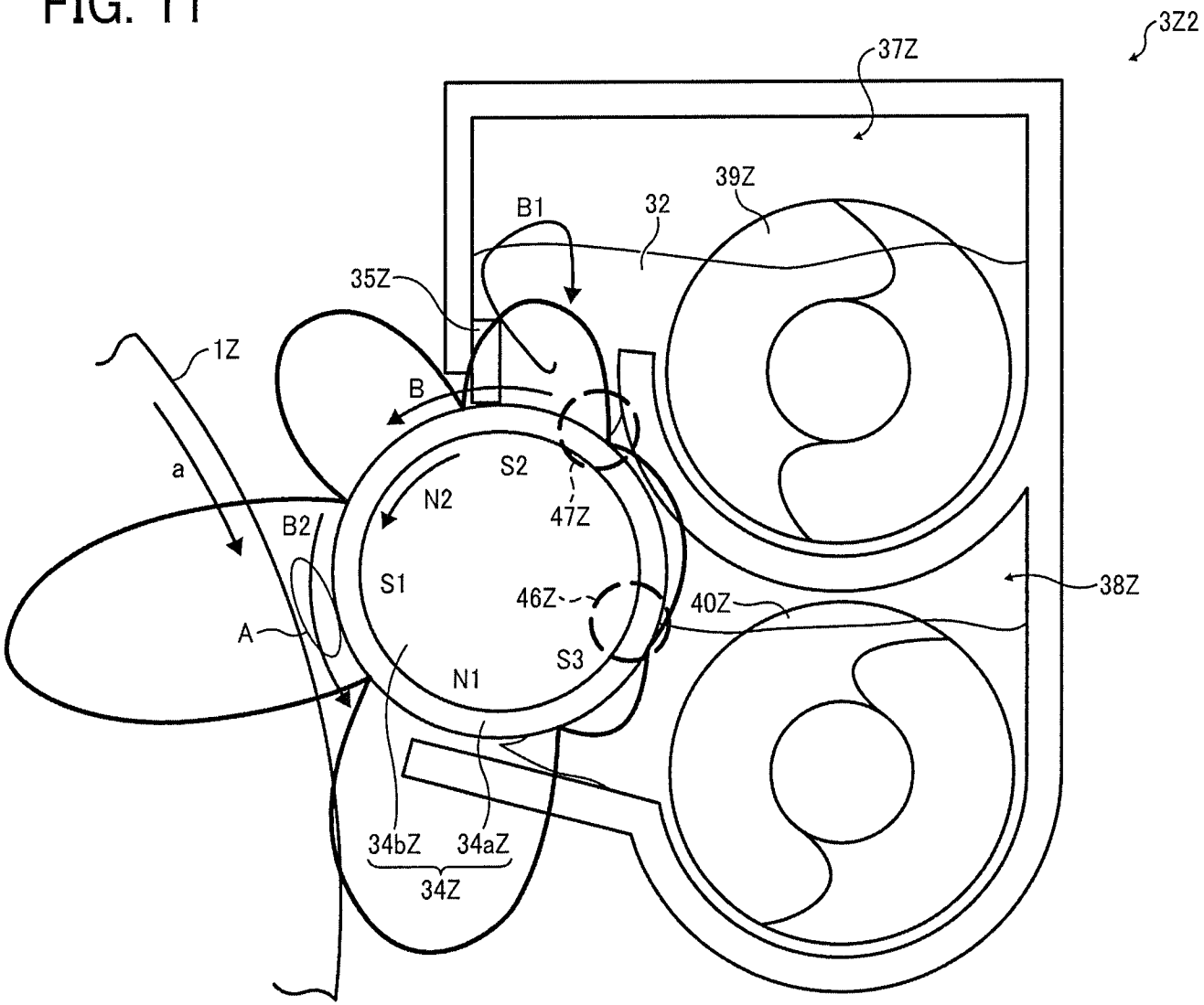
FIG. 11 is a schematic diagram illustrating a configuration of a five-pole development device according to another comparative example.

FIG. 11 is a schematic diagram illustrating a configuration of a development device 3Z2 according to a comparative example 2. Differently from the development device 3 according to the first embodiment shown in FIGS. 2 and 8, the development device 3Z2 uses a five-pole development roller 34Z formed by a development sleeve 34*a*Z in which a five-pole magnet roller 34*b*Z is provided. Hereinafter, although a suffix Z is added to the reference character of each component of the development device according to any one of the comparative examples, they have similar configurations to those of the first embodiment shown in FIGS. 2 and 8 unless described otherwise, and thus descriptions thereof are omitted.

When a development sleeve 34*a*Z has a diameter within a range from about 6 mm to 12 mm and is relatively small, because the magnets are arranged at smaller intervals, each magnet is more susceptible to the magnetic force lines generated by other magnets. In other words, to attain desired distribution of magnetic flux density, the magnets should be arranged precisely, and it is difficult to attain desired distribution of magnetic flux density in this configuration.

By contrast, as described above, in the three-pole configuration shown in FIGS. 2 and 8, the magnets can be arranged at greater intervals than the intervals in the five-pole configuration shown in FIG. 11 even when the development sleeve 34*a* has such a relatively small diameter (e.g., 6 mm to 12 mm), which can increase flexibility in forming the distribution of the magnetic flux distribution. Simultaneously, in the three-pole configuration, the number of the magnets is sufficient to maintain proper intervals, not excessively long, between the magnets so that the developer can be transported reliably.

When the diameter of the development sleeve 34*a* is smaller, because the interval between the centers (M1 and M2, and M2 and M3), which is the peak of magnetic flux density, of two adjacent magnetic poles is sufficiently small. Therefore, the single pre-development pole N2 can serve as both the attraction pole and the pre-development transport pole. Similarly, the development pole S1 and the post-development pole N1 together perform processes of three magnetic poles, namely, the development pole, the post-development transport pole, and the release pole. Thus, the magnetic fields generated by the magnets S1, N1, and N2 can be sufficiently strong for performing the processes of attracting the developer, transporting the developer, developing the latent image with the developer, and releasing the developer from the development sleeve, and thus these processes can be performed reliably.

Thus, the three-pole development roller 34 shown in FIGS. 2 and 8 is preferred to the five-pole development roller 34Z shown in FIG. 11.

In the present embodiment, because the three magnetic poles have functions of attracting the developer to the development sleeve, development, and releasing the developer from the development sleeve, all of the processes of attraction of the developer to the development sleeve, adjustment of the amount of the developer carried on the development sleeve, development, and release of the developer from the development sleeve can be reliably performed similarly to typical configurations in which the number of magnetic poles is five.

The magnetic force F (N) can be expressed using the formula below.

$$F = \frac{4\pi}{\mu_0}\frac{\mu - 1}{\mu + 2}\frac{a^3}{8}B \cdot \nabla B$$

wherein the B (T) represents the magnetic flux density, $\mu_0$ (H/m) represents the magnetic permeability at vacuum, $\mu$ represents a relative magnetic permeability of carrier particles, and a represents a particle diameter of carrier particles.

The graph described below illustrates the magnetic force when carrier particles have a diameter of 35 am and a relative magnetic permeability of 8 as an example.

Figure 12:
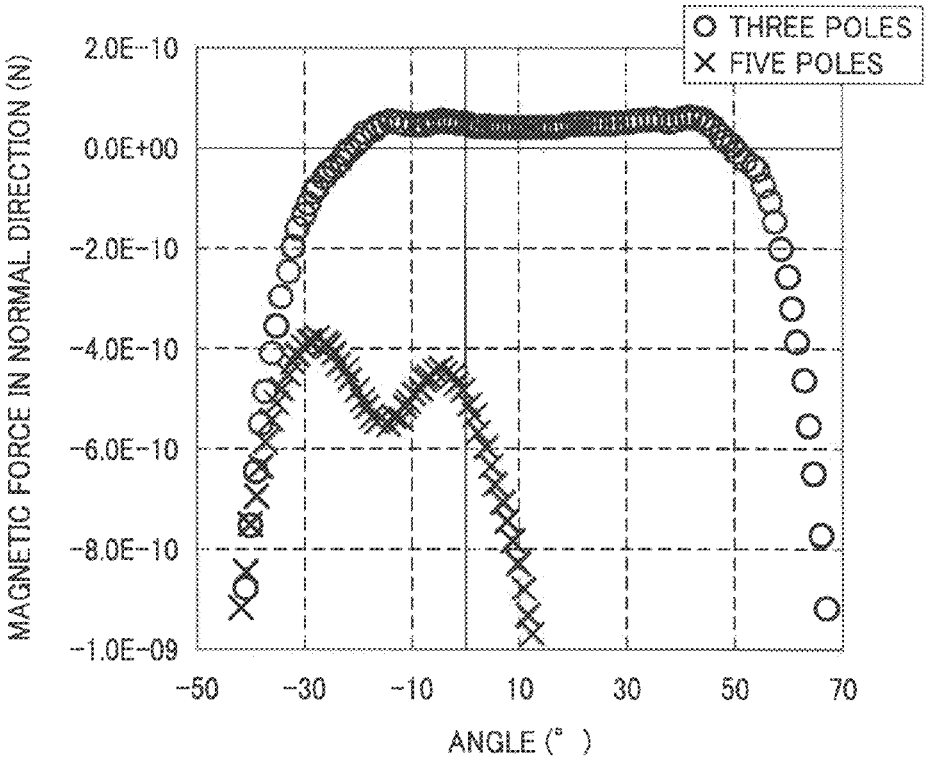
FIG. 12 is a graph illustrating a comparison of the magnetic force in normal direction to the surface of the development sleeve around a release portion between in the three-pole development device shown in FIG. 8 and the five-pole development device shown in FIG. 11.

FIG. 12 is a graph illustrating a comparison between the magnetic force in normal direction to the surface of the development sleeve 34*a* around the release portion 46 in the three-pole development device 3 shown in FIG. 8 and that in the five-pole development device 3Z2 shown in FIG. 11. To make the graph shown in FIG. 12, the magnetic force was actually measured.

In FIG. 12, "○" represents the magnetic force in the three-pole configuration, and "x" represents that in the five-pole configuration, a vertical axis represents the magnetic force, and a horizontal axis indicates an angle that is "0" where the horizontal axis 34*h* crosses the surface of the development sleeve 34*a* and increases in the plus direction as the angle position moves in the direction indicated by arrow D shown in FIG. 8. It is to be noted that, in this specification, "angle" means the center angle formed by the horizontal axis 34*h* shown in FIG. 8 and a line connecting the center of rotation 34*p* and a given point on the surface of the development sleeve 34*a* unless otherwise specified.

Referring to FIG. 12, as the magnetic force in normal direction approaches 0 N, the magnetic force to attract the developer on the development sleeve 34*a* decreases, and accordingly the developer leaves the development sleeve 34*a* due to gravity.

The magnetic force in normal direction functions as the magnetic attraction when being in the minus direction. In the graph shown in FIG. 12, as the magnetic force in normal direction increases in the minus direction, the magnetic force to attract the developer on the development sleeve 34*a* increases, and the frictional force therebetween also increases. Accordingly, the developer is less likely to leave the development sleeve 34*a*. In this case, the magnetic force serves as the magnetic attraction also in the release portion 46, and developer fails to leave the development sleeve 34*a*, which is not desirable. This phenomenon is hereinafter referred to as developer release failure.

By contrast, the magnetic force in normal direction functions as the magnetic repulsion when being in the plus direction.

In the development device 3 shown in FIG. 8 and the comparative example shown in FIG. 11, the release portion 46 is disposed in an angle range from −40° to 0°. When the magnetic force was measured in the comparative example 2 using the five-pole development sleeve 34*a*Z whose diameter was 10 mm, a magnetic force Fr in normal direction around the release portion 46Z was not greater than about $-4\times10^{-10}$ N ($Fr\leq-4\times10^{-10}$). Thus, developer failed to leave the development sleeve 34*a*Z.

In this measurement, the magnetization, particle size, and density of the carrier particle was within a range from 30 emu/g to 120 emu/g, a range from 20 μm to 80 μm, and a range from 3 g/cm$^3$ to 8 g/cm$^3$, respectively.

Typically, in the five-pole development device 3Z2, the developer can be separated from the development sleeve 34*a*Z by generating the magnetic repulsion in normal direction in the release portion 46Z. However, when the development sleeve 34*a*Z has reduced diameter within a range from about 6 mm to 12 mm, because each magnet is more susceptible to the magnetic force lines generated by other magnets, it is difficult to generate desired magnetic repulsion in normal direction.

In the three-pole development device 3 shown in FIG. 8, the release of developer in the release portion 46 can be improved by reducing the magnetic flux density in the attraction portion 47. When the magnetic force was measured in the development device 3 shown in FIG. 8, developer was reliably separated from the development sleeve 34*a* when the magnetic flux density in normal direction at the center M1 (magnetic flux density peak) of the pre-development pole N2 was not greater than 30 mT.

The magnetic force lines from the post-development pole N1 partly flow into the development pole S1, and the rest of the magnetic force lines pass around the release portion 46 and then return to the post-development pole N1. Similarly, the magnetic force lines from the pre-development pole N2 partly flow into the development pole S1, and the rest of the magnetic force lines pass around the release portion 46 and then return to the pre-development pole N2.

The vector of magnetic force around the release portion 46 is determined by the balance between the magnetic force lines flowing from the post-development pole N1 and returning thereto and that flowing from the pre-development pole N2 and returning thereto. When the magnetic flux density in the pre-development pole N2 is reduced, the magnetic force lines flowing from the pre-development pole N2 to the development pole S1 increase relatively, and the magnetic force lines that pass around the release portion 46 are decreased. As a result, the magnetic attraction in normal direction in the release portion 46 can be reduced.

This relation can be expressed as $Br_1>Br_3$, wherein the peak of magnetic flux density in normal direction of the development pole S1 is $Br_1$ (hereinafter simply "magnetic flux density peak in S1"), and the peak of magnetic flux density in normal direction of the pre-development pole N2 is referred to $Br_3$ (hereinafter simply "magnetic flux density peak in N2").

Figure 13:
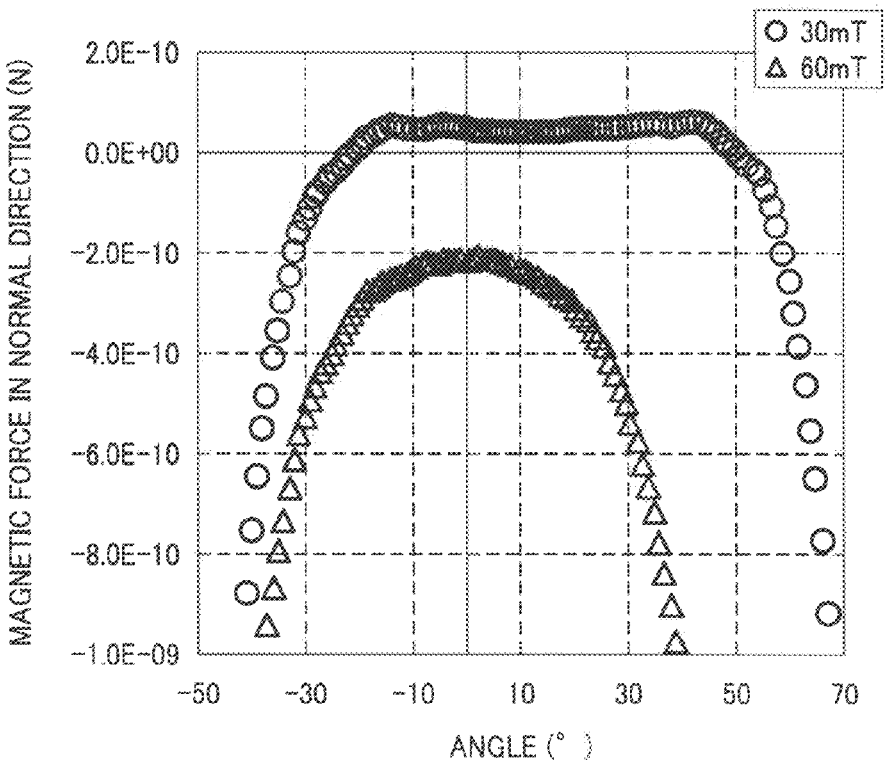
FIG. 13 is a graph illustrating magnetic attraction in normal direction at respective positions around the release portion when the peak of the magnetic flux density in normal direction in a pre-development pole N2 is set to 30 mT and 60 mT.

FIG. 13 is a graph illustrating the magnetic attraction in normal direction measured around the release portion 46 in the development device 3 according to the first embodiment. In the measurement, the peak of the magnetic flux density in normal direction in the pre-development pole N2 was set to 30 mT and 60 mT.

The release portion 46 was set to the angle range from −40° to 0° in the direction indicated by arrow D shown in FIG. 8. As it is known form FIG. 13, when the peak of magnetic flux density in normal direction of the pre-development pole N2 was 30 mT, which is half of 60 mT, the magnetic attraction in normal direction in the release portion 46 was substantially zero, and thus the developer was reliably separated from the development sleeve 34*a*.

(Relation Between Developer Release and Magnetic Flux Densities in Development Pole and Developer Release Pole)

The magnetic attraction in normal direction can be reduced when the relation $Br_1>Br_2$ is satisfied, wherein $Br_1$ represents the magnetic flux density peak in S1, and $Br_2$ represents the peak of magnetic flux density in normal direction of the post-development pole N1 (hereinafter simply "magnetic flux density peak in N1").

Figure 14:
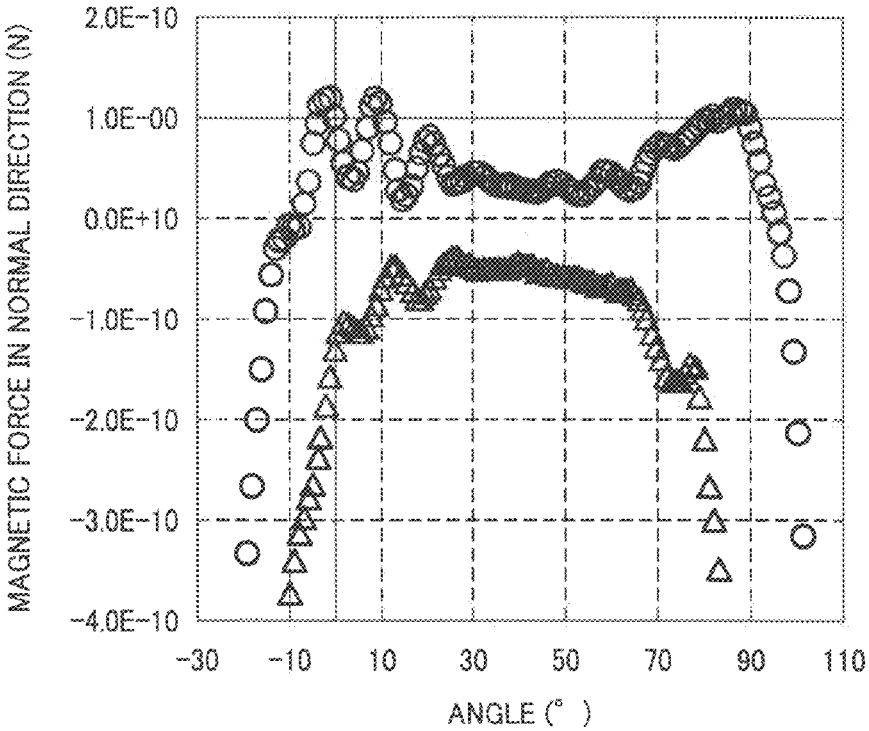
FIG. 14 is a graph comparing the magnetic attraction in normal direction around the release portion measured when a relation $Br_1 \geq Br_2$ is satisfied and when this relation is not satisfied.

FIG. 14 is a graph comparing the magnetic attraction in normal direction around the release portion 46 measured when $Br_1$ and $Br_2$ were substantially the same and that measured when $Br_1>Br_2$ in a development device 3A shown in FIG. 26 to be described later. In this measurement, the release portion 46 was set to the angle range from 20° to 50° (hereinafter referred to "release angle") in the direction indicated by arrow D shown in FIG. 8.

As described above, the magnetic force lines from the post-development pole N1 partly flow into the development pole S1, and the rest passes around the release portion 46 and return to the post-development pole N1. As shown in FIG. 14, when $Br_2$ (magnetic flux density peak in N1), is lower than $Br_1$ (magnetic flux density peak in S1), the magnetic force lines flowing from the post-development pole N1 to the development pole S1 increase, and the magnetic force lines flowing from the post-development pole N1 passing around the release portion 46 are decreased. As a result, the magnetic attraction in normal direction in the release portion 46 can be reduced.

From the descriptions above, it can be known that the magnetic attraction in normal direction in the release portion 46 can be reduced when both $Br_1>Br_2$ and $Br_1>Br_3$ are satisfied.

Next, the relation between $Br_2$ (magnetic flux density peak in N1) and $Br_3$ (magnetic flux density peak in N2) is described below.

As described above, the post-development pole N1 needs to transport the developer that has been used in development. Additionally, the post-development pole N1 needs to cause the carrier particles that have adhered to the photoconductor 1 in the development range A to be again attracted to the development sleeve 34*a*. Therefore, $Br_2$ (magnetic flux density peak in N1) should be sufficiently high to transport the developer as well as to attract the carrier particles. Also in the relation between $Br_2$ (magnetic flux density peak in N1) and $Br_3$ (magnetic flux density peak in N2), when either of them is to be increased, the other should be reduced to balance the magnetic force on the development sleeve 34*a* because the developer is inhibited from leaving the development sleeve 34*a* if both of them are increased, that is, magnetic force in total increases.

Therefore, in the present embodiment, to secure the above-described functions of the post-development pole N1, $Br_2$, magnetic flux density peak in N1, should be higher than $Br_3$, magnetic flux density peak in N2 ($Br_2>Br_3$). That is, the relation $Br_1>Br_2>Br_3$ is satisfied.

Next, a comparative example in which the number of the developer-carrying magnetic pole is only one (hereinafter "single-pole configuration") is described below.

Figure 15:
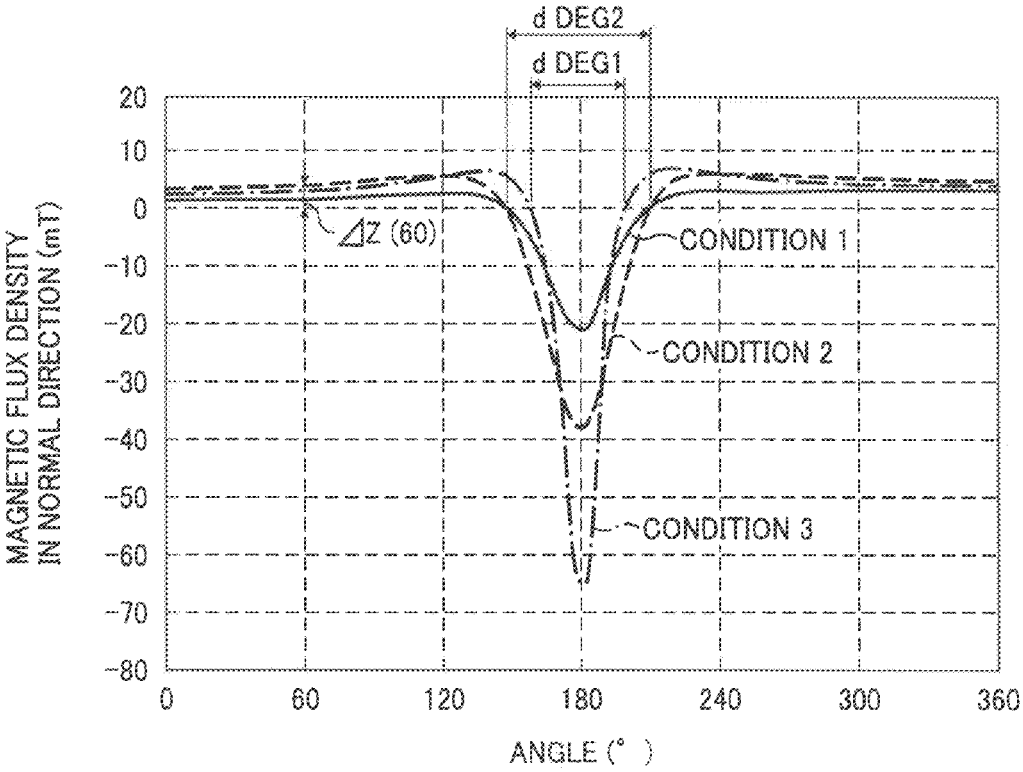
FIG. 15 is a graph illustrating distribution of the magnetic flux density in normal direction at respective positions on the surface of the development sleeve under three different conditions in a single-pole configuration.

FIG. 15 is a graph illustrating distribution of the magnetic flux density in normal direction at respective positions on the surface of the development sleeve in the single-pole configuration, and three different conditions are used. In FIG. 15, an angle of 180° on the horizontal axis represents the peak position of the magnetic flux density in normal direction. In FIG. 15, reference character dDEG (dDEG1 and dDEG2) represents an angle range including the peak position of the magnetic flux density in normal direction, formed by the center of rotation of the development sleeve and two positions on the circumference of the development sleeve at which the magnetic flux density in normal direction to the surface of the development sleeve is 0 mT. Conditions 1 through 3 used to obtain the graph shown in FIG. 15 are specified in table 1 shown below.

TABLE 1

| Condition | Peak value (-mT) | Half hand width (°) | dDEG (°) | X | ΔZ (60) | X/ (360-dDEG) |
|---|---|---|---|---|---|---|
| 1 | 21 | 30.5 | 62 | 640.5 | 2.1 | 2.1 |
| 2 | 37 | 35.5 | 62 | 1313.5 | 4.1 | 4.1 |
| 3 | 63 | 18 | 39 | 1134 | 3.3 | 3.2 |

In FIG. 15 and table 1, ΔZ (60) represents the magnetic flux density at an angle of 60° on the circumference of the development sleeve. As shown in FIG. 15, under any of the conditions 1, 2, and 3, although fluctuations in the magnetic flux is significant around the peak position of magnetic flux density in normal direction, the magnetic flux is substantially constant around the angle of 60° on the circumference of the development sleeve. It is to be noted that an angle of 60° on the circumference of the development sleeve means a rough angle at which a mean value of the magnetic flux densities in plus direction in FIG. 15 is obtained.

In the single-pole configuration, when it is assumed that the polarity of the peak position of the magnetic flux density in normal direction is N pole (negative direction in FIG. 15), an magnetic field whose polarity is S pole (positive direction in FIG. 15, opposite that of the peak position) is generated in a range on the surface of the development sleeve except the range (dDEG1 and dDEG2) whose polarity is N pole, which is identical to that of the peak position.

At this time, the integrated density of magnetic flux in normal direction in the N pole range is identical or similar to the integrated density of magnetic flux in normal direction in the S pole range on the surface of the development sleeve.

A product of a peak value Br of the magnetic flux density and a half band width θh in that magnetic pole can be used as an approximation of the integrated density of magnetic flux in normal direction in the range whose polarity is identical to that of the peak position. Hereinafter, the product of the peak value Br and the half band width θh is referred to as a magnetic flux density product X. The half hand width θh means, in a magnetic field generated by a single magnetic pole, an angle in an angle range including the peak position of the magnetic flux density in normal direction, formed by the center of rotation of the development sleeve and two positions on the circumference of the development sleeve where the magnetic flux density in normal direction is half the peak value Br.

Because the integrated density of magnetic flux in normal direction in the range whose polarity is identical to that of the peak position is identical or similar to that in the range whose polarity is the opposite, the mean value of the magnetic flux density in normal direction in the range whose polarity is the opposite can be identical or similar to a value obtained by dividing the magnetic flux density product X by the center angle (360−dDEG) of the range whose polarity is the opposite.

Additionally, under any of the conditions 1 through 3 shown in table 1, the value of X/(360−dDEG) is similar to ΔZ (60), and accordingly it can be known that the integrated density of magnetic flux in normal direction in the range whose polarity is opposite that of the peak position appropriates to the product of the peak value Br and the half hand width θh.

As shown in table 1, the magnetic pole under condition 1 has a peak value of −23 mT and a half band width of 30.5°. Then, the product X of these values is 640.5, and the mean value of the magnetic flux density in normal direction of the opposite polarity is 2.1 mT. Similarly, under the condition 2, the product X of these values is 1313.5, and the mean value of the magnetic flux density in normal direction of the opposite polarity is 4.1 mT. Thus, the product X and the mean value of the magnetic flux density in normal direction of the opposite polarity under condition 2 are respectively 2.05 times and 1.95 times the values obtained under condition 1. That is, under the conditions 1 and 2 in which the values of dDEG are identical, the mean value of the magnetic flux density in normal direction of the opposite polarity is substantially proportional to the product X. Additionally, under the condition 3 in which the value of dDEG is different, a similar relation can be observed.

Although the description above concerns the single-pole configuration, in multiple magnetic-poles configurations, basically, the above-described theory works by integrating the distributions of magnetic flux density in normal direction. To be more exact, the description in the multiple-poles configuration is not so simple because it is possible that a magnetic circuit may be formed inside the development sleeve and the magnetic field does not leak to the surface. However, when the number of the magnetic poles is relatively small as in the present embodiment, an approximate graph of the distribution of magnetic flux density in normal direction can be drawn by integrating the distribution of magnetic flux density in the single-pole configuration.

Figure 16:
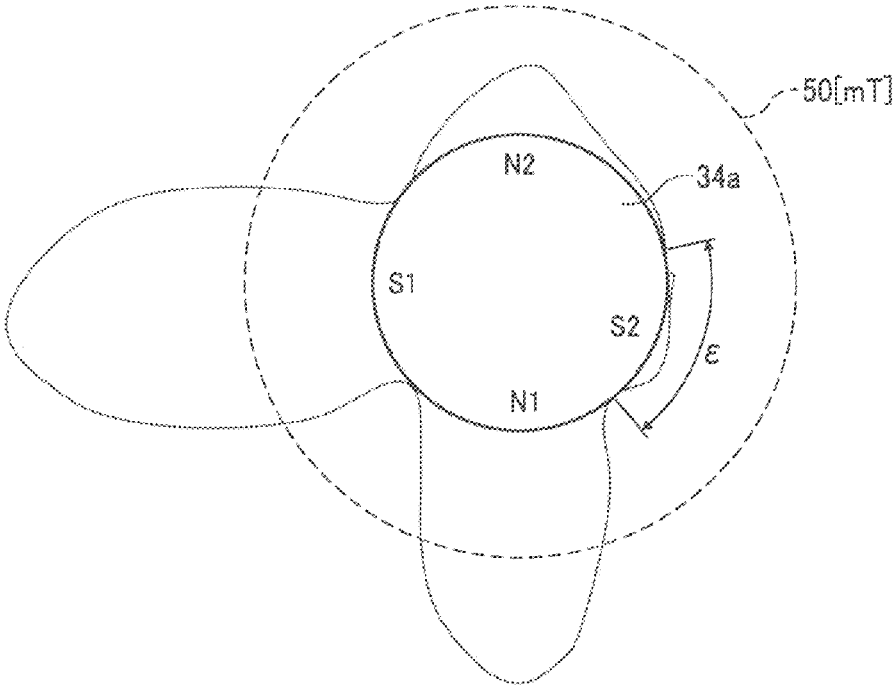
FIG. 16 illustrates an example of distribution of magnetic flux density in normal direction around the development sleeve in which the density peak of the magnetic flux of the opposite polarity is considered.

That is, on the circumferential surface of the development roller, the integrated density of magnetic flux in normal direction whose polarity is S pole can be substantially identical to the integrated density of magnetic flux in normal direction whose polarity is N pole. Additionally, when the density peak of magnetic flux is relatively large as in the conditions 2 and 3 for FIG. 15, the density peak of magnetic flux of the opposite polarity, which arises around a position on the development sleeve where the direction (plus/minus) of magnetic flux in normal direction is reversed, is also relatively large. FIG. 16 illustrates an example of distribution of magnetic flux density in normal direction around the development sleeve in which the density peak of the magnetic flux of the opposite polarity is considered. Peak values, half band widths, and products X in the respective magnetic poles, shown in FIG. 16, provided in the development sleeve 34*a* are specified in table 2 shown below.

TABLE 2

| Condition | Peak value (−mT) | Half hand width (°) | X |
|---|---|---|---|
| S1 | 95 | 48 | 4560 |
| N1 | 90 | 33 | 2970 |
| N2 | 30 | 42 | 1260 |

In the present embodiment, because the density peak of magnetic flux in the post-development pole N1 is larger, a magnetic pole S2 whose polarity is opposite the polarity of the post-development pole N1 is formed downstream from the post-development pole N1 in the rotational direction of the development sleeve 34*a* as shown in FIG. 16. Although another S pole whose polarity is opposite the polarity of the post-development pole N1 is formed upstream from the post-development pole N1 in that direction, because the development pole S1 has a peak of magnetic flux density sufficiently larger than that of that S pole, the distribution of magnetic flux density in normal direction of that S pole is integrated into the development pole S1. Although the density peak of magnetic flux in the development pole S1 is also larger, because the opposite pole of the development pole S1 is sandwiched between the post-development pole N1 and the pre-development pole N2 whose peak values are sufficiently larger than that of the opposite pole, the distribution of magnetic flux density in normal direction of the pole opposite the development pole S1 is integrated into the post-development pole N1 and the pre-development pole N2.

As shown in FIG. 16, if the magnetic pole S2 is formed, the magnetic pole S2 might serve as a developer transport pole of the developer that has passed the position facing the post-development pole, inhibiting the release of the developer from the development sleeve 34*a*. Therefore, the effect of the magnetic pole S2 should be inhibited.

In the present embodiment, to inhibit the effect of the magnetic pole S2, it is preferred that the product X of the magnetic flux density peak Br and the half hand width θh in the development pole S1 be greater than the sum of the product (X=Br·θh) in the post-development pole N1 and the product (X=Br·θh) in the pre-development pole N2.

Setting the product X in the development pole S1 is described below. Hereinafter, reference characters $Br_1$ $\theta h_1$, and X1 represent the magnetic flux density peak in normal direction, the half hand width, and the magnetic flux density product, respectively, in the development pole S1 in the present embodiment.

Similarly, reference characters $Br_2$ $\theta h_2$, and X2 represent the magnetic flux density peak in normal direction, the half hand width, and the magnetic flux density product, respectively, in the post-development pole N1 whose peak of magnetic flux density is higher than that of the pre-development pole N2 although the polarity of them are identical. Similarly, reference characters $Br_a$ $\theta h_3$, and X3 represent the magnetic flux density peak in normal direction, the half hand width, and the magnetic flux density product, respectively, in the pre-development pole N2 whose peak of magnetic flux density is lower than that of the pre-development pole N1.

At this time, when the development roller 34 is configured so that the relations $Br_1>Br_2>Br_3$ and $Br_1\cdot\theta h_1>Br_2\cdot\theta_2+Br_3\cdot\theta$ are satisfied, the value of X1−(X2+X3) determines whether the mean value of magnetic flux density in normal direction in an area s shown in FIG. 16 is negative or positive. The areas shown in FIG. 16 is an area from the position where the magnetic flux density in normal direction is 0 mT downstream from the post-development pole N1 and to the position where the magnetic flux density in normal direction is 0 mT upstream from the pre-development pole N2 in the rotational direction of the development sleeve 34*a*. If the value of X1−(X2+X3) is negative, the polarity of the areas shown in FIG. 16 is S.

The polarity of the magnetic pole in normal direction to the surface of the development roller 34 is reversed to N in a downstream end portion in the area s shown in FIG. 16 in the rotational direction of the development sleeve 34*a*.

By contrast, if the value of X1−(X2+X3) is positive, the polarity of the area s shown in FIG. 16 is N. In other words, when X1>X2+X3 is satisfied, the polarity of the area c shown in FIG. 16 from the release pole (N1) to the attraction pole (N2) can be entirely identical (N pole) to that of the post-development pole N1 and the pre-development pole N2.

By setting the polarity of the area from the release pole (N1) to the attraction pole (N2) to the polarity identical to that of the release pole (N1), the developer can be better separated from the development sleeve 34*a* after passing through the development range A.

As described above, although the pole S2 is formed due to a relatively high peak value in the post-development pole N1, the magnetic flux density caused by the pole S2 can be reduced when X1>X2+X3 is satisfied. Even when the pole S2 generates an S magnetic field, because its polarity can be reversed to N immediately downstream from that magnetic field, the effects by the pole S2 can be inhibited. Therefore, fluctuations in the magnetic flux density in normal direction between the post-development pole N1 to the pre-development pole N2 can be reduced, which can facilitate release of the developer form the development sleeve 34*a*.

Additionally, the position where the polarity of the magnetic field generated by the pole S2 is reversed to N can be adjusted with the half band width of the attraction pole N2.

(Developer Release Angle)

Figure 17:
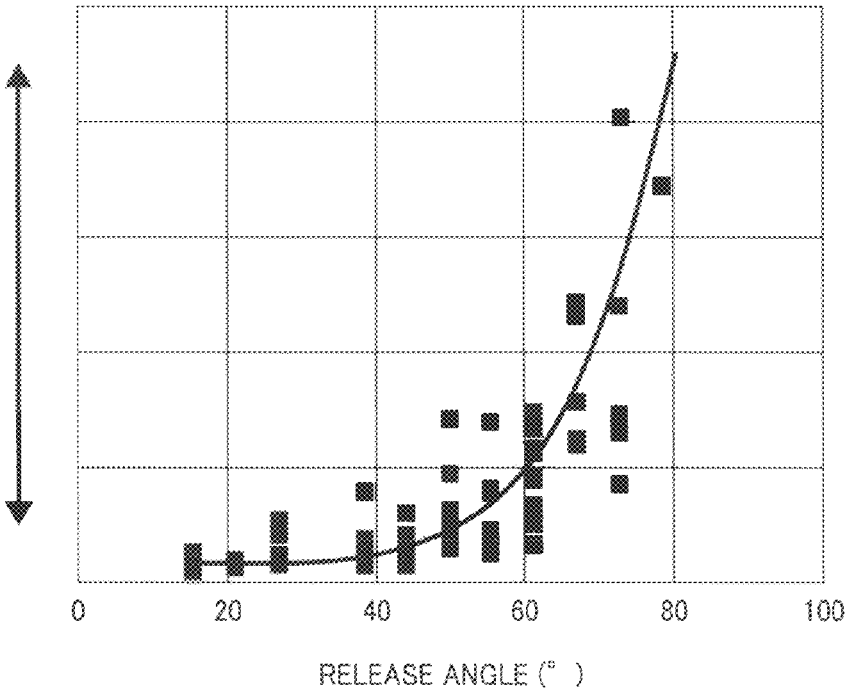
FIG. 17 is a graph illustrating a relation between the release angle and the amount of carried-over developer.
Figure 18A:
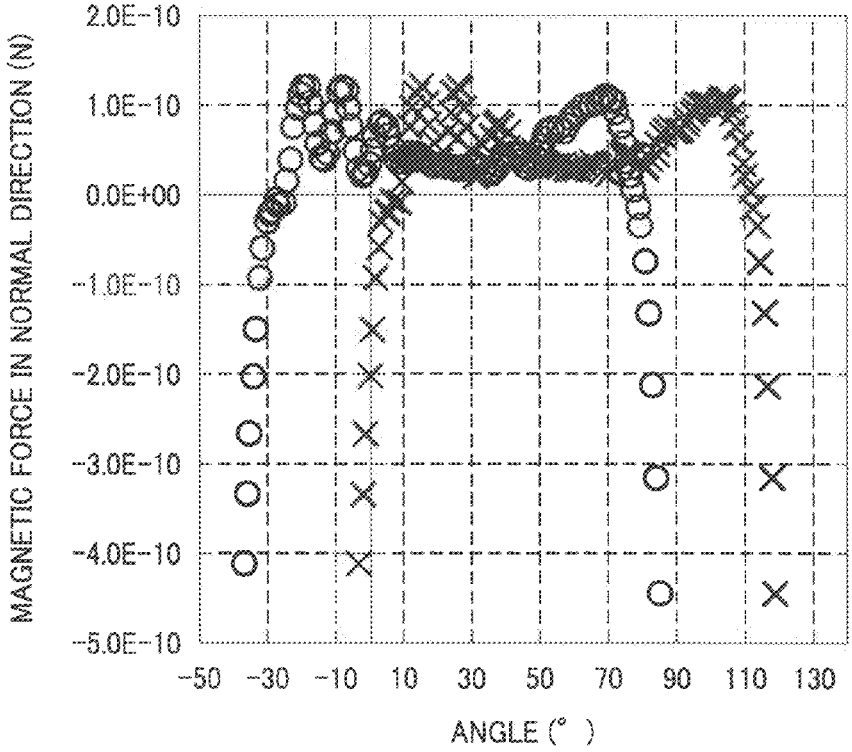
FIG. 18A is a graph illustrating the relation between the angle position on the circumferential surface of the development sleeve and magnetic force in the normal direction.

FIG. 17 illustrates a relation between the release angle and the amount of carried-over developer when the development sleeve 34*a* rotates counterclockwise and the angle at which the horizontal axis 34*h* crosses the surface of the development sleeve 34*a* is 0° as in the first embodiment shown in FIG. 7. In FIG. 17, a vertical axis indicates changes in the amount of carried-over developer. There are two factors with which the release angle varies: changes in the magnetic force of the development roller 34, and changes in the amount of the developer in the circulation path 38. The data shown in FIG. 17 were obtained in an experiment in which the release angle was varied by rotating a fixture, not shown, fixing the magnets of the magnetic roller 34*b*, and simultaneously, actual release angle was observed while the amount of the developer in the circulation path 38 was varied by changing the amount of the developer in the casing 33 of the development device 3. Experiments were performed using two different development rollers 34 whose magnetic force distributions (types A and B) were different only around the release portion 46. In FIG. 18A, ○ and x respectively represent the magnetic force distribution in normal direction of the types A and B, and in FIG. 18B, ○, and x respectively represent the magnetic force distribution in tangent direction of the types A and B, respectively.

Figure 18B:
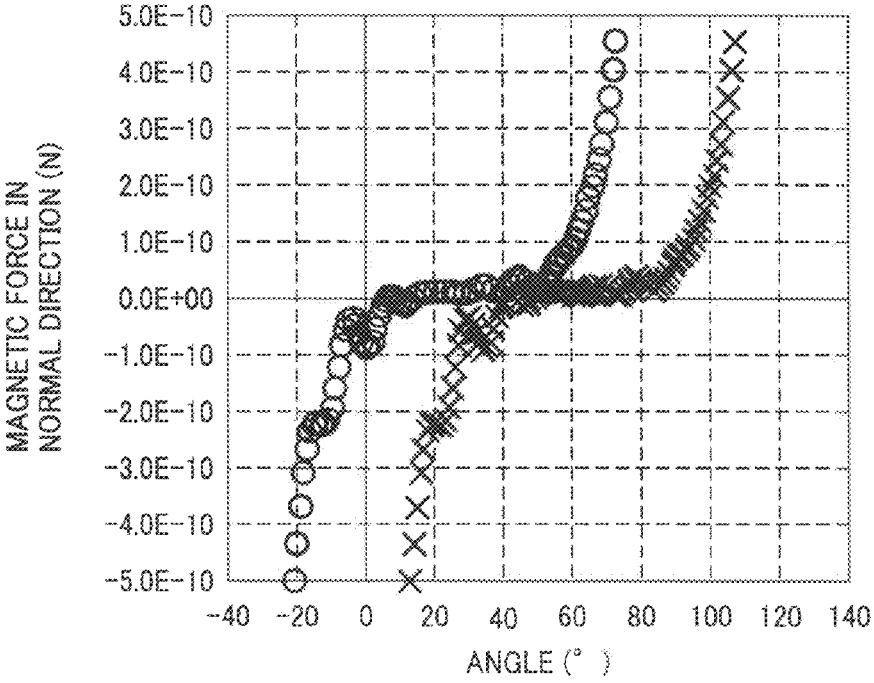
FIG. 18B is a graph illustrating the relation between the angle position on the circumferential surface of the development sleeve and magnetic force in a tangent direction.

When images were output in the experiment, the developer was reliably separated from the development sleeve 34*a* in the case of the magnetic force distribution type A represented by ○ shown in FIGS. 18A and 18B. However, the developer release failure occurred, causing an image failure in the case of the magnetic force distribution type B represented by x shown in FIGS. 18A and 18B.

As shown in FIG. 18A, the range where the magnetic attraction in normal direction was substantially zero is around a range from −20° to 60° in the type A and around a range from 20° to 100° in the type B.

Although, in both types A and B, the magnetic attraction in normal direction was substantially zero around the release portion 46 that in the present embodiment is within the range from 0° to 50°, the developer was reliably separated from the development sleeve 34*a* in the type A while the developer release failure occurred in the type B.

Figure 19:
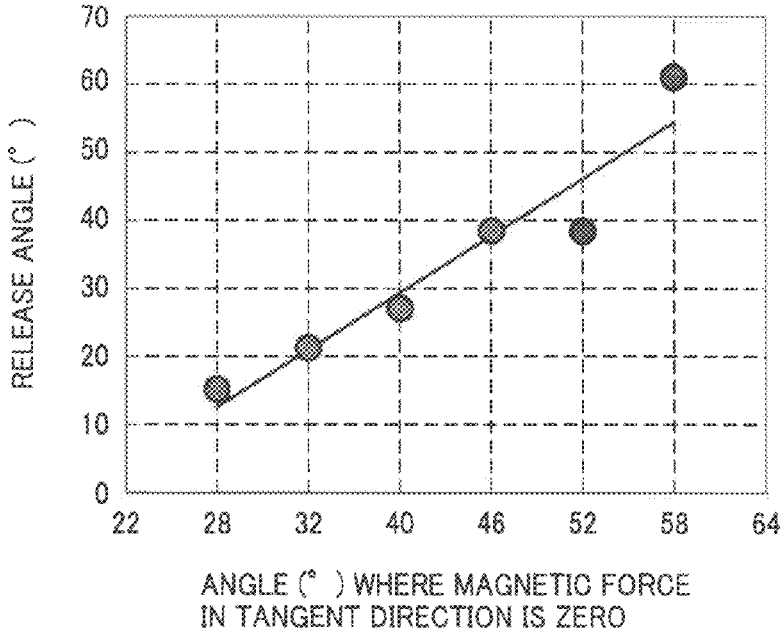
FIG. 19 is a graph illustrating the relation between the release angle and a range where the magnetic force in the tangent direction is zero.

FIG. 19 illustrates results of another experiment to observe the relation between the release angle and the range where the magnetic force in tangent direction is zero. In this experiment, although the magnetic force in normal direction was substantially zero around the release portion 46, the angle range where the magnetic force in tangent direction was zero was varied. A horizontal axis in FIG. 19 indicates, as the angle at which the magnetic force in tangent direction is zero, an angle on the surface of the development sleeve 34*a*, positioned at an upstream edge of the range where the magnetic force in tangent direction is zero in the rotational direction of the development sleeve 34*a*. From the graph shown in FIG. 19, it can be known that the developer 32 around the release portion 46 is transported close to the position where the magnetic force in tangent direction is zero. Herein, the release angle means the angle at which the developer 32 started to leave the development sleeve 34*a* in the experiment.

Image failure caused by the developer release failure is described below.

Because the circulation path 38 mainly contains the used developer whose toner concentration is lower, image density is decreased when such used developer is again transported by the development sleeve 34*a* and used in development. By contrast, the toner concentration is higher immediately after fresh toner is supplied to the circulation path 38, and accordingly image density is higher in this case. Although it is difficult to determine whether or not the image failure was caused by developer release failure if the difference is only the image density, in the case of developer release failure, the state of the developer 32 in the circulation path 38 is reflected in resulting images, which is distinctive feature of the developer release failure. For example, when unevenness in the image density of the resulting images corresponds to the pitch of the circulation screw 40, developer release failure can be regarded as the cause.

The magnetic field generated by each magnet of the magnet roller 34*b* has a specific size and a specific direction, and accordingly the magnetic force generated by the magnetic field has a specific size and a specific direction. As shown in FIG. 19, the developer 32 is transported close to the position where the magnetic attraction in normal direction is smaller and the vector thereof is perpendicular to the surface of the development sleeve 34*a*, that is, where the magnetic force in tangent direction is zero.

Figure 20:
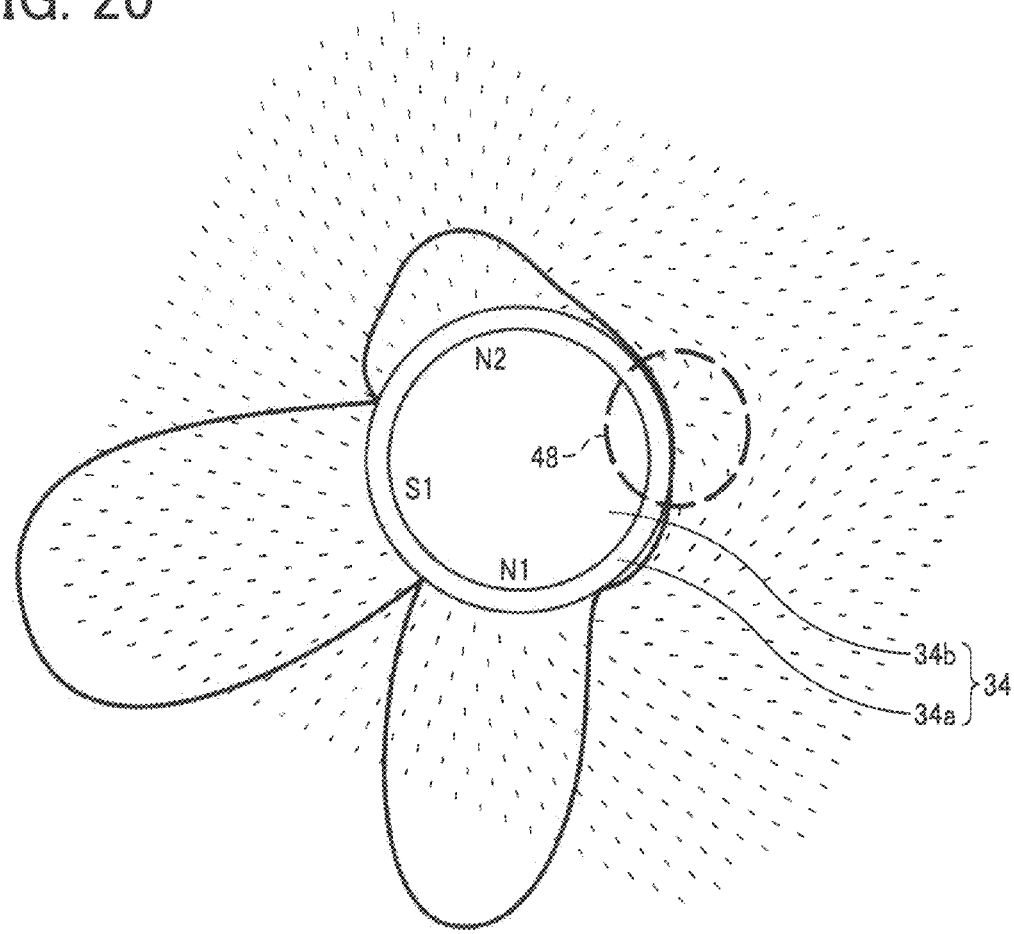
FIG. 20 illustrates a relation between the vector of magnetic force and the distribution of the magnetic flux density in the normal direction around the development roller.

FIG. 20 illustrates a relation between the vector of magnetic force and the distribution of the magnetic flux density in normal direction around the development roller 34. Although the developer 32 receives magnetic force along the vector of magnetic force generated by the magnets of the magnet roller 34*b*, the magnetic attraction in normal direction is smaller in the release portion 46, and the developer does not receive the force to be transported across a range 48 where the direction of the magnetic force in tangent direction changes, that is, the magnetic force in the tangent direction is substantially zero in the range 48. Therefore, the developer is transported only to the range 48.

From the graph, it can be known that, even when the magnetic force in normal direction is extremely small, the amount of carried-over developer significantly increases when the release angle is within the range from about 50° to °60 because, if the developer remains on the development sleeve 34*a* until that portion of the development sleeve 34*a* reaches the upper portion of the development roller 34, vertical repulsion from the development sleeve 34*a* increases due to the weight of the developer itself even when the magnetic force is not present at all. Accordingly, the frictional force between the development sleeve 34*a* and the developer carried thereon increases. As a result, the force of the development sleeve 34*a* to transport the developer increases, which increases the amount of carried-over developer. From the results shown in FIGS. 17 and 19, it can be known that the developer can be reliably released from the development sleeve 34*a* by disposing the range 48 shown in FIG. 20, where the magnetic force in tangent direction is zero, at an angle position not greater than 50° on the development sleeve 34*a*.

(Unidirectional Circulation and Non-Unidirectional Circulation)

Although, in the unidirectional development device 3 shown FIG. 2, the developer that has passed the development range A is sent to not the supply path 37 but the circulation path 38, a non-unidirectional development device 3Z3 according to a comparative example 3 is described below with reference to FIG. 21.

Figure 21:
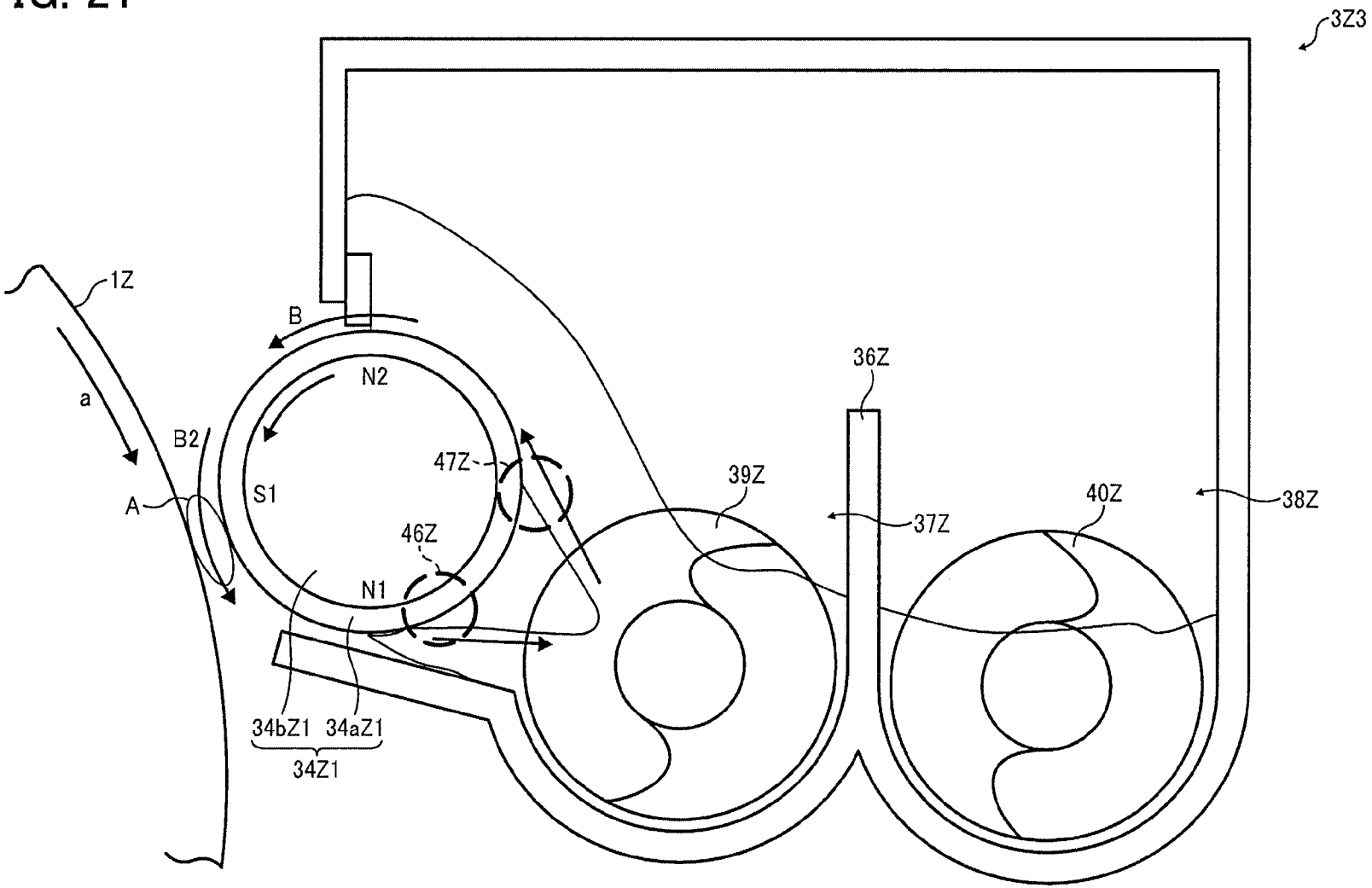
FIG. 21 is a schematic diagram illustrating a configuration of a development device according to another comparative example.

FIG. 21 is a schematic diagram illustrating a configuration of the non-unidirectional development device 3Z3.

The development device 3Z3 is different from the development device 3 shown in FIG. 2 in that a supply path 37Z and a circulation path 38Z are arranged horizontal and accordingly the shape of a partition 36Z is different from that shown in FIG. 2. The developer is supplied from the supply path 39Z to a development sleeve 34*a*Z and then is returned to the supply path 39Z after passing through a development range.

In the development device 3Z3, similarly to the development device 3 shown in FIG. 2, ports, not shown, are respectively formed in an upstream end portion and a downstream end portion of a partition 36Z to connect the supply path 37Z and the circulation path 38Z, and a circulation screw 40Z transports the developer in a direction opposite the direction in which the supply screw 39Z transports the developer. Thus, the developer is circulation between the supply path 37Z and the circulation path 38Z.

In non-unidirectional development devices such as the development device 3Z3 shown in FIG. 21, the developer that has passed through the development range A is collected in the identical developer transport path from which the developer is supplied to the development sleeve 34*a*Z1. That is, the release portion 46Z where the developer leaves the development sleeve 34*a*Z1 and the attraction portion 47Z where the developer is attracted to the development sleeve 34*a*Z1 are disposed in the identical developer transport path. Therefore, in particular, when the diameter of the development sleeve 34*a*Z1 is smaller and the release portion 46Z and the attraction portion 47Z are close to each other, it is possible that developer release failure and/or improper attraction of the developer occur more frequently.

Additionally, as in the comparative example 3 shown in FIG. 21, in the configuration in which the magnetic force generated by the magnet roller 34*b*Z1 attracts the developer to the development sleeve 34*a*Z1, the developer can be reliably attracted to the development sleeve 34*a*Z1 when the magnetic force in the attraction portion 47Z is sufficiently strong. However, the magnetic force is also strong in the release portion 46Z that is close to the attraction portion 47Z, which increases the frequency of developer release failure. By contrast, when the magnetic force in the attraction portion 47 is reduced, although developer release failure can be inhibited because the magnetic force in the release portion 46Z is also reduced, it is possible that the developer cannot be reliably attracted to the development sleeve 34*a*.

Therefore, it is necessary to reduce the effects of either of the release portion 46 and the attraction portion 47 given to the other by disposing them away from each other to achieve the functions of both of them.

(Relative Positions of Development Sleeve and Circulation Screw)

Next, relative positions of the development sleeve 34*a* and the circulation screw 40 are described below. In the unidirectional developer device 3 shown in FIG. 2, as described above, the amount of the developer in the circulation path 38 increases toward downstream in the developer transport direction, and the developer is likely to reach a highest edge of the circulation screw 40 in the downstream portion. Additionally, as shown in FIG. 17, if the developer is carried to the upper portion of the development sleeve 34*a*, developer release failure is likely to occur, which is not desirable. Therefore, as the relative positions of the development roller 34 and the circulation screw 40, the highest edge of the circulation screw 40 is preferably lower than an angle of 50° and more preferably lower than an angle of 0° on the surface of the development sleeve 34*a*.

Relations between the toner concentration and positions in the axial direction in the supply path 37 and the circulation path 38 and on the development sleeve 34*a* are described below according to FIGS. 22A and 22B.

Figure 22A:
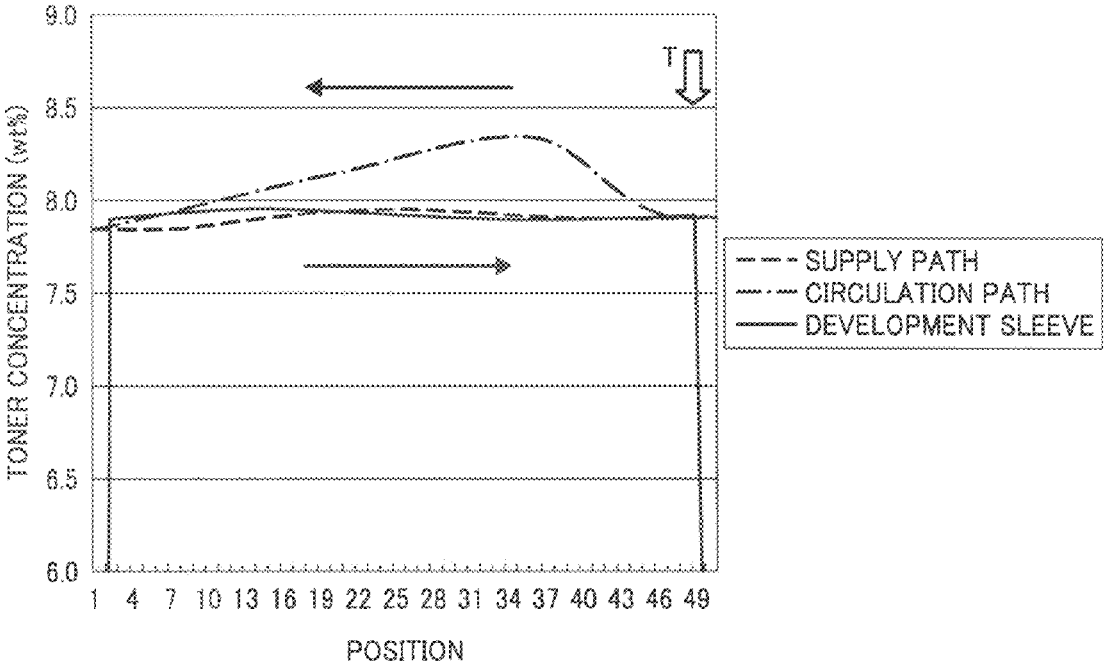
FIGS. 22A and 22B are graphs respectively illustrating relations between toner concentration in weight percent and positions in the development device shown in FIG. 2 and that in a development device according to a comparative example 4.

FIG. 22A and FIG. 22A are respectively graphs illustrating relations between the toner concentration in weight percent and the positions in the development device 3 shown in FIG. 2 and that in a development device according to a comparative example 4. The graphs shown in FIGS. 22A and 22B were obtained by forming solid images on A3 sheets and measuring the toner concentration in the development device 3. The amount of toner adhering to the A3 sheets was 0.45 g/cm$^2$.

Similarly to the development device 3 according to the first embodiment, the development device according to the comparative example 4 includes a supply path provided with a supply screw and a circulation path provided with a circulation screw to transport the developer in a direction opposite the developer transport direction of the supply screw. However, the comparative example 4 is different from the first embodiment in that the developer that has passed through the development range is collected in the supply path, and only the developer that reaches a downstream end portion in the supply path in the developer transport direction is sent to an upstream end portion of the circulation path.

Figure 22B:
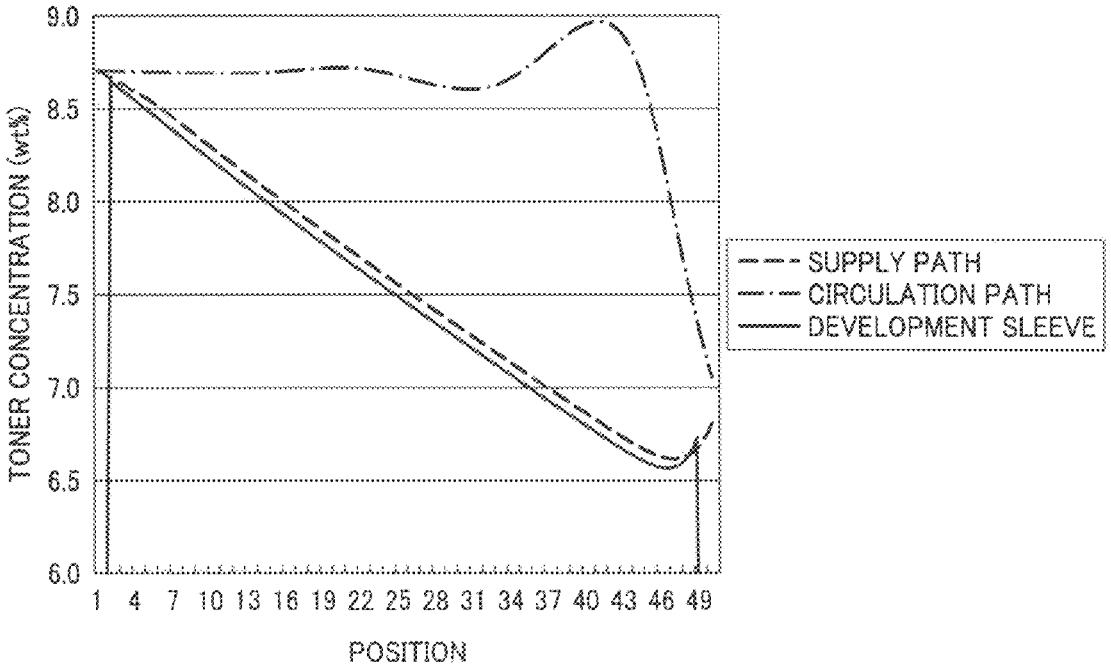

It is to be noted that the graph of the toner concentration on the developer sleeve shown in FIGS. 22A and 22B shows toner concentration of the developer that has just passed a position facing the developer regulator 35. In FIGS. 22A and 22B, as the value of vertical axes increases, the position on the supply screw shifts downstream while the position on the circulation screw shifts upstream in the developer transport direction.

In the first embodiment, as shown in FIG. 22A, the toner concentration on the development sleeve 34*a* is substantially constant regardless of the position in the axial direction. By contrast, as shown in FIG. 22B, the toner concentration on the development sleeve decreases as the position shifts downstream in the developer transport direction of the supply screw in the comparative example 4.

It is to be noted that, because the capacity of the developer container (e.g., supply path and circulation path) is smaller in a compact development device, the proportion of the toner in the developer decreases more significantly in it even when the identical amount of toner is consumed in the compact development devices and a typical development device. Therefore, in the comparative example in which the used developer is collected in the supply path, when the development device is relatively compact, the toner concentration on the development sleeve decreases more significantly as the position shifts downstream in the developer transport direction of the supply screw, which is not desirable.

By contrast, in the first embodiment in which the used developer is collected in the circulation path 38 separately provided from the supply path 37, even when it is relatively compact and accordingly the capacity of the development container is smaller, a substantially constant toner concentration can be maintained on the development sleeve 34*a*. Thus, image density can be kept substantially constant even when the development device is relatively compact. By increasing the interval between the pre-development pole (attraction pole) N2 and the post-development pole (release pole) N1, the developer that has passed through the development range can be collected in the circulation path 38 separately provided from the supply path 37.

(Stress)

Additionally, in the configuration in which the rotary shaft of the supply screw 39 is disposed above the center of rotation 34*p* and the developer is supplied onto the development sleeve 34*a* from above, the developer that has strode the barrier 43 can fall on the development sleeve 34*a* due to gravity. Thus, the developer can be reliably supplied to the development sleeve 34*a* even when the magnetic flux density in the attraction portion 47 is reduced.

This configuration is efficient when the relation $Br_1>Br_2>Br_3$ is satisfied. That is, when this relation is satisfied in the three-pole magnet roller 34*b*, the peak $Br_2$ in the post-development pole N1, functioning as the release pole, can be used to catch carrier particles and to facilitate the release of the developer from the development sleeve 34*a* simultaneously. Although the peak $Br_3$, that is, ability to attract the developer, of the pre-development pole N2 (attraction pole) is reduced accordingly, this ability can be supplemented by supplying the developer to the development sleeve 34*a* from above.

Additionally, reducing the magnetic flux density in the attraction portion 47, that is, reducing the magnetic flux density peak of the pre-development pole N2, can significantly reduce the stress given to the developer upstream from the developer regulator 35 in the rotation direction of the development sleeve 34*a*, thus expanding the life of the developer. Reducing the stress to the developer upstream from the developer regulator 35 also can reduce load to the development sleeve 34*a*, and thus deformation of the development sleeve 34*a* can be prevented or reduced even when its diameter is smaller and accordingly its strength is reduced. As described above, in the first embodiment, the relative positions of the barrier 43 forming the supply path 37 and the development sleeve 34*a* are set so that gravity can be used to supply the developer to the development sleeve 34*a*. By arranging the surface of the development sleeve 34*a* below the barrier 43 as shown in FIG. 2, the developer that has sent over the barrier 43 as the supply screw 39 rotates can be supplied onto the development sleeve 34*a* due to gravity.

It is to be noted that, by using gravity to supply the developer, even in the present embodiment in which an identical magnetic pole serves as both the attraction pole and the developer regulation pole, that is, the number of the magnetic poles is reduced from that in the configuration that includes the attraction pole and the developer regulation pole separately, the developer can be supplied to the development range reliably.

In the first embodiment, among the magnetic poles (S1, N1, and N2) for carrying the developer onto the development sleeve 34*a*, the magnetic flux density peak of the magnetic field generated by the pre-development pole N2 in normal direction to the surface of the development sleeve 34*a* is 40 mT or less. Thus, this magnetic flux density peak of the magnetic field generated by the pre-development pole N2 is reduced from a conventional configuration in which the magnetic flux density peak of the magnetic field generated by the attraction pole is about 50 mT to 70 mT.

In particular, the load to the development sleeve 34*a* as well as the stress to the developer thereon can be reduced by setting the magnetic flux density in normal direction at the center M1 (magnetic flux density peak) of the pre-development pole N2 to a value not greater than 30 mT. The relation between the attraction portion 47 and the size of the magnetic flux density in the pre-development pole N2 should be set in view of the following condition: The barrier 43 to be strode by the developer should be configured so that the developer can be carried on the development sleeve 34*a* due to the magnetic force in the pre-development pole N2 and the frictional force between the developer and the development sleeve 34*a*. Additionally, the position where the developer where the developer is caused to fall is the above-described position where the developer can be carried by the development sleeve 34*a* and the position between the post-development pole N1 and the pre-development pole N.

When gravity is used to supply the developer onto the surface of the development sleeve 34*a*, the developer can be transported reliably even when the maximum magnetic flux density of the magnetic field generated by the pre-development pole N2 serving as the attraction pole in the normal direction to the development sleeve 34*a* is reduced to about one fourth of that in typical development devices. In this case, the load to the development sleeve 34*a* can be reduced to 20 percent to 30 percent of that in typical development devices.

Thus, in the present embodiment, because the load to the development sleeve 34*a* in the developer regulation portion is reduced, unevenness in the development gap, which can occur when the diameter of the development sleeve 34*a* is smaller, can be reduced, and thus image development can be performed reliably.

The strength of the development sleeve 34*a* decreases as the diameter thereof decreases, which is described in further detail below.

Figure 23:
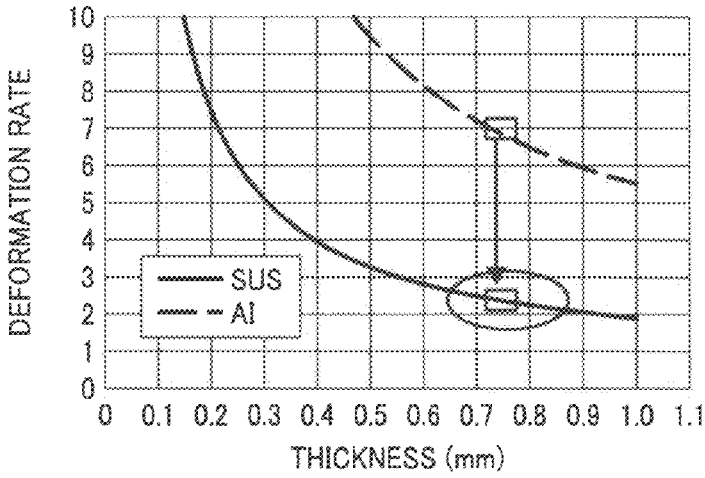
FIG. 23 is a graph illustrating deformation amount of development sleeves whose materials and diameters are different.

FIG. 23 is a graph illustrating the deformation amount of the development sleeve 34*a* when an aluminum sleeve (represented by "Al" in FIG. 23) having a diameter of 10 mm and a stainless steel sleeve (represented by "SUS" in FIG. 23) having a diameter of 10 mm is used, and the deformation amount of an aluminum sleeve according to a comparative example, having a diameter of 18 mm and a thickness of 0.8 mm. In FIG. 23, a horizontal axis indicates the thickness of the sleeves whose diameter is 10 mm, and a vertical axis indicates their deformation rates when the deformation amount of the sleeve according to the comparative example 5 is 1.

It is to be noted that the deformation amount, that is, the amount by which the sleeve is deformed, herein means a maximum deformation amount δmax (e.g., deformation amount of a center portion) when uniformly-distributed load is given to either end of the support beam. The maximum deformation amount δmax can be calculated using formula 1 shown below.

$$\delta_{max} = \frac{5wl^4}{384EI} \quad (1)$$

wherein w represents a load per unit length, l represents the length of the development sleeve, and E represents Young's modulus, and I represents second moment of area of the development sleeve.

In formula 1, the Young's moduli of aluminum, ordinary steel, and stainless steel (SUS) are set to 69090 MPa, 205800 MPa, and 199920 MPa, respectively. The second moment of area of the development sleeve I is calculated using formula 2 shown below.

$$I = \frac{\pi}{64}(d^4 - di^4) \quad (2)$$

wherein d represents the outer diameter of the development sleeve, and di represents the inner diameter of the development sleeve.

In the case of the aluminum sleeve having a diameter of 10 mm and a thickness of 0.7 mm, the deformation rate is 7 as shown in FIG. 23, that is, seven times the deformation amount of the sleeve according to the comparative example 5. Even when the SUS sleeve whose diameter and thickness are identical is used, the deformation amount is more than twice the deformation amount of the sleeve according to the comparative example 5.

It is to be noted that the development sleeve 34*a* is deformed by the load caused by the developer accumulated upstream from the position facing the developer regulator 35. More specifically, the action of the accumulated developer to expand the space between the development sleeve 34*a* and the casing 33 as well as the weight of the developer push the development sleeve 34*a* to the direction opposite the developer regulator 35. When the developer sleeve 34*a* is deformed by this load, a regulation gap, which is the space between the developer regulator 35 and the surface of the development sleeve 34*a*, is larger in the center portion in the axial direction than in the end portions. Accordingly, the amount of developer passing through the regulation gap is larger in the center portion in the axial direction than in the end portions, and thus the amount of developer transported to the development range A is not uniform in the axial direction. Also in the development range A, a development gap, which is the gap between the photoconductor 1 and the development sleeve 34*a*, is expanded by the developer in the center portion, and thus the development gap is uneven in the axial direction, resulting in unevenness in the image density.

As described above with reference to FIG. 23, when the diameter of the development sleeve is smaller, the deformation amount increases, causing unevenness in image density. However, in the first embodiment, the deformation of the development sleeve 34*a* can be reduced even when its diameter is relatively small because the load in the portion where the developer is regulated can be reduced by setting the magnetic flux density in the pre-development pole N2 serving as the attraction pole to a relatively small value. Therefore, unevenness in image density can be reduced.

Figure 24:
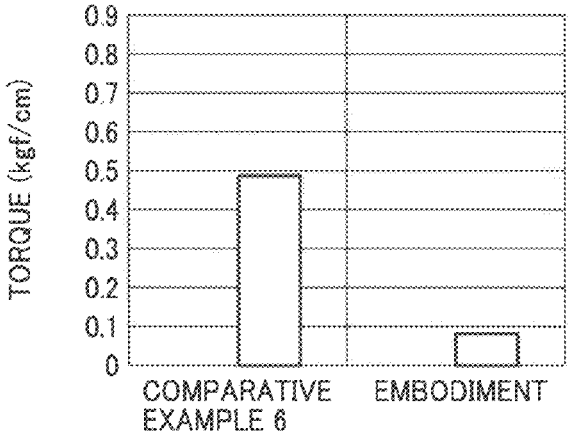
FIG. 24 is a graph illustrating torque of the development sleeve in the first embodiment and a comparative example 6.

FIG. 24 is a graph illustrating torque of the development sleeve in the first embodiment and a comparative example 6. The magnetic flux density in normal direction at the center M1 (e.g., magnetic flux density peak) of the pre-development pole N2 in the first embodiment is 30 mT, and that in the comparative example 6 is 57 mT similarly to that in the attraction pole in typical development devices. As shown in FIG. 24, because the torque of, that is, the load to, the development sleeve 34*a* in the first embodiment is about 20% of that in the comparative example 6, the deformation of the development sleeve is not increased even when the aluminum sleeve having a relatively small diameter is used.

Figure 25:
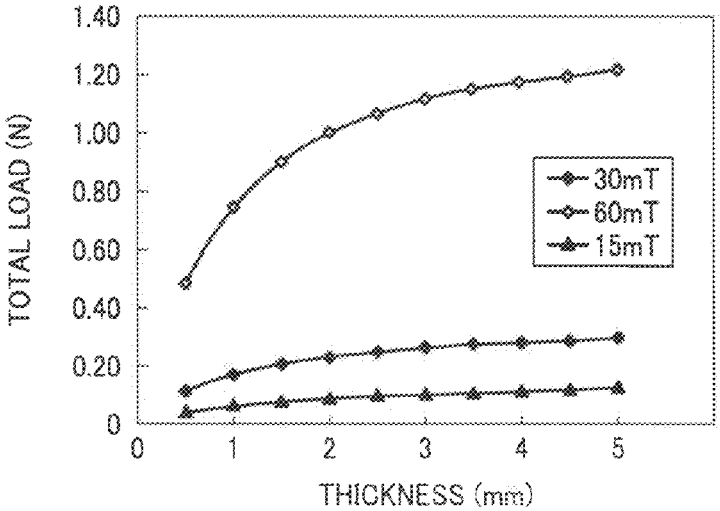
FIG. 25 is a graph illustrating the load calculated based on the magnetic attraction when the magnetic flux density in the normal direction at a center of the pre-development pole is varied.

FIG. 25 is a graph illustrating the load calculated based on the magnetic attraction when the magnetic flux density in normal direction at the center M1 of the pre-development pole N2 is varied by changing the magnet forming the pre-development pole N2 in the development device 3 shown in FIGS. 2 and 8.

In FIG. 25, a vertical axis indicates a total load and a horizontal axis indicates the thickness of the development sleeve 34*a*. In FIG. 25, the load is reduced significantly when the magnetic flux density in normal direction at the center M1 of the pre-development pole N2 is not greater than 30 mT. Thus, the load can be reduced in the first embodiment even when the diameter of the development sleeve 34*a* is smaller and the strength thereof is smaller accordingly.

Attraction Pole

Second Embodiment

Figure 26:
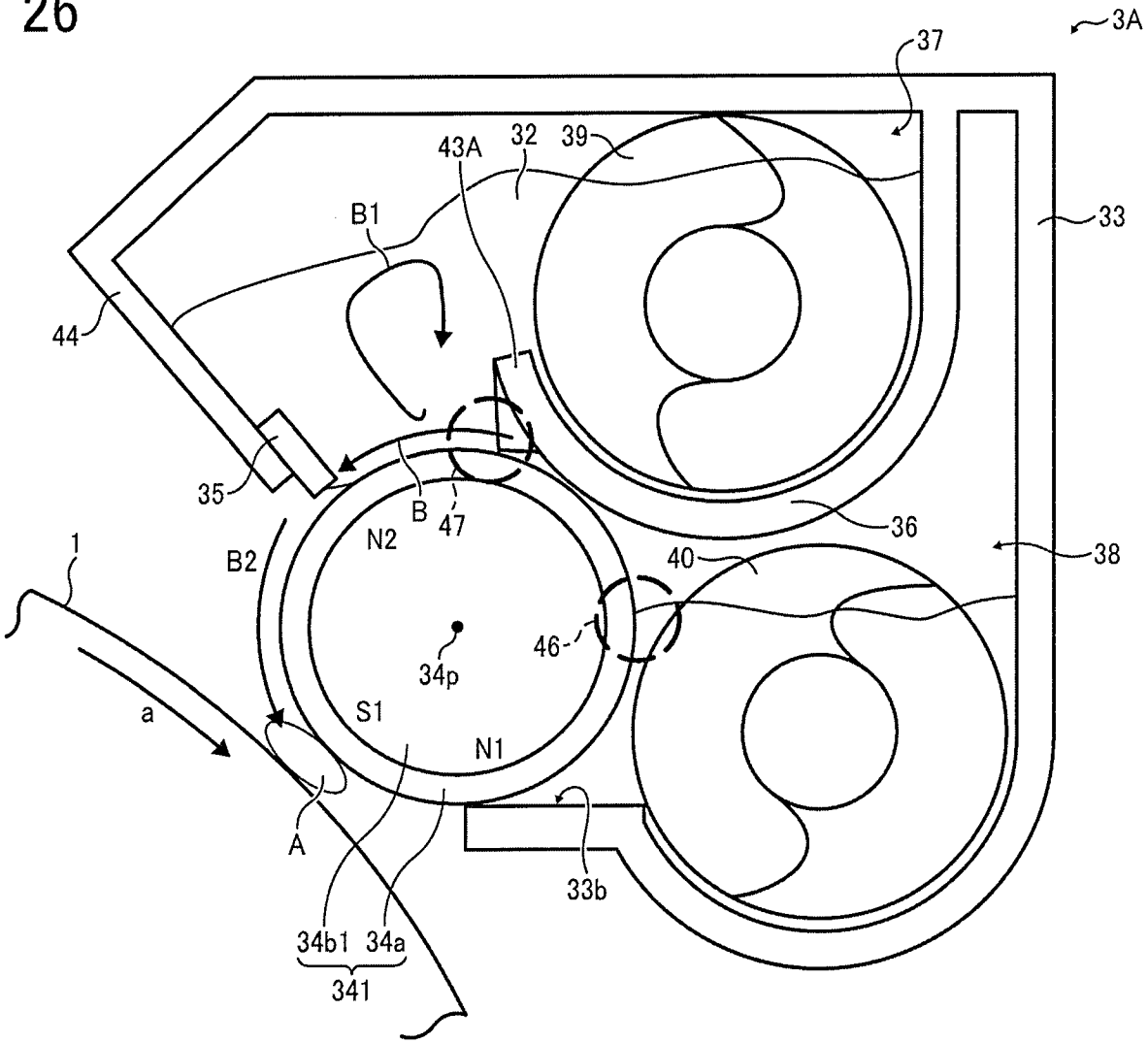
FIG. 26 is a schematic diagram illustrating a configuration of a development device according to a second embodiment.

FIG. 26 illustrates a schematic configuration of a development device 3A according to a second embodiment of the present invention. Except the differences described below, the development device 3A according to the second embodiment has a similar configuration to that of the development device 3 shown in FIG. 2 according to the first embodiment, and thus the description of the similar configuration is omitted.

Although the magnet S1 is disposed so that the heights of the development pole S1 and the center of rotation 34*p* of the development sleeve 34*a* are substantially similar, a development roller 341 shown in FIG. 26 is different from the development roller 34 in that, in a magnet roller 34*b*1, the development pole S1 is lower than the center of rotation 34*p* of the development sleeve 34*a*. Additionally, although the magnet N2 forming the pre-development pole N2 is disposed so that the pre-development pole N2 faces a highest point 34*t*, which is a point on the surface of the development sleeve 34*a* at the tope of its rotation, in the first embodiment, in the second embodiment shown in FIG. 26, the magnet N2 is disposed so that the pre-development pole N2 faces a position downstream from the highest point 34*t* on the surface of the development sleeve 34*a* in the rotational direction of the development sleeve 34*a*. In addition, the shape of a barrier 43A is different from that of the barrier 43 shown in FIG. 2.

Figure 27:
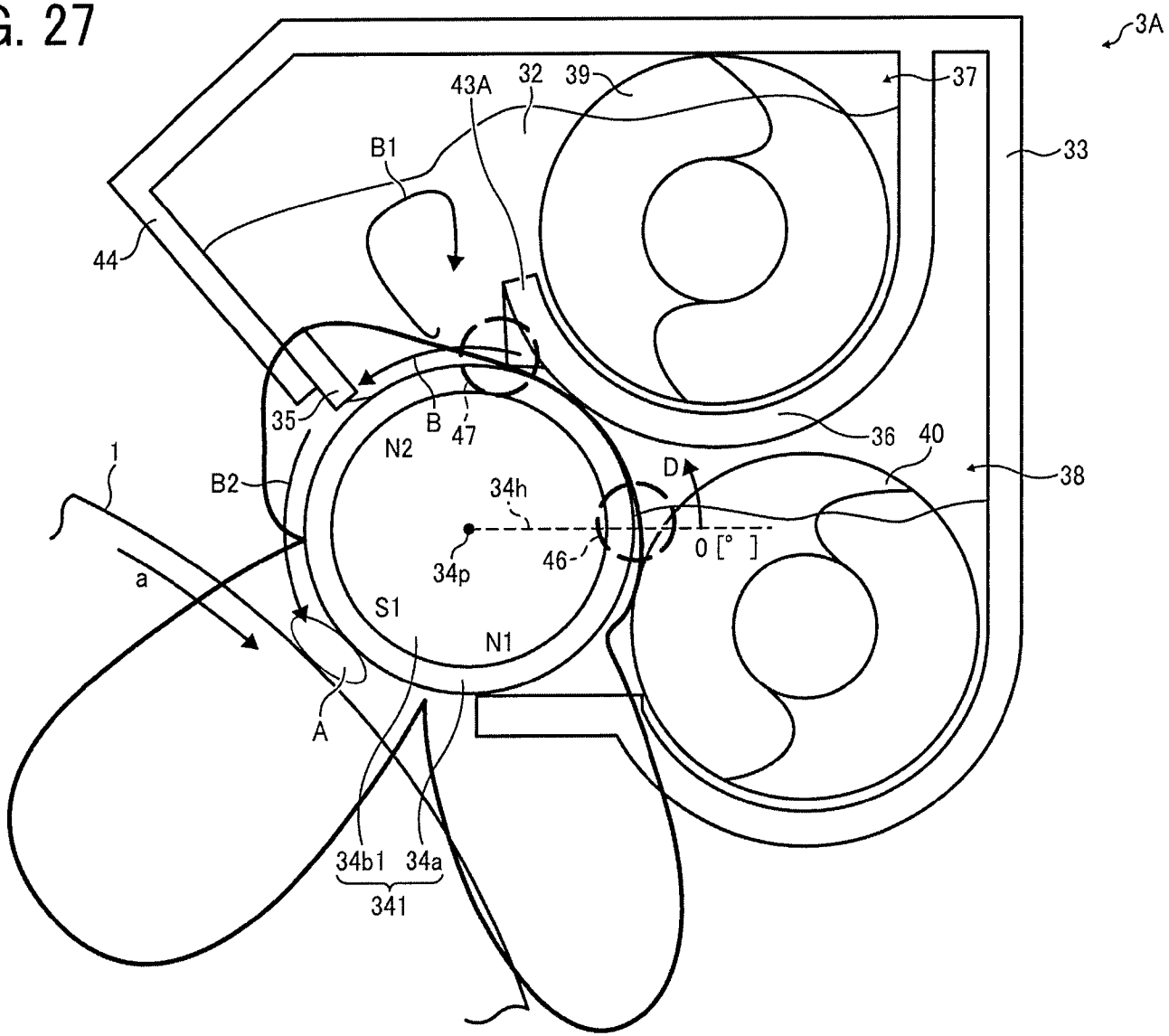
FIG. 27 illustrates the configuration of the development device together with a waveform of the magnetic fields around a development roller in the second embodiment.
Figure 28:
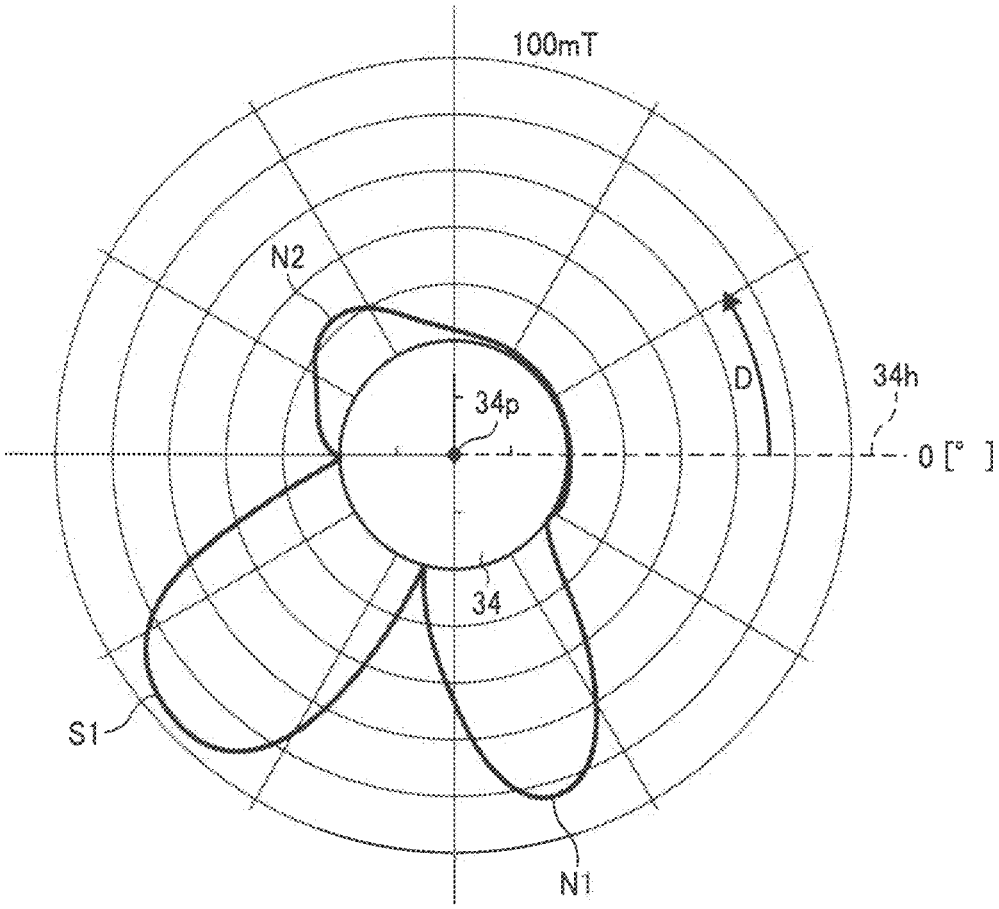
FIG. 28 is a graph illustrating a distribution of magnetic flux density in the normal direction in the development device shown in FIG. 26.

FIG. 27 illustrates the configuration of the development device 3A shown in FIG. 26 together with a waveform of the magnetic fields around the development roller 341. FIG. 28 is a graph illustrating a distribution of the magnetic flux density in normal direction in the development device 3A shown in FIG. 24.

Third Embodiment

Figure 29:
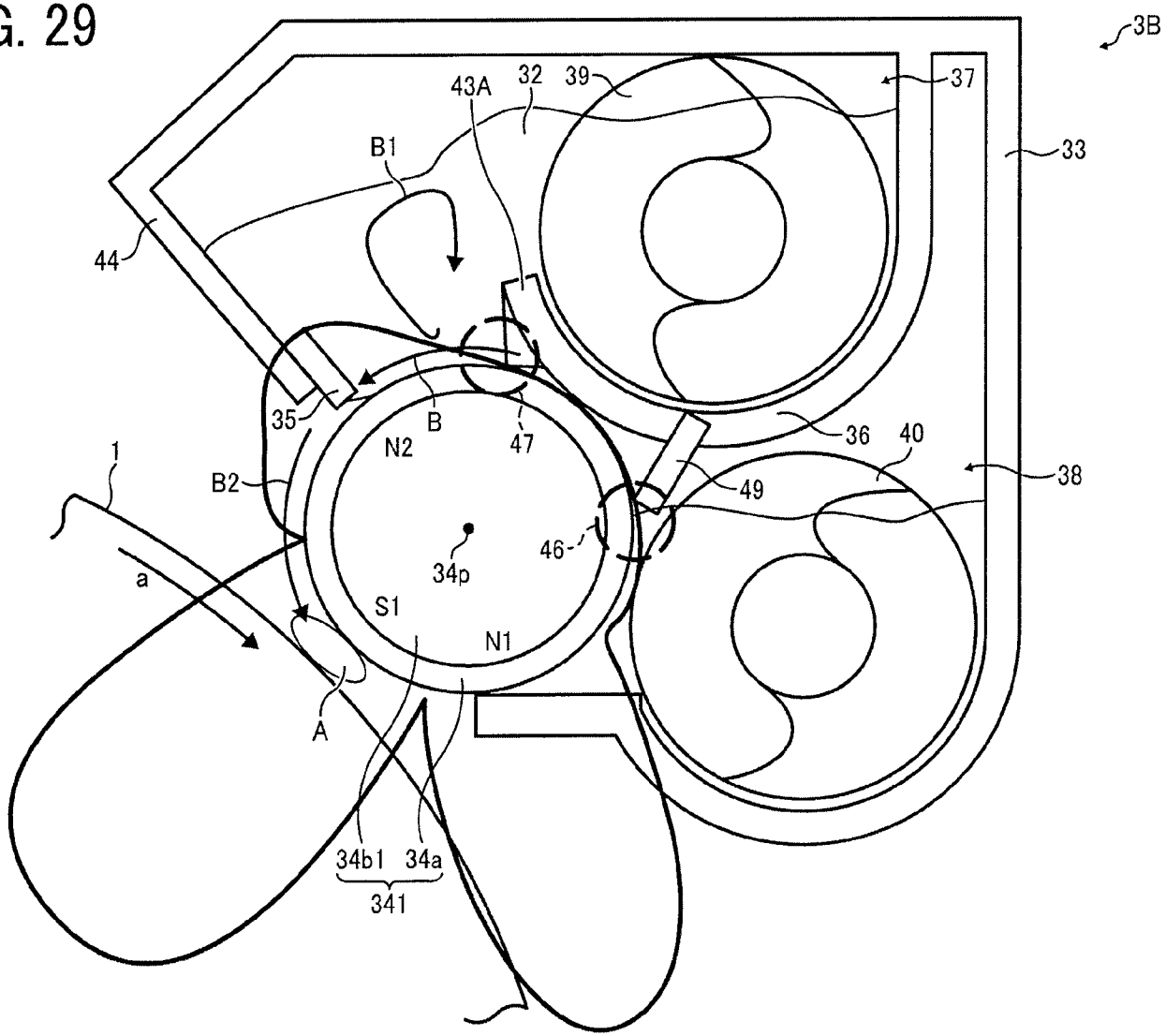
FIG. 29 is a schematic diagram illustrating a configuration of a development device according to a third embodiment.

FIG. 29 illustrates a schematic configuration of the development device 3B according to a third embodiment of the present invention.

Except that a separation plate 49 is provided, the development device 3B according to the third embodiment has a similar configuration to that of the development device 3A according to the second embodiment, and thus the descriptions thereof are omitted.

In the development device 3B shown in FIG. 29 according to the third embodiment, by providing the separation plate 49 adjacent to the release portion 46 to separate the developer 32 from the development sleeve 34*a*, the developer 32 can be reliably separated from the development sleeve 34*a* even when the amount of the developer 32 is increased on the downstream side in the transport direction of the circulation screw 40. An edge portion of the separation plate 49 is preferably close to an angle position within a range from −20° to +5° on the surface of the development sleeve 34*a* when the angle position where the magnetic force in tangent direction is zero. In other words, the edge portion of the separation plate 49 is preferably disposed close to a range on the surface of the development sleeve 34*a* downstream form the center M1 (magnetic flux peak position) in the post-development pole N1 and upstream from the center M1 (magnetic flux peak position) in the pre-development pole N2 in the rotational direction of the development sleeve 34*a*.

Figure 30:
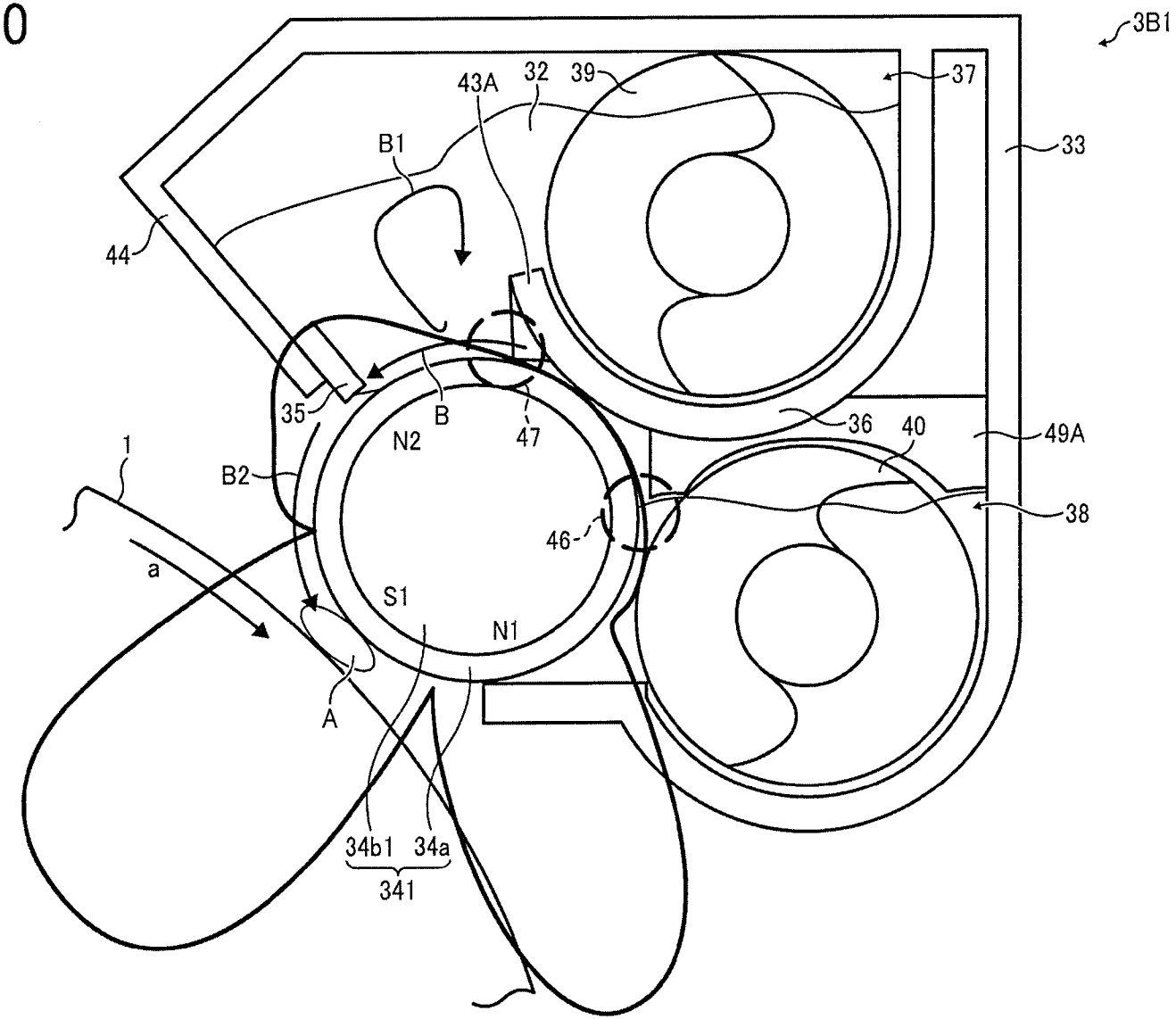
FIG. 30 is a schematic diagram illustrating a development device as a variation of the third embodiment.

It is to be noted that the configuration and position of the separation plate 49 is not limited to those shown in FIG. 30. Alternatively, a separation plate 49A shown in FIG. 30 may be used. A development device 3B1 shown in FIG. 30 has a configuration similar to that of the development device 3B shown in FIG. 29 except the separation plate 49A, and thus the description thereof is omitted.

Fourth Embodiment

Figure 31:
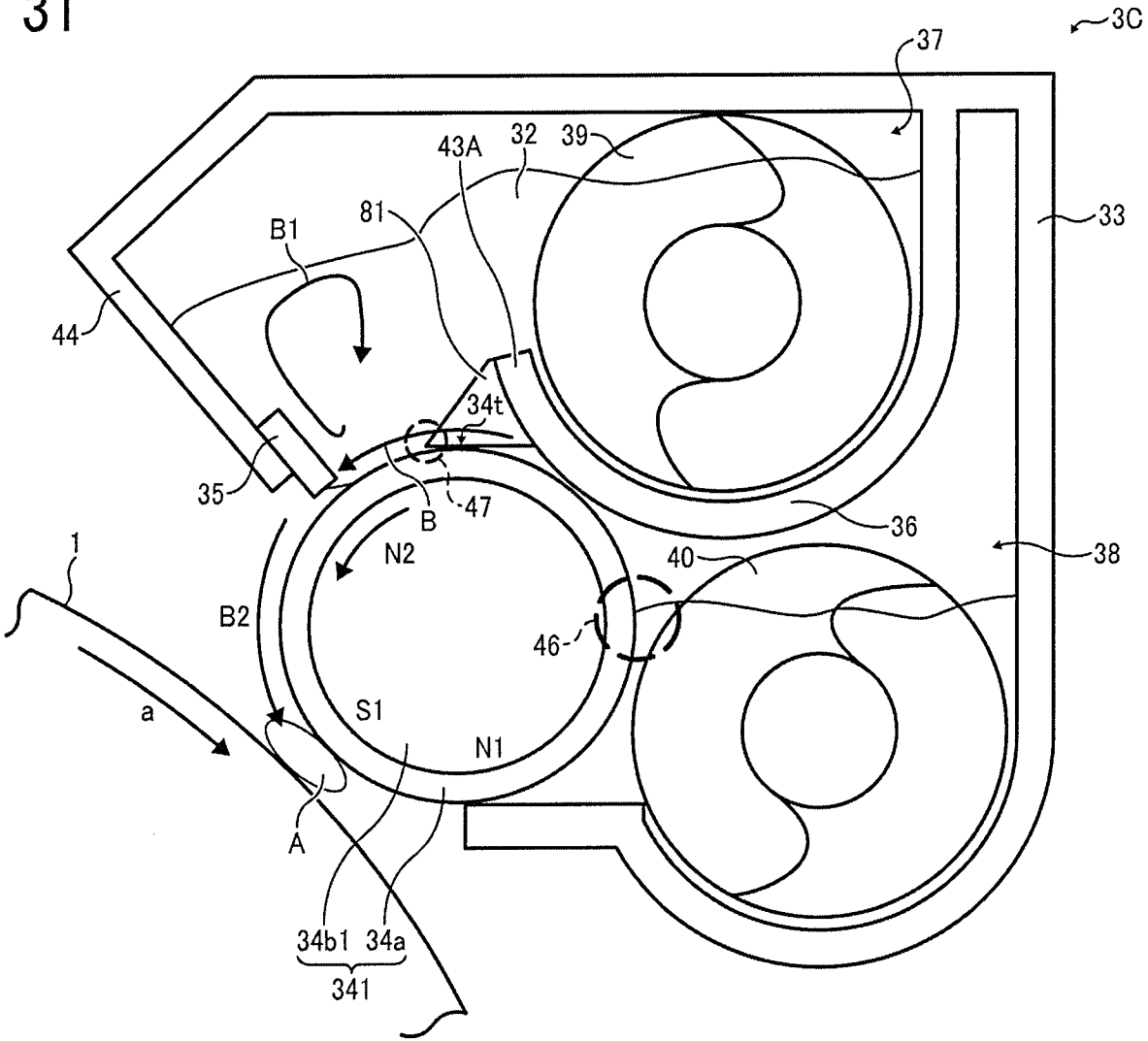
FIG. 31 is a schematic diagram illustrating a configuration of a development device according to a fourth embodiment.
Figure 32:
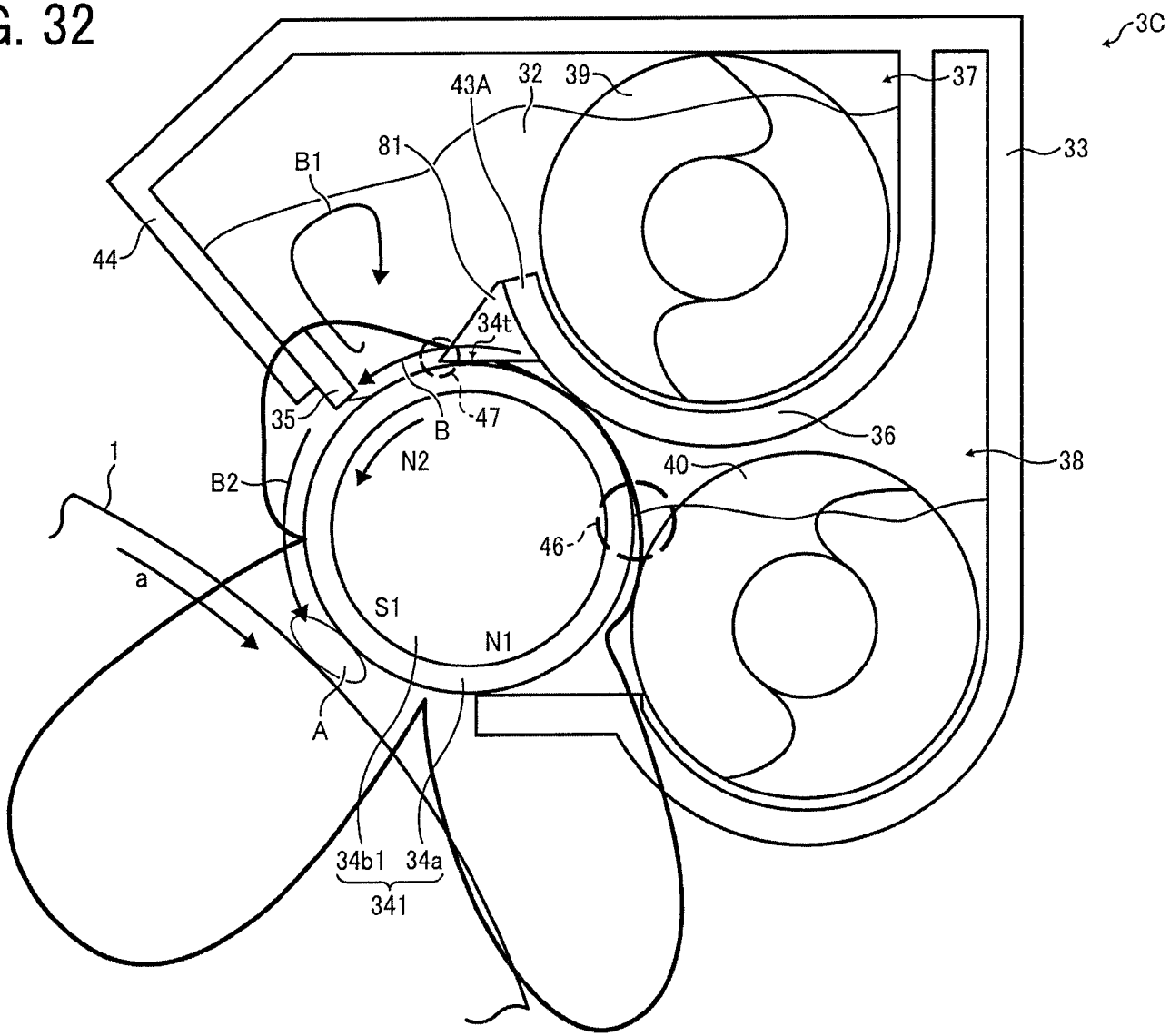
FIG. 32 illustrates the configuration of the development device together with a waveform of the magnetic fields around a development roller in the fourth embodiment.

FIG. 31 illustrates a schematic configuration of the development device 3C according to a fourth embodiment of the present invention. FIG. 32 illustrates the configuration of the development device 3C shown in FIG. 31 together with a waveform of the magnetic fields around the development roller 341.

Except that a supply position adjuster 81 is provided, the development device 3C according to the fourth embodiment has a similar configuration to that of the development device 3A according to the second embodiment, and thus the descriptions thereof are omitted.

It is to be noted the distribution of the magnetic flux density in normal direction in the development device 3C according to the fourth embodiment is similar to that shown in FIG. 28. Also in the fourth embodiment, the pole S1 facing the photoconductor 1 serves as the development pole, and the pole N1 and the pole N2 respectively disposed downstream and upstream from the development pole S1 in the rotational direction of the development sleeve 34*a* serve as the post-development pole and s the pre-development pole. Additionally, as shown in FIGS. 31 and 32, the portion where the developer 32 overflowing from the supply path 37 contacts the surface of the development sleeve 34*a* is referred to as the attraction portion 47.

Generally, the developer inside the development device 3C receives a large pressure upstream from the developer regulation portion and then deteriorates. More specifically, the amount of the developer transported to the development range A through the regulation gap is significantly small compared with the amount of the developer supplied to the development sleeve 34*a*. Therefore, the developer accumulates upstream from the regulation gap in the rotational direction of the development sleeve 34*a* and accordingly receives a large pressure.

Additionally, the developer 32 supplied by the supply screw 39 is carried on the surface of the development sleeve 34*a* due to the magnetic attraction of the pre-development pole N2 generated by the magnet disposed close to the position facing the supply screw 39. At this time, if the supply screw 39 is lower than the development sleeve 34*a*, the developer 32 in the supply path 37 should be carried upward to the developer sleeve 34*a* against the weight of the developer itself. Therefore, the pre-development pole N2 serving as the attraction pole needs a relatively high magnetic flux density to supply the developer to the development sleeve 34*a* reliably.

The longer the distance between the development sleeve 34*a* and the supply screw 39 is, or the lower the height of the supply screw 39 relative to the development sleeve 34*a* is, the higher the magnetic flux density in the pre-development pole (attraction pole) N2 should be to supply the developer to the development sleeve 34*a* reliably. However, although the developer can be reliably supplied to the development sleeve 34*a* by increasing the magnetic flux density in the attraction pole N2, the developer is more likely to deteriorate because the frictional force between the development sleeve 34*a* and the developer carried thereon increases, which is not desirable.

Therefore, if the developer can be reliably supplied to the development sleeve 34*a* even when the magnetic force of the attraction pole N2 is weaker, deterioration of the developer can be reduced while reliably supplying the developer to the development sleeve 34*a*.

As in the first, second, and third embodiments, when the supply screw 39 is disposed above the development sleeve 34*a*, even when the magnetic force of the attraction pole N2 is weaker, the developer overflowing from the supply path 37 by rotation of the supply screw 39 can fall onto the development sleeve 34*a* due to gravity. Thus, a constant amount of developer can be reliably supplied to the development sleeve 34*a*.

Additionally, in the fourth embodiment, the supply position adjuster 81 is disposed so that the attraction portion 47 is adjusted to a position downstream from the highest position 34*t* on the surface of the development sleeve 34*a*. When the magnetic flux density around the attraction portion 47 is smaller, although the developer can be supplied to the development sleeve 34*a* due to gravity, the force to keep the developer on the surface of the development sleeve 34*a* against gravity is weaker, and it is possible that a certain amount of the developer might pass between the development sleeve 34*a* and the partition 36 forming the bottom surface of the supply path 37, falling into the circulation path 38. However, the supply position adjuster 81 disposed as described above can prevent or reduce such inconvenience.

In the fourth embodiment, the supply position adjuster 81 guides the developer that has strode the barrier 43A to the position downstream from the highest point 34*t* on the surface of the development sleeve 34*a* in the rotational direction thereof. In other words, as shown in FIG. 28, when the angle position where the horizontal axis 34*h* crosses the surface of the development sleeve 34*a* is 0°, by disposing the attraction portion 47 at a position not lower than 90°, the developer supplied from the supply path 37 does not fall into the circulation path 38 but can be sent to the developer regulator 35.

Thus, when the casing 33 serving as the developer containing part and the development sleeve 34*a* are disposed so that gravity can be used to supply the developer from the supply path 37 onto the development sleeve 34*a* and the attraction portion 47 where the developer supplied from the supply path 37 contacts the surface of the development sleeve 34*a* is positioned downstream from the highest position 34*t* on the surface of the development sleeve 34*a*, the developer supplied from the supply path 37 does not fall into the circulation path 38 but can be sent to the developer regulation portion.

It is to be noted that it is not preferable that a relatively large gap is present between the developer regulator 35 and the attraction portion 47, which herein means the position where a downstream edge portion of the supply position adjuster 81 faces the development sleeve 34*a*, because a larger amount of developer is present in a space between the developer regulator 35 and the barrier 43A (hereinafter "buffer area"). In other words, if the amount of developer present in the buffer area is excessive, the amount of developer accumulating upstream from the regulation gap in the rotational direction of the development sleeve 34*a* increases, which can accelerate deterioration of the developer.

Additionally, because the developer accumulated in the buffer area presses the development sleeve 34*a* with its own weight, the development sleeve 34*a* is deformed particularly in the center portion in the axial direction.

From an experiment in which the position of the attraction portion 47 was varied by changing the shape of the supply position adjuster 81, it is known that a center angle formed by the attraction portion 47 and position on the surface of the development sleeve 34*a* facing the developer regulator 35 is preferably not greater than 30°.

Fifth Embodiment

Figure 33:
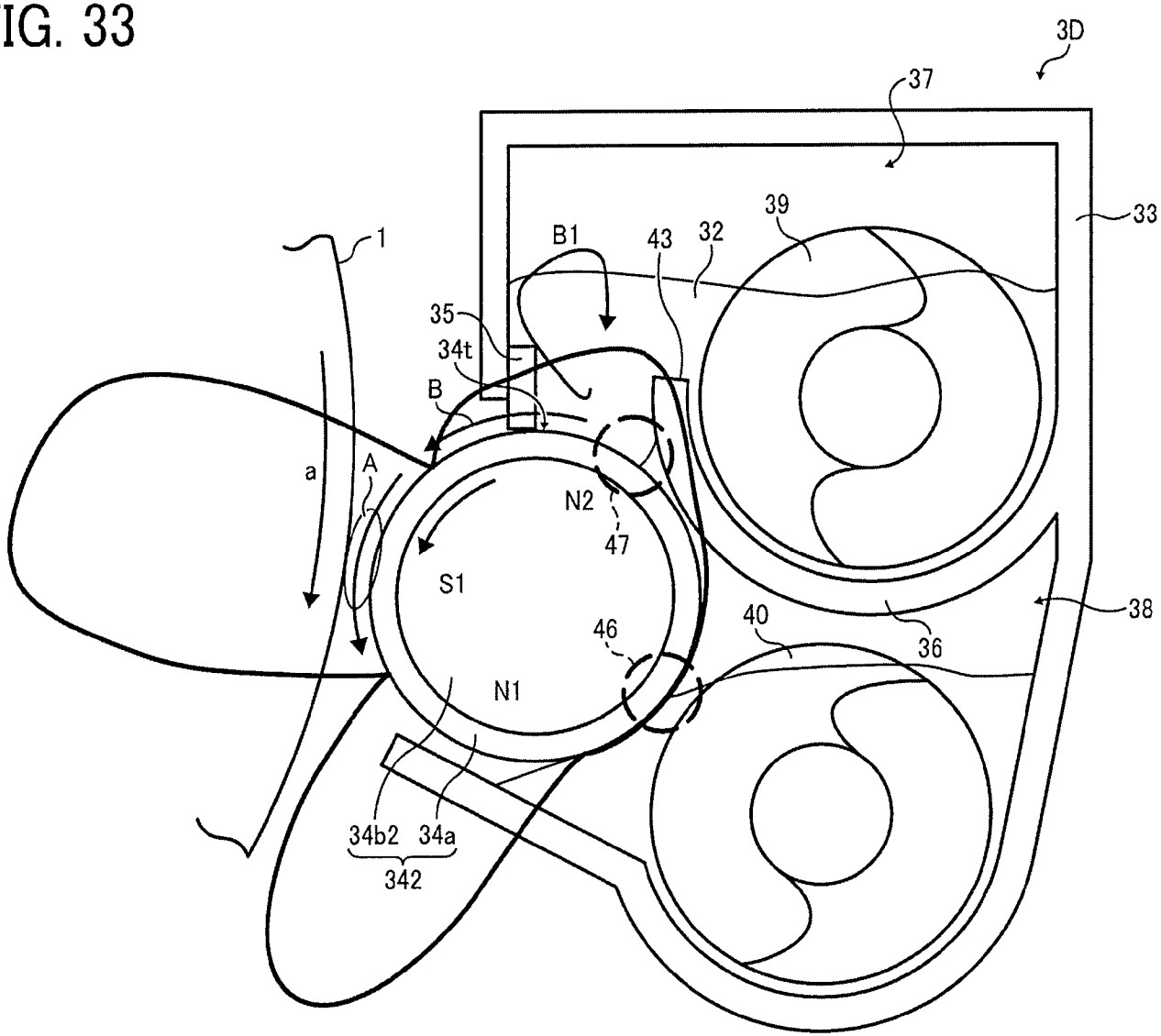
FIG. 33 is a schematic diagram illustrating a configuration of a development device according to a fifth embodiment.

FIG. 33 illustrates a schematic configuration of a development device 3D according to a fifth embodiment of the present invention. In the fifth embodiment, although the attraction portion 47 is upstream from the highest position 34*t* similarly to the first embodiment shown in FIG. 2, the pre-development pole N2 is disposed close to the attraction portion 47 differently from the first embodiment. Except that, the development device 3D has a similar configuration to that of the development device 3 shown in FIG. 2, and thus the descriptions thereof are omitted.

In this embodiment, gravity is used to supply the developer from the supply path 37 onto the development sleeve 34*a*, and the attraction portion 47 is positioned upstream from the highest point 34*t* on the development sleeve 34*a* in the rotational direction of the development sleeve 34*a*, by disposing the magnet forming the pre-development pole N2 so that the peak of the magnetic flux density in normal direction of the pre-development pole N2 is close to the attraction portion 47. In this configuration, also the developer can be reliably supplied to the development sleeve 34*a*. In an experiment, the peak of the magnetic flux density in normal direction of the pre-development pole N2 was varied and the amount of developer fallen into the circulation path 38 was measured. In the experiment, in an angle range on the development sleeve 34*a* not greater than 80° to the horizontal axis 34*h*, when the peak of the magnetic flux density in normal direction is not greater than 10 mT, the force of the developer to fall under gravity is greater than the force generated by the attraction pole to keep the developer in the development sleeve 34*a*. As a result, the amount of the developer falling into the circulation path 38 increased. Therefore, it is preferred that the magnetic flux density in normal direction in the attraction portion 47 be greater than 10 mT.

It is to be noted that, the position of the peak of the magnetic flux density of the pre-development pole N2 is not necessarily identical to that of the attraction portion 47.

Sixth Embodiment

Figure 34:
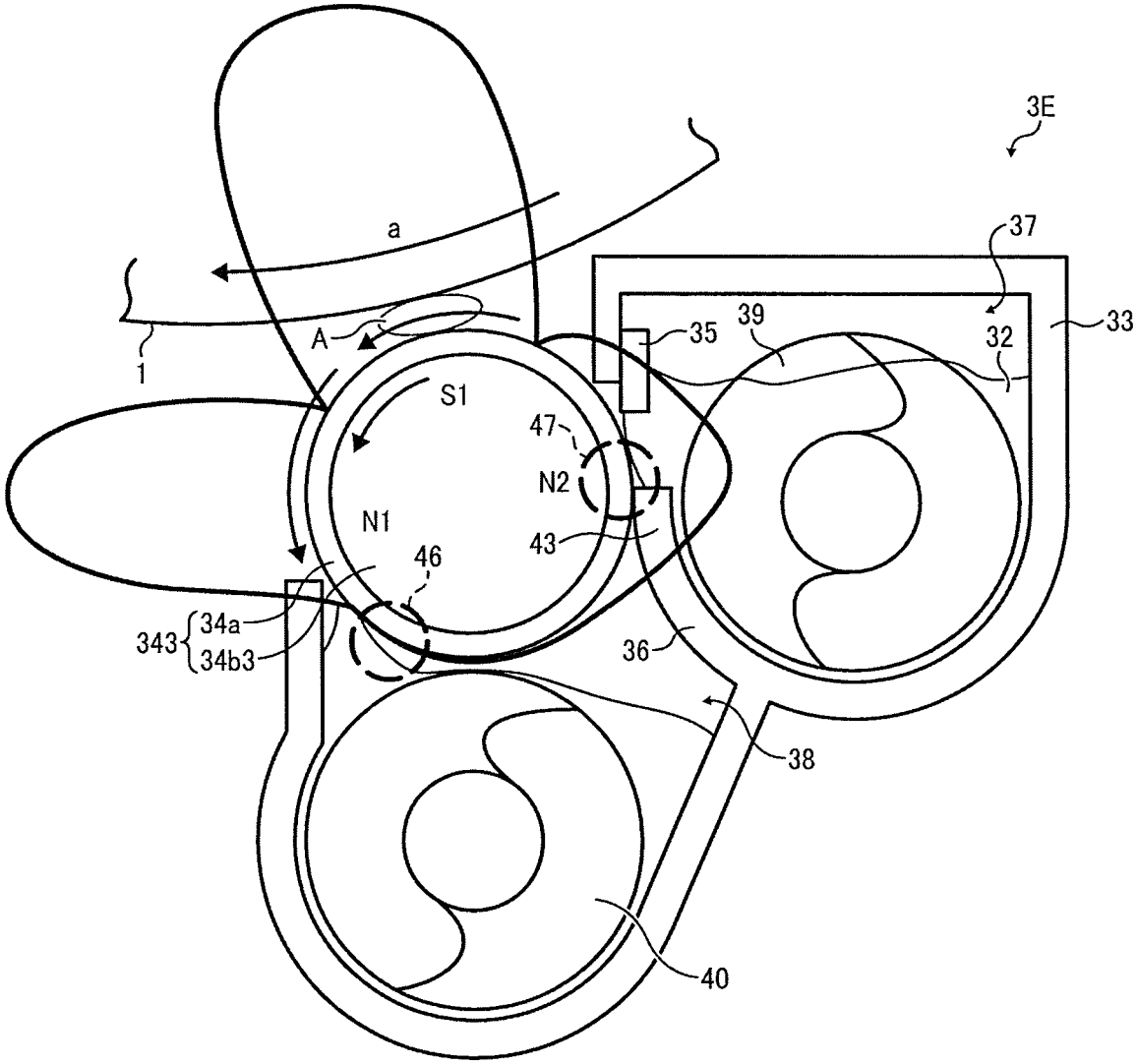
FIG. 34 is a schematic diagram illustrating a configuration of a development device according to a sixth embodiment.

FIG. 34 illustrates a schematic configuration of a development device 3E according to a sixth embodiment of the present invention.

The development device 3E according to the sixth embodiment is different from the development device 3D shown in FIG. 33 in that the positions of the supply screw 39 and the circulation screw 40 relative to a development roller 342 is different and that positions of the magnets S1, N1, and N2 are different from those in FIG. 33. Thus, the development roller and the magnet roller are given reference characters 343 and 34*b*3, respectively. The development roller 343 is disposed not on the side of but beneath the photoconductor 1 in FIG. 34. Other than those features, the development device 3E has a similar configuration to that of the development device 3 shown in FIG. 2, and thus the descriptions thereof are omitted.

As shown in FIG. 34, when the attraction portion 47 is disposed close to an angle of 0° on the surface of the development sleeve 34*a*, it is preferable that the peak of the magnetic flux density in normal direction of the pre-development pole N2 (attraction pole) and the attraction portion 47 be disposed at a substantially identical position within a range from −5° to 15°. With this configuration, the developer can be reliably supplied to the development sleeve 34*a*, and simultaneously, the developer that is not carried on the development sleeve 34*a* can fall into the supply path 37 not the circulation path 38.

It is to be noted that, regarding shortage of the developer, the development devices 3 through 3D according to the first through fifth embodiments are more advantageous than the development device 3E according to the sixth embodiment because the developer cannot overstride the barrier 43 and cannot be supplied to the development sleeve 34*a* unless a certain amount of developer is accumulated in the supply path 37 in the development device 3E shown in FIG. 34. However, regarding release of the developer, the development device 3E according to the sixth embodiment is more advantageous than the first through fifth embodiments because the position of the release portion 46 in the sixth embodiment allows the developer to fall from the development sleeve 34*a* due to its own weight.

Seventh Embodiment

Figure 35:
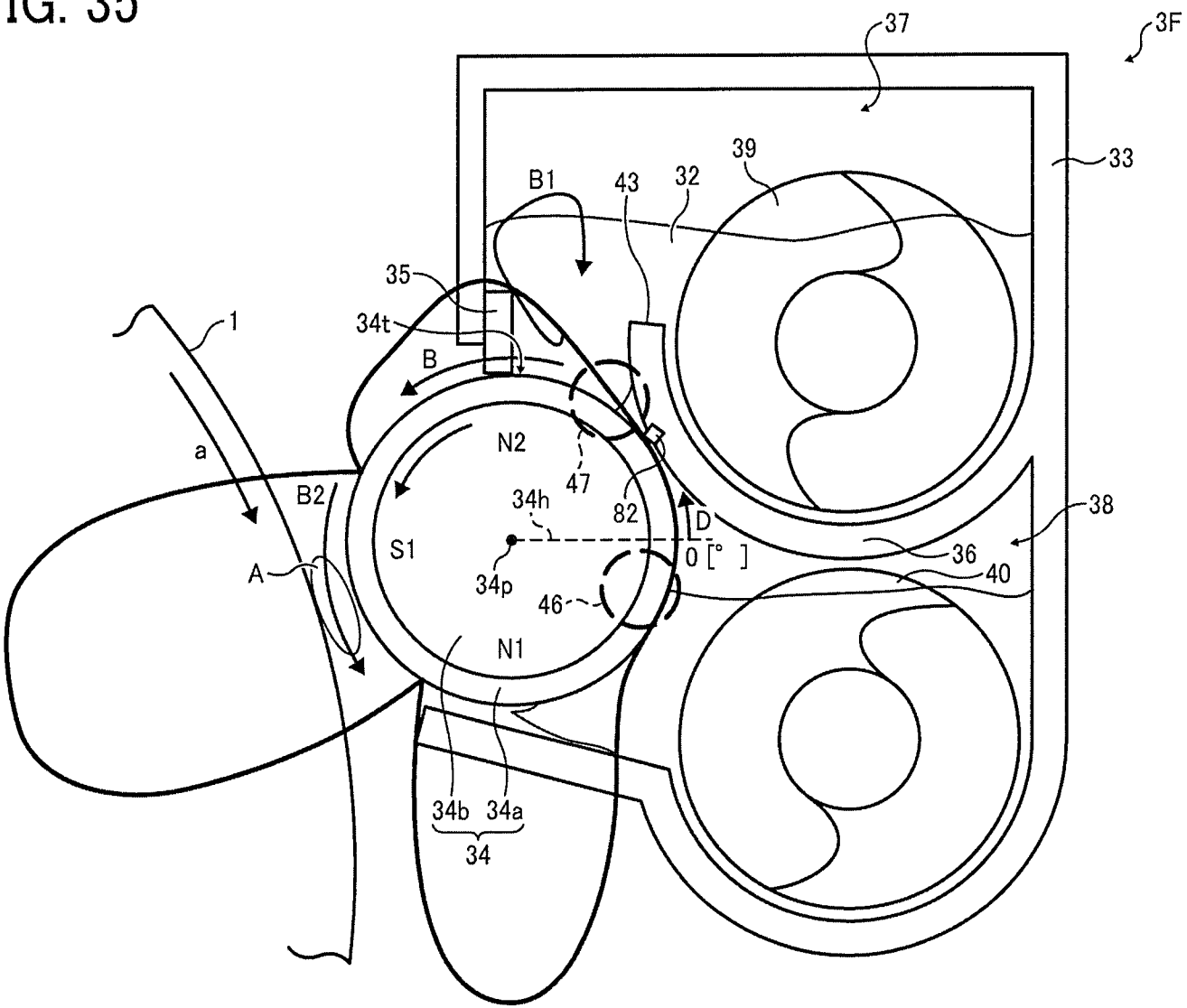
FIG. 35 is a schematic diagram illustrating a configuration of a development device according to a seventh embodiment.

FIG. 35 illustrates a schematic configuration of a development device 3F according to a seventh embodiment of the present invention. The development device 3F shown in FIG. 35 is different from the development device 3 shown in FIG. 2 according to the first embodiment in that a buried member 82 is provided upstream from the attraction portion 47 in the rotational direction of the development sleeve 34*a*. Except that, the development device 3F according to the seventh embodiment has a similar configuration to that of the development device 3 shown in FIG. 2, and thus the descriptions thereof are omitted.

Even when the attraction portion 47 is disposed upstream from the highest point 34*t* on the development sleeve 34*a* in the rotational direction of the development sleeve 34*a*, as shown in FIG. 35, by providing the buried member 82 on the partition 36 to reduce a gap between the partition 36 forming the supply path 37 and the surface of the development sleeve 34*a*, the developer can be prevented from falling into the circulation path 38.

When the attraction portion 47 is disposed within an angle range from 70° to 80° on the surface of the development sleeve 34*a*, by disposing the buried member 82 across a gap of about 0.5 mm to 1 mm from the surface of the development sleeve 34*a*, the developer can be prevented from falling into the circulation path 38. The buried member 82 is preferably formed of a soft material such as urethane because the development sleeve 34*a* might wear from the contact with the buried member 82.

Additionally, when the attraction portion 47 is disposed within an angle range from 80° to 90° on the surface of the development sleeve 34*a*, the developer can be prevented from falling into the circulation path 38 by setting the size of the gap between the buried member 82 and the development sleeve 34*a* to about 1 mm to 3 mm. This configuration is preferable because reliable developer supply can be achieved while preventing the wear of the development sleeve 34*a*.

It is to be noted that, although the buried member 82 is provided on the partition 36 to prevent the developer from falling into the circulation path 38 in the seventh embodiment, alternatively, this objective can be achieved by reducing the size of the gap between the partition 36 and the surface of the development sleeve 34*a* when it can be set precisely.

When the attraction portion 47 is disposed within an angle range from 70° to 80° on the surface of the development sleeve 34*a*, the developer can be prevented from falling into the circulation path 38 by setting the size of the gap between the partition 36 and the development sleeve 34*a* to about 0.5 mm to 1 mm. Additionally, when the attraction portion 47 is disposed within the angle range from 80° to 90° on the surface of the development sleeve 34*a*, by setting the size of the gap between the partition 36 and the development sleeve 34*a* to about 1 mm to 3 mm, the developer can be prevented from falling into the circulation path 38 while preventing the wear of the development sleeve 34*a*.

(Variation 1)

Figure 36:
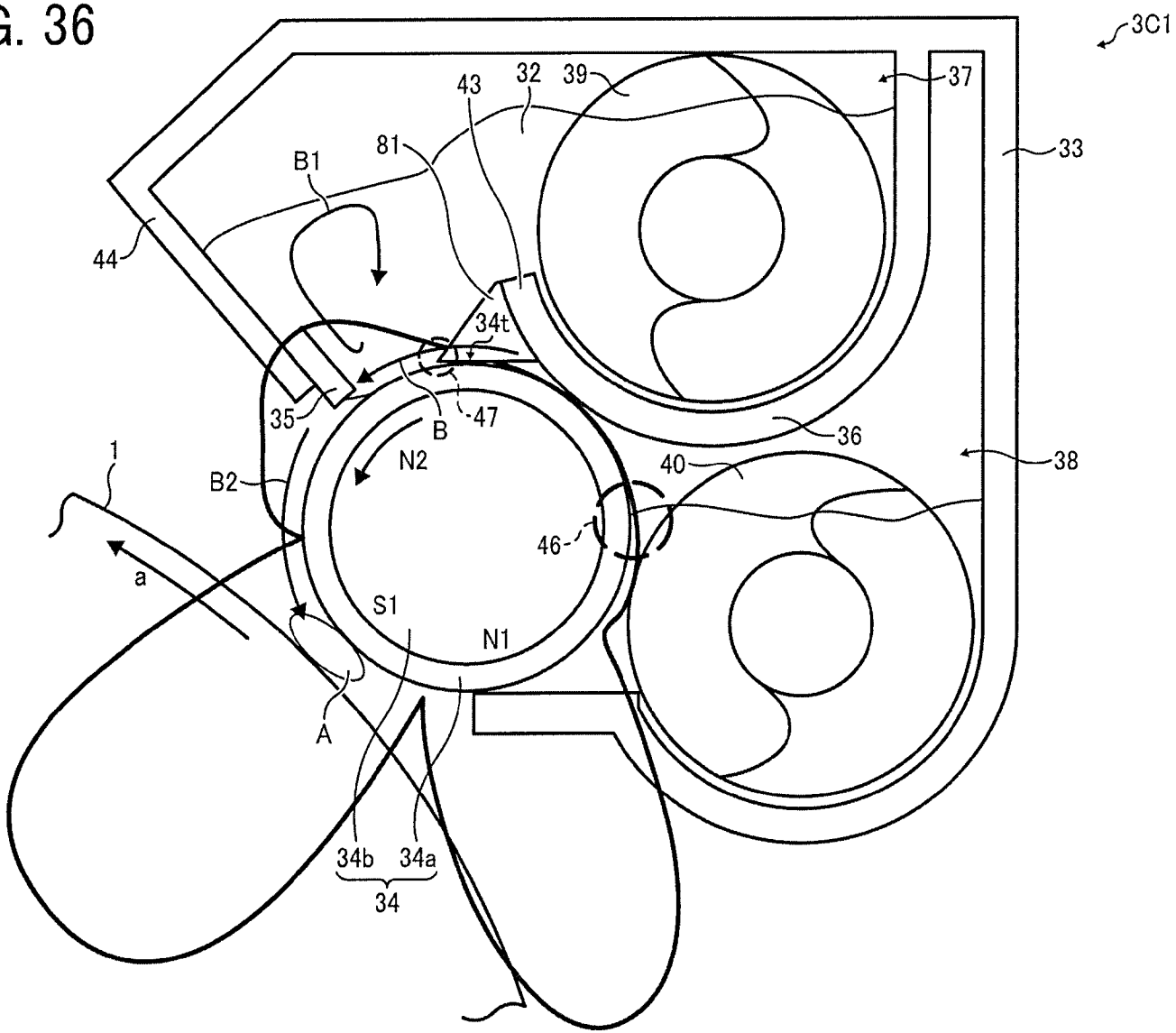
FIG. 36 is a schematic diagram illustrating a configuration of a variation of the development device shown in FIG. 31.

FIG. 36 illustrates a schematic configuration of a development device 3C1 according to a first variation that is a variation of the fourth embodiment (development device 3C) shown in FIG. 31. Except that the development device 3C1 is a reverse development type, that is, the photoconductor 1 and the development roller 34*a* rotate in opposite directions in the development range A, the development device 3C1 according to the first variation has a similar configuration to that of the development device 3C according to the fourth embodiment, and thus the descriptions thereof are omitted.

Generally, image failure in which leading edges of images are absent tends to occur in the reverse development type due to the following reason.

Herein, a development nip and the development range A respectively mean an area where the developer on the development sleeve 34*a* contacts the photoconductor 1 and a portion within the development nip where development is performed due to the magnetic field. While the photoconductor 1 and the development sleeve 34*a* rotate in the opposite directions, the toner adhering to the photoconductor 1 in the development range A exits the development nip. The carrier particles in the developer carried on the development sleeve 34*a* form a magnetic brush, and, upstream from the development range A in the rotational direction of the development sleeve 34*a*, toner particles adhering to an edge portion of the magnetic brush move toward the development sleeve 34*a* due to the electrical field applied to a non-image area. Because a positive electrical field (hereinafter "counter charge") remains on the edge portion of the magnetic brush, the toner adhering to the photoconductor 1 can be electrically removed therefrom by the counter charge, and thus leading edges of resultant images tends to be absent. Additionally, the development sleeve 34*a* rotating in the direction opposite the rotational direction of the photoconductor 1 can remove the toner adhering to the photoconductor 1 mechanically.

Even in the reverse development type development device 3C1, similarly to the above-described various embodiments, the image failure in which leading edges of images are absent can be inhibited by reducing the diameter of the development sleeve 34*a* because, when the diameter is smaller, curvature of the development sleeve 34*a* increases, attaining the following advantage.

In the development sleeve 34*a* whose diameter is smaller, the width of the development nip is significantly small. For example, the width of the development nip may be within a range from about 1.5 mm to 2.5 mm when the diameters of the development sleeve 34*a* and the photoconductor 1 are 10 mm and 30 mm, respectively, a smallest gap between the development sleeve 34*a* and the photoconductor 1 is 0.35 mm, and the amount of developer carried on the development sleeve 34*a* that has passed through the regulation gap is 50 mg/cm$^2$. When the diameter of the development sleeve 34*a* is 18 mm and other conditions are similar, the width of the development nip may be within a range from about 4 mm to 5 mm. Thus, when the diameter of the development sleeve 34*a* is smaller, the width of the development nip is significantly small. Accordingly, the magnetic brush can be separated from the photoconductor 1 immediately after development, which can reduce the amount of developer mechanically removed from the photoconductor 1. Additionally, the size of the electrical field outside the development range A can be smaller when the curvature of the development sleeve 34*a* is larger, which can reduce the amount of toner electrically removed from the photoconductor 1.

Additionally, in the reverse development type, because the sliding between the photoconductor 1 and the development sleeve 34*a* can be enhanced, the photoconductor receives less effected by after images, which can obviate the need of a cleaning unit to clean the surface of the photoconductor 1.

Thus, by using the development sleeve 34*a* whose diameter is smaller in the reverse development type development device 3C1, the above-described image failure can be inhibited while the cleaning unit for the photoconductor 1 is omitted, which can reduce the size and the cost of the apparatus.

Herein, when the developer is supplied to the development sleeve 34*a* from above as in the first through seventh embodiments and the first variation, the amount of developer that passes through the regulation gap can be substantially constant regardless of whether the developer regulator 35 is formed of a magnetic material or non-magnetic material.

Figure 37A:
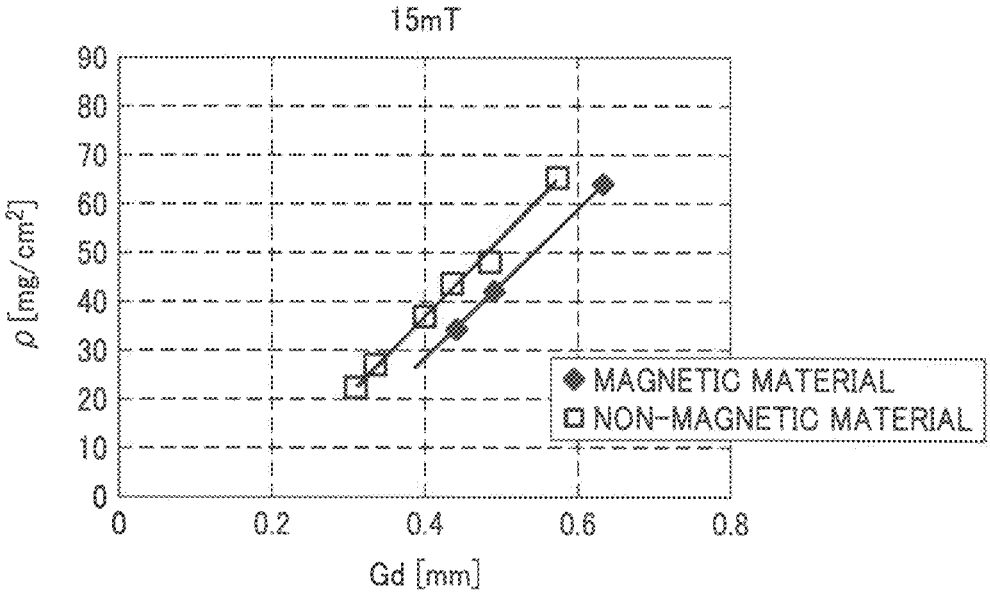
FIGS. 37A and 37B are graphs showing relations between the amount of developer passing through a regulation gap and the width of the regulation gap when the peak of the magnetic flux density in the normal direction in the pre-development pole N2 is 15 mT and 30 mT, respectively.
Figure 37B:
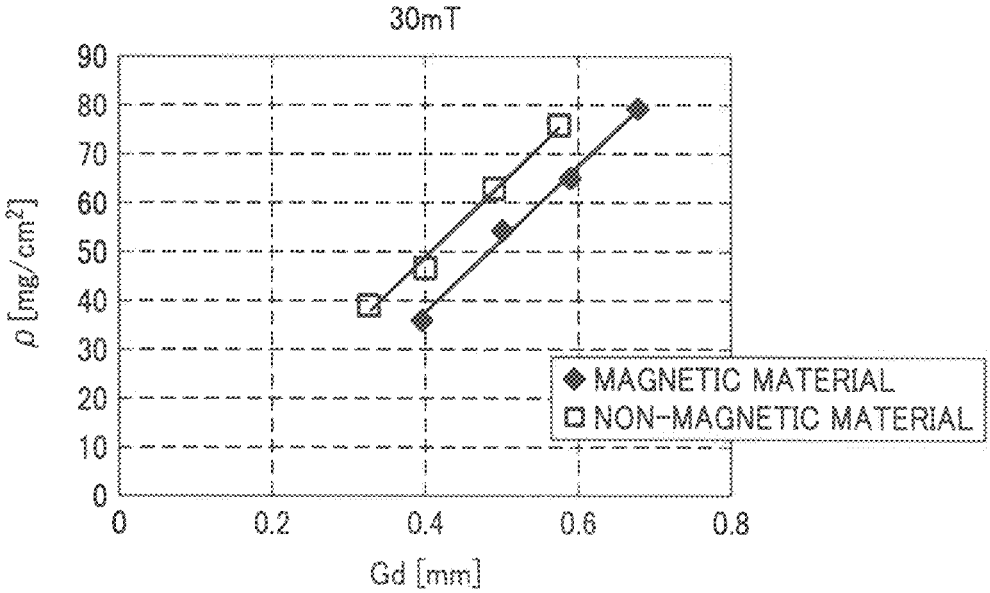

FIGS. 37A and 37B are graphs showing the relations between the amount (ρ) of developer that passes through the regulation gap and the width (Gd) of the regulation gap between the edge of the developer regulator 35 and the surface of the development sleeve 34*a* in the development device 3C (shown in FIG. 31) according to the fourth embodiment. FIGS. 37A and 37B respectively illustrate results obtained when the peak of the magnetic flux density in normal direction in the pre-development pole N2 serving as the developer regulation pole was set to 15 mT and 30 mT.

As shown in FIGS. 37A and 37B, regardless of whether the material of the developer regulator 35 is magnetic or non-magnetic, the graph showing the relation between the width Gd of the regulation gap and the amount p of the developer has a similar inclination, that is, changes in the amount p according to changes in the width Gd of the regulation gap are similar.

Figure 38:
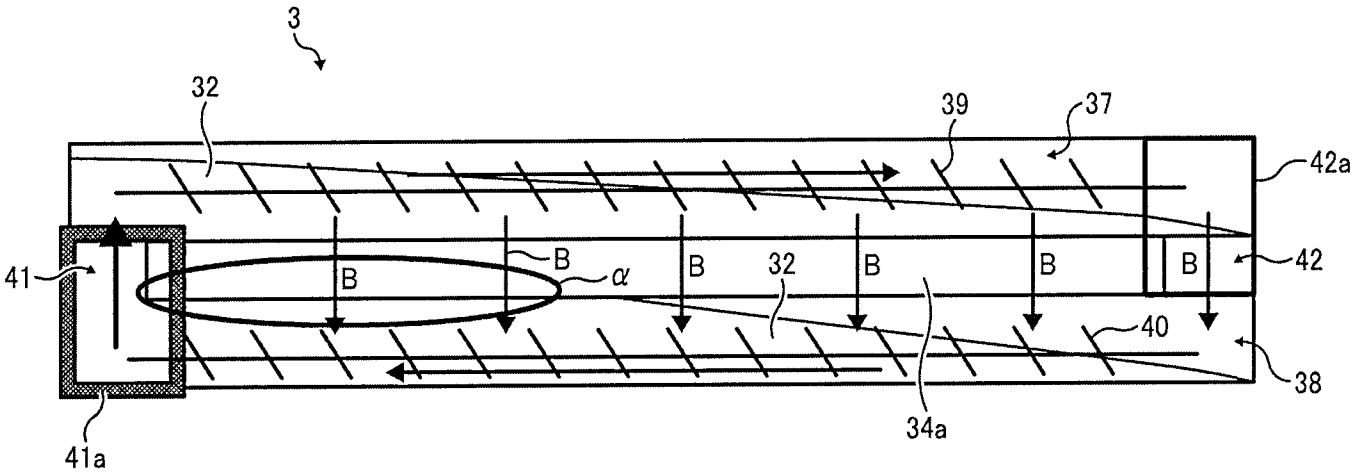
FIG. 38 illustrates a flow and a distribution of the developer in developer transport paths in the development device according to an illustrative embodiment.

Next, transportation of the developer in the development devices 3 through 3F (hereinafter correctively "development device 3") in the first through seventh embodiments is described in further detail below. FIG. 38 illustrates a flow and a distribution of the developer in the developer transport paths (supply path 37 and circulation path 38) in the development device 3 in the first through seventh embodiments. A bring-up portion 41*a* means a portion where the developer is brought up against gravity from the circulation path 38 through the bring-up port 41 to the supply path 37. A falling portion 42*a* means a portion where the developer falls from the supply path 37 through the falling port 42 to the circulation path 38. Therefore, the developer tends to accumulate around the bring-up portion 41*a*. Herein, leakage and carrying over of the developer, which can occur on the downstream side in the circulation path 38 in the developer transport direction, are described below. As shown in FIG. 38, the amount per unit time of the developer brought up through the bring-up port 41 is larger than that of the developer falling through the falling portion 42*a* to the circulation path 38. Therefore, the developer tends to accumulate around the bring-up portion 41*a*. As a result, the developer tends to accumulate not only around the bring-up portion 41*a* but also upstream from the bring-up portion 41*a* in the circulation path 38 in the developer transport direction of the circulation screw 40.

In the state shown in FIG. 38, the developer accumulates upstream from the bring-up portion 41*a* in the circulation path 38 in the developer transport direction of the circulation screw 40. In the state shown in FIG. 38, the developer cannot be collected from the development sleeve 34*a* to the circulation path 38 in an area a shown in FIG. 38. In this case, because the developer carried on the development sleeve 34*a* that has passed through the development range A cannot enter the circulation path 38, the developer has to leak through a gap in the casing 33 outside the development device 3, which is hereinafter referred to as leakage of developer.

Additionally, as shown in FIG. 38, when the developer accumulates around the downstream end in the circulation path 38 in the developer transport direction therein, carrying over of the developer can occur in addition to the leakage of developer. Carrying over of developer means the phenomenon that the developer fails to leave the development sleeve 34*a* in the portion where the development sleeve 34*a* faces the circulation path 38 and is again transported to the development range A. The toner concentration of such carried-over developer is lower. Therefore, when the carrying over of developer occurs, a necessary amount of toner cannot be supplied to the development range A, thus decreasing the image density.

It is to be noted that both leakage of toner and carrying over of developer tend to occur when the amount of developer is relatively large around the downstream end in the circulation path 38 in the developer transport direction. That is, leakage of toner and carrying over of developer do not occur when the amount of developer is relatively small and the height thereof is lower around the downstream end in the circulation path 38 in the developer transport direction.

Next, prevention of the leakage of toner and the carrying over of developer in the development device 3 is described below. The amount of developer can be kept relatively small around the downstream end in the circulation path 38 in the developer transport direction with the following features: (a) increasing the force to transport the developer around the downstream end in the circulation path 38 in the developer transport direction or (b) setting the area and the position of the bring-up port 41 properly.

Eighth Embodiment

An eighth embodiment including the feature (a) is described below. The feature (a) can be added to the development device 3 according to any one of the above-described first through seventh embodiments.

To achieve the feature (a), a lead angle of the circulation screw 40 transporting the developer in the circulation path 38 should be set properly.

Figure 39:
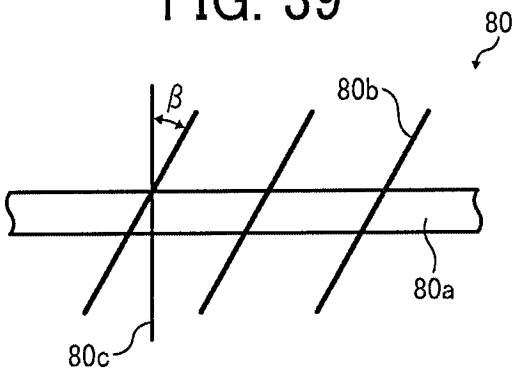
FIG. 39 illustrates a lead angle of a screw member.

A lead angle of a screw 80 usable as the supply screw 39 and the circulation screw 40 is described below with reference to FIG. 39. Referring to FIG. 39, the lead angle β is an angle formed by a virtual plane 80*c* and a face of a bladed screw spiral 80*b* fixed to a screw shaft 80*a*. The lead angle β decreases as the inclination of the blade screw spiral 80*b* approaches an inclination perpendicular to the screw shaft 80*a*. The lead angle β can be expressed using formula 3 shown below.

$$\theta = \tan^{-1}\left[\frac{B}{2A}\right] \quad 3$$

wherein A represents the diameter of the screw 80, and B represents the screw pitch thereof.

Figure 40:
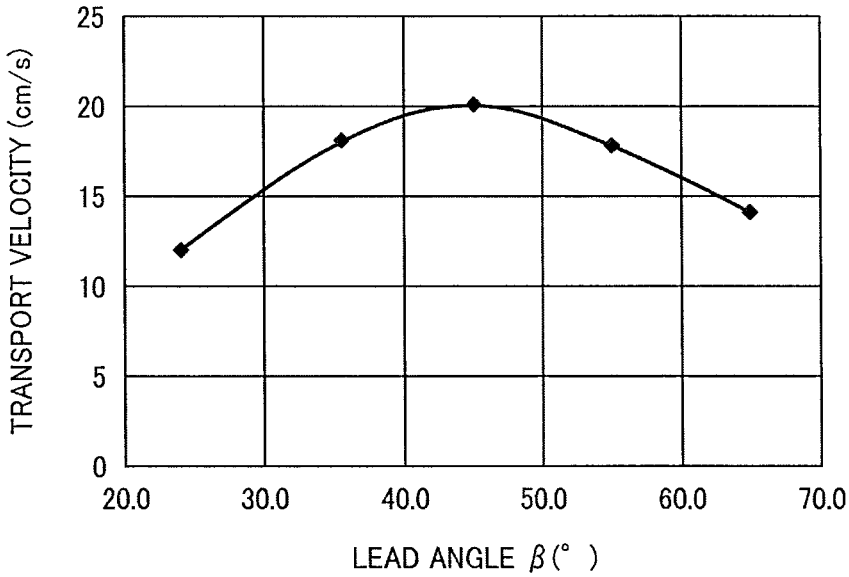
FIG. 40 is a graph illustrating the relation between the lead angle and transport velocity of the screw member.

FIG. 40 is a graph illustrating the relation between the lead angle β and the transport velocity of the screw 80.

FIG. 40 shows the transport velocity in the axial direction of the screw 80 measured in an experiment in which the diameter and the rotational velocity of the screw 80 were set to 14 mm and 800 rpm, respectively.

As shown in FIG. 40, the transport velocity can be increased by setting the lead angle β to an angle close to 45°. Thus, it is preferred to set the lead angle of a portion of the circulation screw 40 around the downstream end in the circulation path 38 in the developer transport direction an angle of about 45°. Alternatively, the transport velocity of the developer can be increased by increasing the rotationally number of the circulation screw 40. However, when the rotational number of the screw is higher, heat is generated due to friction between the screw and the bearing portion. Because such heat might cause toner in the developer to coagulate and be solidified, it is preferred that the rotational number of the screw be as small as possible. Therefore, in the development device 3, the portion of the circulation screw 40 around the downstream end in the circulation path 38 in the developer transport direction has a lead angle of about 45° and then the rotational number thereof is set to a necessary number. As an example, the circulation screw 40 rotates at a rotational number of 800 rpm in the eighth embodiment.

Additionally, it is preferred that the circulation screw 40 should have such a configuration to apply an upward force to the developer at the position where the bring-up port 41 is disposed in the circulation path 38. More specifically, it is preferred that the lead angle of a portion of the circulation screw 40 corresponding to the bring-up port 41 in the circulation path 38 be close to an angle of 60°, for example, within a range from 45° to 70°, which is described in further detail below with reference to FIG. 41.

Figure 41:
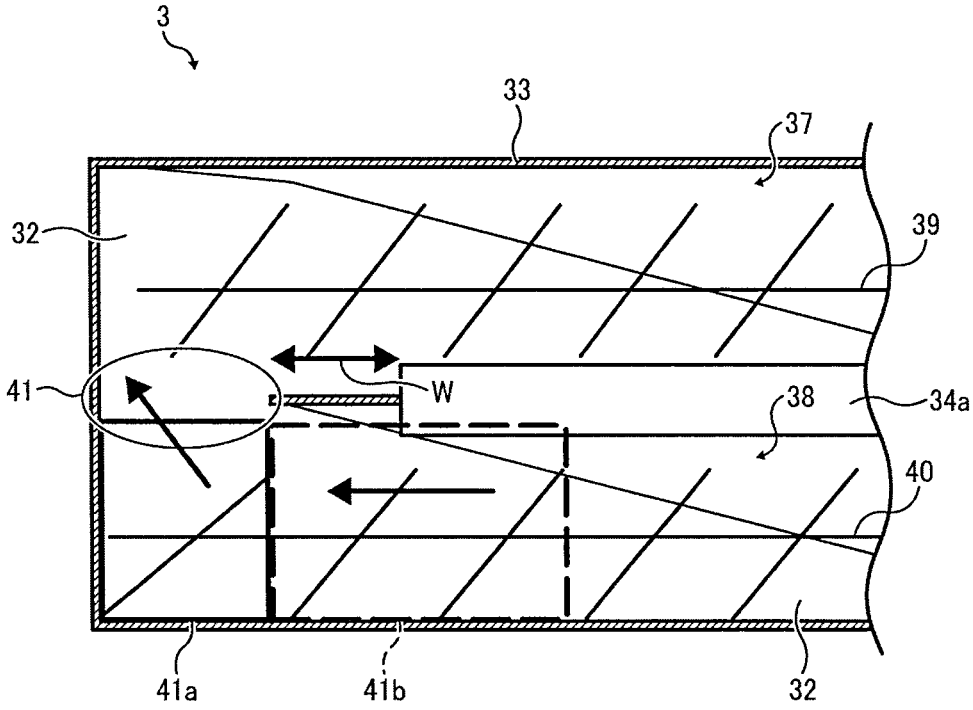
FIG. 41 illustrates a flow of the developer around a downstream end in a circulation path in a developer transport direction.

FIG. 41 illustrates a flow of the developer around the downstream end in the circulation path 38 in the developer transport direction.

In FIG. 41, the portion around the downstream end in the circulation path 38 includes the bring-up portion 41*a* and an upstream portion 41*b* positioned upstream from the bring-up portion 41*a* in the developer transport direction. In FIG. 41, arrow W indicates the distance between the bring-up port 41 and the development sleeve 34*a* in the axial direction.

As shown in FIG. 41, the developer is transported to the left in FIG. 41 to the upstream portion 41*b* positioned upstream from the bring-up portion 41*a*, and then transported upward in the bring-up portion 41*a*.

Therefore, the circulation screw 40 needs different functions in the bring-up portion 41*a* and the upstream portion 41*b*.

The portion of the circulation screw 40 corresponding to the upstream portion 41*b* needs to transport the developer in a horizontal direction efficiently, and thus the lead angle of that portion is set to an angle around 45°

By contrast, because the portion of the circulation screw 40 corresponding to the bring-up portion 41*a* needs to apply upward force to the developer, it is preferable that an inclined paddle is provided in that portion. Alternatively, the lead angle of that portion is set to an angle greater than 45°.

Figure 42:
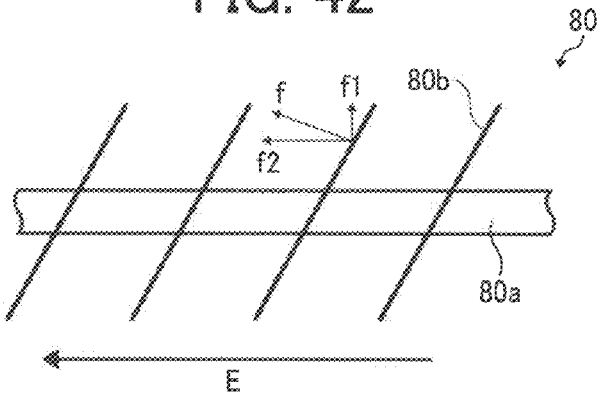
FIG. 42 illustrates a screw member having a smaller lead angle.
Figure 43:
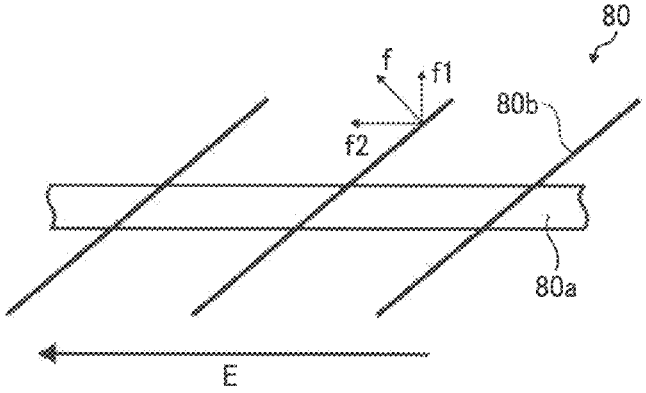
FIG. 43 illustrates a screw member having a larger lead angle.

FIG. 42 illustrates the screw 80 having a smaller lead angle, and FIG. 43 illustrates the screw 80 having a larger lead angle. In FIGS. 42 and 43, arrow E represents the developer transport direction.

The bladed screw spiral 80*b* of the screw 80 applies a vertical repulsion indicated by arrow f shown in FIGS. 42 and 43, which is vertical to the face of the screw spiral 80*b*, to the developer. The vertical repulsion f is formed by a component f1 perpendicular to the axial direction and a component f2 in the axial direction.

That is, the vertical repulsion f is determined by the lead angle β (shown in FIG. 39). When the lead angle is smaller, the component f2 in the axial direction is larger in the vertical repulsion f as shown in FIG. 42. As the lead angle increases, the component f2 in the axial direction decreases, and simultaneously, the component f1 in the direction perpendicular to the axial direction increases as shown in FIG. 43.

Therefore, upward force applied to the developer can be increased by increasing the lead angle of the circulation screw 40 in the portion corresponding to the bring-up portion 41*a*. However, when the lead angle is excessively large, the component f1 in the direction perpendicular to the axial direction is dominant in the vertical repulsion f, which is not desirable because the amount of developer entering the bring-up portion 41*a* decreases in this state. If the circulation screw 40 does not have a force to transport the developer in the axial direction at all in the bring-up portion 41*a*, the developer accumulates around a boundary between the bring-up portion 41*a* and the upstream portion 41*b* even if the circulation screw 40 tries to transport the developer in the axial direction in the upstream portion 41*b*. As a result, the amount of developer entering the bring-up portion 41*a* decreases, which reduces the efficiency in transporting the developer upward in the bring-up portion 41*a*.

Figure 44:
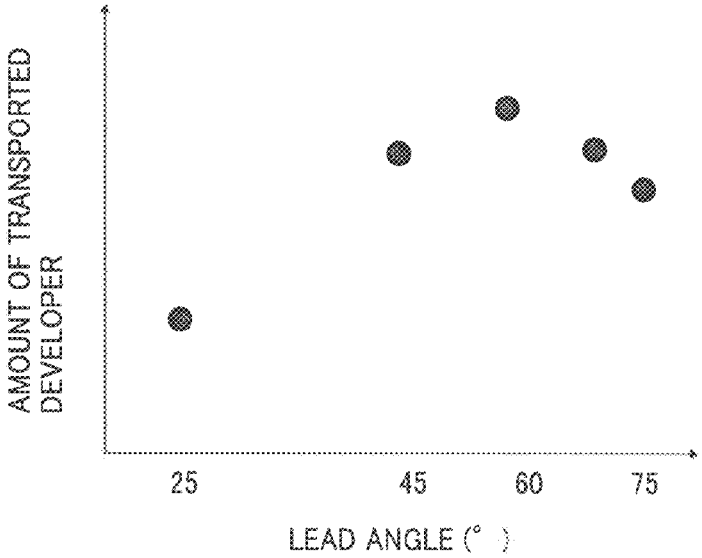
FIG. 44 is a graph illustrating the relation between the lead angle of the screw member and the amount of developer transported upward in a bring-up portion.

FIG. 44 illustrates a relation between the lead angle of the circulation screw 40 in the bring-up portion 41*a* and the amount of the developer transported upward in the bring-up portion 41*a* when the transportation of the developer in the development device 3 is in equilibrium.

In the example shown in FIG. 44, the amount of the developer transported upward in the bring-up portion 41*a* is greatest when the lead angle is about 60°.

From the graph shown in FIG. 44, it can be known that the developer can be transported efficiently from the circulation path 38 through the bring-up portion 41*a* to the supply path 37 by setting the lead angle of the screw blade 80*b* of the circulation screw 40 in the bring-up portion to an angle around 60°. It is to be noted that, instead of setting the lead angle of the screw blade to about 60°, to efficiently transport the developer upward, a paddle may be provided in the portion corresponding to the bring-up portion 41*a* and the lead angle of the paddle may be set to about 60°.

In the eighth embodiment, the lead angle of the circulation screw 40 is set to about 45° in the portion around the downstream end in the circulation path 38, which means, for example, one third of the circulation path 38 divided in the developer transport direction, disposed on the downstream side in the developer transport direction, and set to an angle greater than 45° in the portion upstream from the portion around the downstream end in the circulation path 38. Additionally; the lead angle of the circulation screw 40 is set to an angle about 60° in the portion corresponding to the bring-up portion 41*a* inside the portion around the downstream end in the circulation path 38.

With this configuration, because the force to transport the developer can be increased around the downstream end in the circulation path 38 in the developer transport direction, and simultaneously the developer can be transported efficiently from the circulation path 38 through the bring-up portion 41*a* to the supply path 37, the amount of developer accumulating in the portion around the downstream end in the circulation path 38 can be reduced, preventing or inhibiting the leakage of the developer and the carrying over of the developer.

Ninth Embodiment

A development device 3G according to a ninth embodiment including the feature (b) is described below.

The feature (b) can be added to the development device 3 according to any one of the above-described first through eighth embodiments.

Important factors regarding the feature (b) are the shape of the bring-up port 41 and the position thereof relative to the development sleeve 34*a* on a virtual plane perpendicular to the axial direction of the development sleeve 34*a* in the bring-up port 41.

Figure 45:
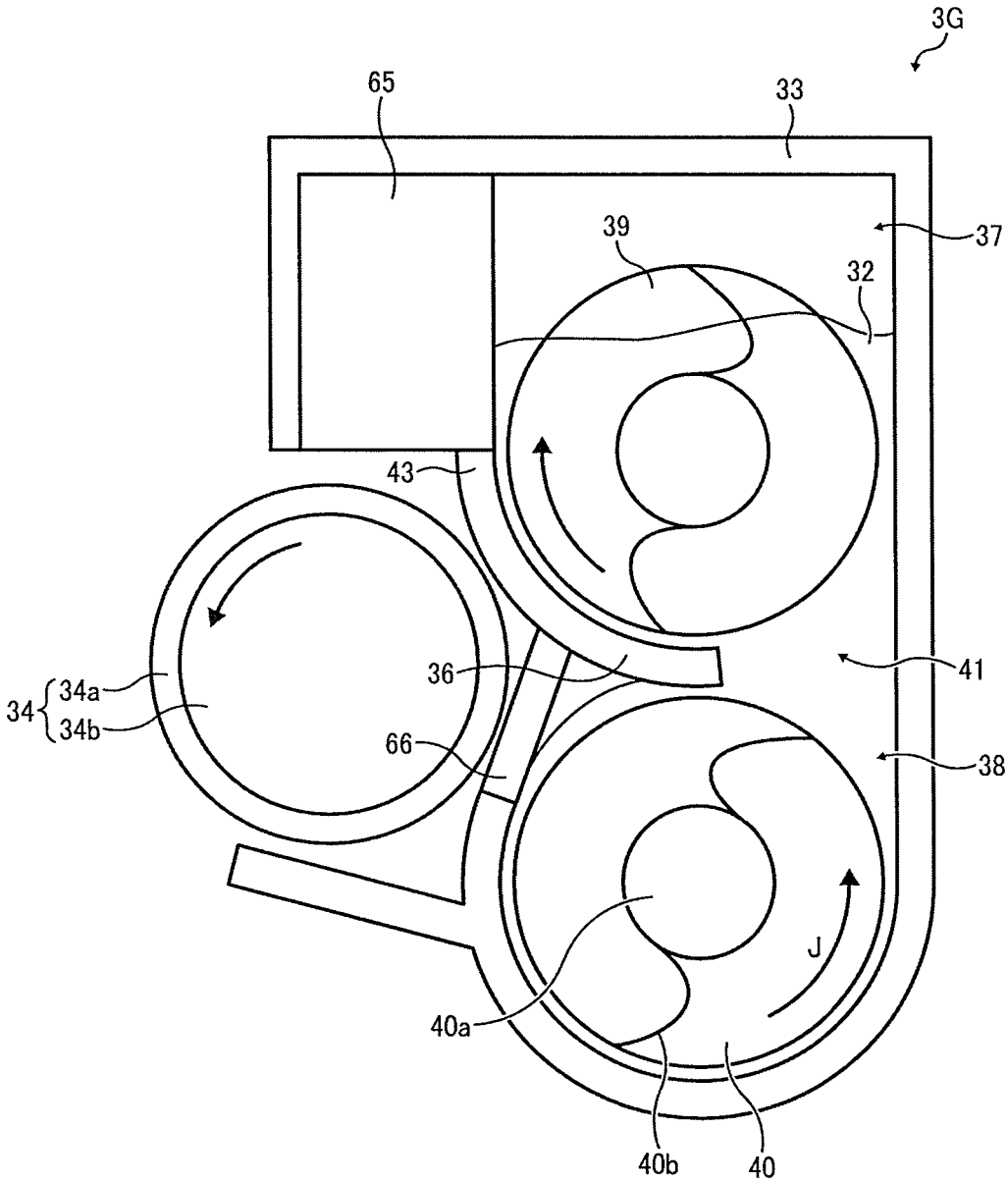
FIG. 45 illustrates a cross section of a development device cut at the position of the bring-up portion in a ninth embodiment.

FIG. 45 illustrates a cross section of the development device 3G on the virtual plane perpendicular to the axial direction of the development sleeve 34*a* in the bring-up port 41. It is to be noted that, at the position in the axial direction where the bring-up port 41 is disposed, the developer is not supplied to the development sleeve 34*a* nor collected therefrom. Therefore, a portion 65 divides the space above the barrier 43, between the supply screw 39 and the development sleeve 34*a*, and a partition 66 divides the space between the circulation screw 40 and the development sleeve 34*a*.

In the development device 3G shown in FIG. 45, the bring-up port 41 is formed in the partition 36 on the side away from the development sleeve 34*a* on the virtual plane.

Additionally, in the development device 3G, the circulation screw 40 rotates counterclockwise (in a direction indicated by arrow J) in FIG. 45. Thus, a bladed screw spiral 40*b* moves upward on the right of a screw shaft 40*a* in FIG. 45 and downward on the left of the screw shaft 40*a* in FIG. 45. Because the surface of the developer in the circulation path 38 is higher on the right of the screw shaft 40*a* in FIG. 45 accordingly, the bring-up port 41 is formed in an upper portion on the right of the screw shaft 40*a* in FIG. 45 in the circulation path 38 to bring up the developer to the supply path 37 from the side where the surface of the developer is higher. The efficiency in transporting the developer upward in the bring-up portion 41*a* can be enhanced by bringing up the developer from the side where the surface of the developer is higher as in the present embodiment.

Figure 46:
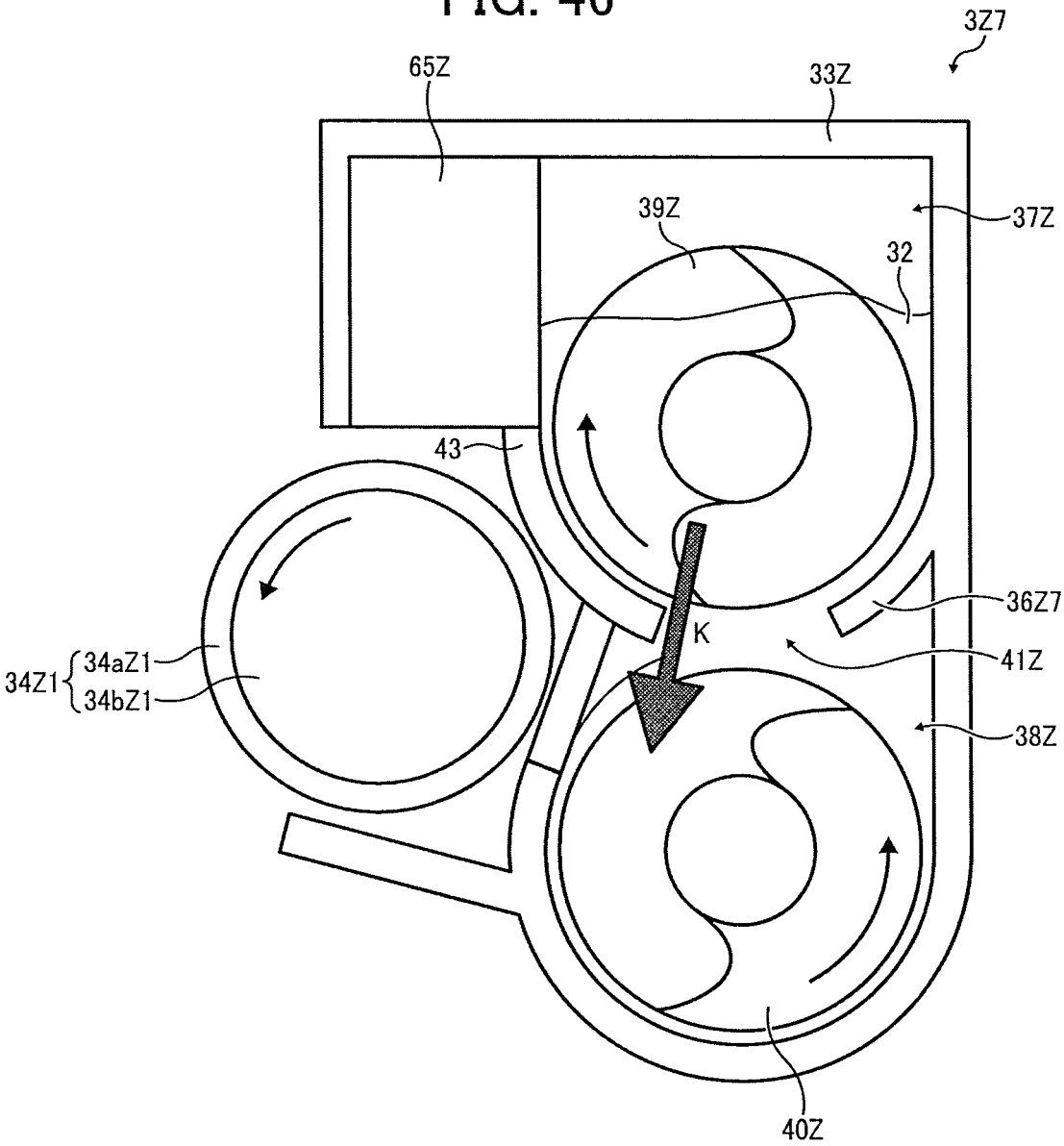
FIG. 46 illustrates a cross section of a development device cut at the position of a bring-up portion in a comparative example 7.

FIG. 46 illustrates a cross section of a development device 3Z7 according to a comparative example 7 in which a bring-up port 41Z is closer to the development sleeve 34Z1 on the virtual plate than in the ninth embodiment shown in FIG. 45.

In the development device 3G and 3Z7 respectively shown in FIGS. 45 and 46, a gap is present on a side closer to the development sleeve 34*a*Z1 in the bring-up port 41Z unless the developer clogs the bring-up port 41Z. Therefore, the developer that has been sent to the supply path 37Z falls through the gap in the bring-up port 41Z to the circulation path 38Z as indicated by arrow K shown in FIG. 46. Additionally, because the circulation screw 40Z rotates in the direction identical to the rotational direction of the circulation screw 40 shown in FIG. 45, the surface of the developer in the circulation path 38Z is higher on the side away from the development sleeve 34Z1 than on the side closer to it. Therefore, in the development device 3Z7 shown in FIG. 46, to bring up the developer from the circulation path 38Z to the supply path 37Z, a greater amount of developer should be present in the bring-up port 41Z than that in the development device 3G shown in FIG. 45 because the developer should clog the bring-up port 41Z. Thus, although the surfaces of the developer in FIGS. 45 and 46 are at a similar highest, in the comparative example 7, a greater amount of developer is necessary in the bring-up portion to fill the bring-up port 41Z with the developer close to the development sleeve 34*a*Z1 because the developer falls from the supply path 37Z through the gap in the bring-up port 41Z as indicated by arrow K shown in FIG. 46. However, when the developer accumulates in the bring-up portion 41*a*, the developer accumulates also in the portion 41*b*, thus increasing the possibility of occurrence of carrying over and leakage of developer.

By contrast, in the ninth embodiment, because the bring-up port 41 is disposed away from the development sleeve 34*a*, the developer can be brought up from the circulation path 38 to the supply path 37 even when the amount of the developer is smaller than that in the comparative example 7. Accordingly, the amount of developer present in the upstream portion 41*b* upstream from the bring-up portion 41*a* can be smaller, thus inhibiting the carrying over and leakage of developer. Therefore, it is preferred that the bring-up port 41 is disposed away from the development sleeve 34*a* on the vertical plane perpendicular to the axial direction of the development sleeve 34*a*.

Next, the shape of the bring-up port is described below with reference to FIG. 47.

Figure 47:
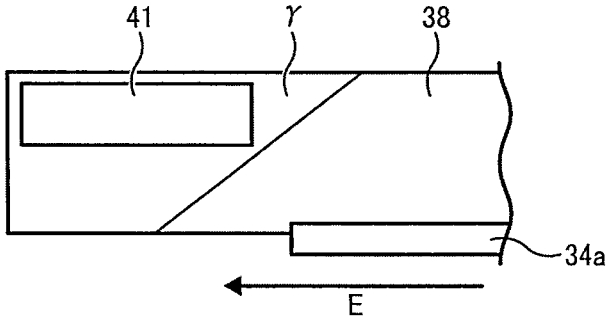
FIG. 47 schematically illustrates a downstream end portion in a circulation path in the development device shown in FIG. 45 viewed from above.

FIG. 47 schematically illustrates the portion around the downstream end in the circulation path 38 in the development device 3G shown in FIG. 45 viewed from above.

In FIG. 47, a reference character y represents an area where the developer in the circulation path 38 contacts a lower side of the partition 36. The developer can be brought up from the circulation path 38 to the supply path 37 only when the bring-up port 41 is clogged with the developer, and the developer contacts the partition 36 around the bring-up port 41 in that state. In other words, the bring-up port 41 should be formed in a portion inside the area y where the developer contacts the lower side of the partition 36 in the circulation path 38.

Figure 48:
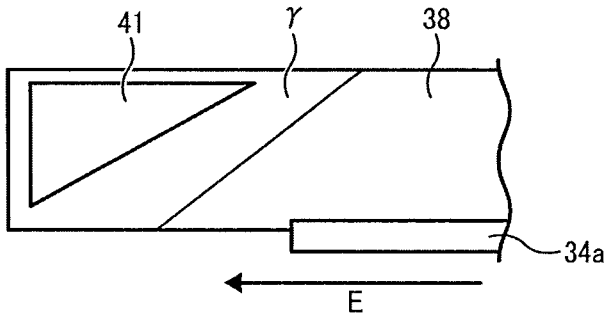
FIG. 48 illustrates a triangular bring-up port.
Figure 49:
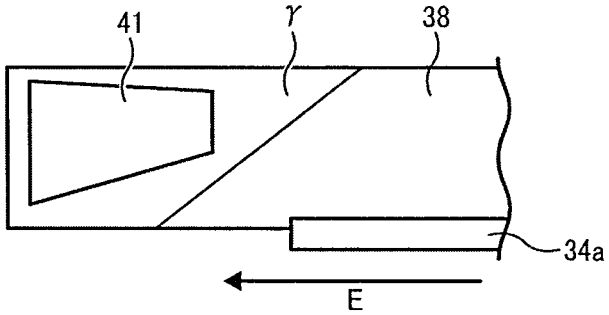
FIG. 49 illustrates a trapeziform bring-up port.
Figure 50:
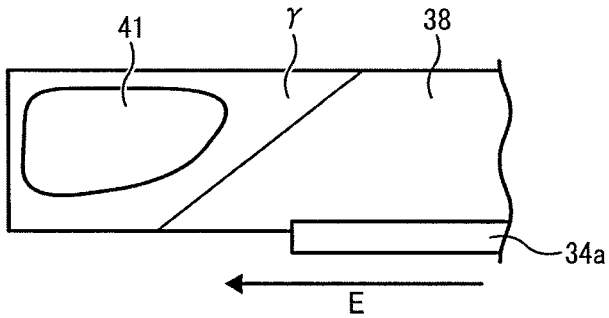
FIG. 50 illustrates a rounded bring-up port.

The shape of the bring-up port 41 is not limited to the shape shown in FIG. 47 but can be triangular as shown in FIG. 48, trapeziform as shown in FIG. 49, or rounded as shown in FIG. 50, for example. Although the bring-up port 41 can have any shape, the bring-up port 41 preferably has such a shape that its length in the axial direction of the development sleeve 34*a* increases toward the side away from the development sleeve 34*a*. It is preferred that the bring-up port 41 be formed on the side away from the development sleeve 34*a* in the partition 36 as described above.

Additionally, it is preferred that the area of the bring-up port 41 be larger than that of the cross section of the circulation screw 40, which is described later with reference to FIG. 59. It is to be noted that the area of the cross section of the screw means the area of a circle formed by external shape of the blade on a cross section perpendicular to the screw shaft of the screw.

Next, dispersion of fresh toner supplied to the development device 3 is described below.

Figure 51:
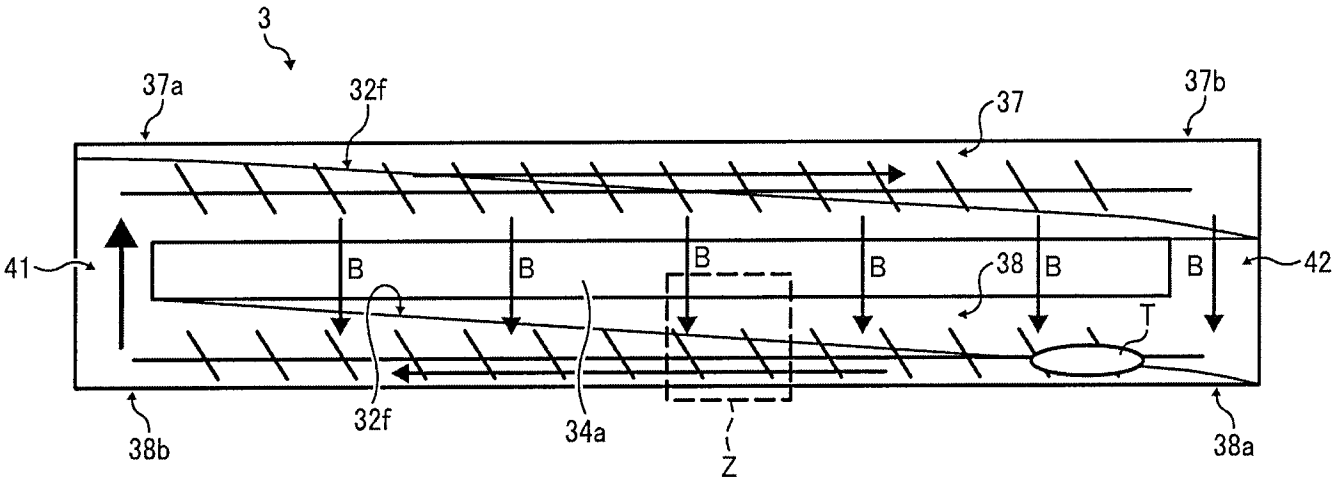
FIG. 51 illustrates a flow and a distribution of developer in developer transport paths in an illustrative embodiment.

FIG. 51 illustrates a toner supply position T where fresh toner is supplied to the development device 3 shown in FIG. 38. The fresh toner is supplied on the upstream side in the circulation path 38 in the developer transport direction. While mixed with the existing developer, the supplied toner is transported sequentially from the circulation path 38 through the bring-up port 41 and the supply path 37 up to the surface of the development sleeve 34*a*.

To compensate for the amount of consumed toner, 0.05 g of toner is supplied to the development device 3 in each supply operation. For example, when 0.3 g of toner is to be supplied, the supply operation is repeated six times intermittently.

The toner supplied in each supply operation (0.05 g) should be dispersed in the developer in the longitudinal direction (axial direction) of the development sleeve 34*a* while transported.

Dispersion of supplied toner while the circulation screw 40 transports the developer is to be described later.

Dispersing the supplied toner in the bring-up portion 41*a* is described below.

Figure 52:
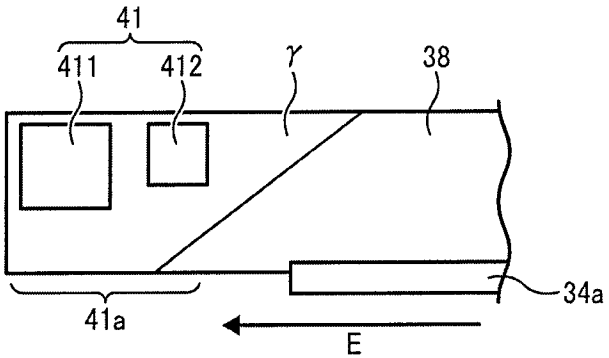
FIG. 52 is an overhead view illustrating a downstream end portion in a circulation path in a development device in which a bring-up port 41 is divided into two.
Figure 53:
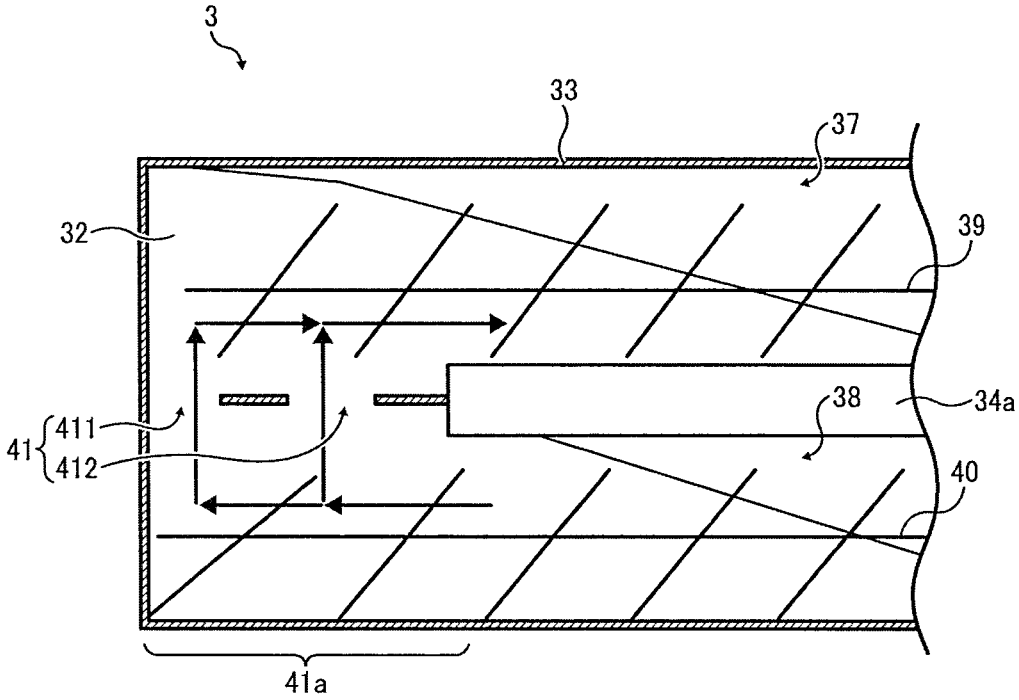
FIG. 53 is a side view illustrating the downstream end portion in the circulation path in the development device shown in FIG. 52.

To disperse the supplied toner in the longitudinal direction, the path through which the supplied toner is transported in the bring-up portion 41*a* may be divided. For example, as shown in FIG. 52, the bring-up port 41 may be divided into a first port 411 and a second port 412. When the bring-up port 41 is thus divided, the developer flows through two different paths in the bring-up portion 41*a* as shown in FIG. 53. With this configuration, even when developer whose toner concentration is higher enters the bring-up portion 41*a* locally, the toner concentration of the developer that has passed through the bring-up portion 41*a* can be equalized because the developer is divided into two different paths.

It is to be noted that, when the bring-up port 41 is divided, the opening area of the second port 412 positioned upstream from the first port 411 is preferably smaller than that of the first port 411 as shown in FIG. 52. If the opening area of the second port 412 is larger, most of the developer passes through the second port 412, and thus dispersion effect is reduced. Further, when the total opening area of two divided ports 411 and 412 is greater than the cross section of the circulation screw 40, clogging of the developer can be prevented.

It is to be noted that the dispersibility of the supplied toner can be enhanced also when the bring-up port 41 has such a shape that its width in the direction perpendicular to the axial direction of the development sleeve 34*a* is reduced toward upstream in the developer transport direction as in FIGS. 48 and 49 because, similarly to when the bring-up port 41 is divided, time lag is caused in bringing up the developer between the upstream side and the downstream side in the developer transport direction in the circulation path 38.

Figure 54:
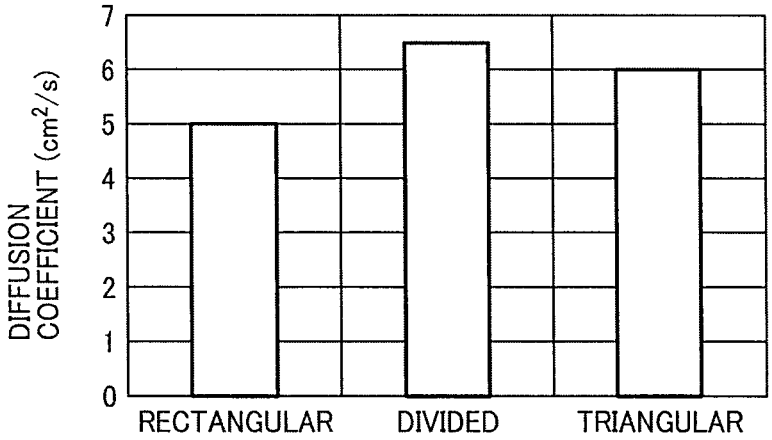
FIG. 54 is a graph illustrating the relation between the shape of the bring-up port and dispersion coefficient of toner.

FIG. 54 is a graph illustrating the relation between the shape of the bring-up port 41 and dispersion coefficient of toner, which is a coefficient D used in a transport and dispersion equation of developer expressed by formula 3 shown below.

In formula 4, C represents the toner concentration, and the left part represents changes in the toner concentration per unit time. In the right part, a first term is a transport term concerned with movement of the developer in the axial direction and a second term is a dispersion term concerned with dispersion of toner in the developer. When the dispersion coefficient D in the above-described formula 4 is larger, dispersion of toner in the developer is enhanced, that is, the toner can be better mixed with the existing developer, in the longitudinal direction.

The toner concentration is measured immediately after fresh toner is supplied and after the developer is brought up from the circulation path 38 to the supply path 37, and the coefficients D and u in formula 4 are calculated based on the distance by which the developer is transported (hereinafter "transport distance") and the time during which the developer is transported (hereinafter transport time).

FIG. 54 illustrates the results of calculation of the dispersion coefficient. In FIG. 4, "rectangular" represents the result when the bring-up port 41 has the shape shown in FIG. 47. Similarly, "triangular" and "divided" represent the results when the bring-up port 41 has the shapes shown in FIGS. 48 and 52, respectively.

Thus, dispersibility of the supplied toner is better when the bring-up port 41 has such a shape as shown in FIG. 48, 49, 50, or 52 than when the bring-up port 41 is rectangular as shown in FIG. 47.

Tenth Embodiment

A tenth embodiment regarding transportation of the developer is described below. The feature of the tenth embodiment is applicable to the development device 3 according to any one of the above-described first through ninth embodiments.

The flow of the developer in the development device 3 is described below.

Figure 55:
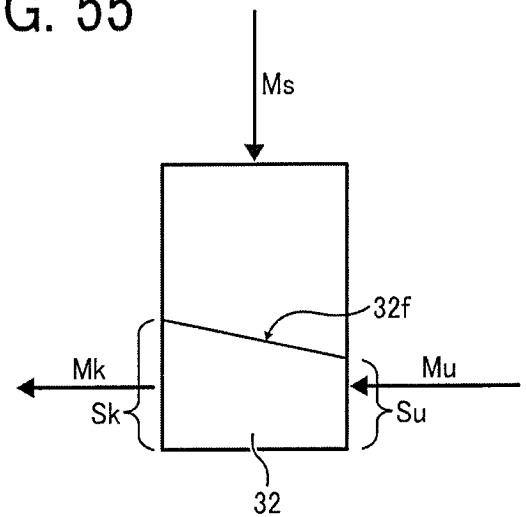
FIG. 55 illustrates a flow of the developer in a given area in the circulation path in a developer transport direction.

As shown in FIG. 51, the developer passes through an upstream end portion 38*a* in the circulation path 38, a downstream end portion 38*b* in the circulation path 38, an upstream end portion 37*a* in the supply path 37, and a downstream end portion 37*b* in the supply path 37 and thus is circulated in the development device 3, forming a backflow (hereinafter "main backflow"). In addition to the main backflow, a certain amount of developer flows from the supply path 37 through the surface of the development sleeve 34*a* to the circulation path 38 (hereinafter "branched flow"). When the main backflow flows at a similar velocity across the entire development device 3, the amount of the developer increases toward downstream in the circulation path 38 and increases toward upstream in the supply path 37 in the developer transport direction. Therefore, a surface 32*f* of the developer is oblique in the longitudinal direction as shown in FIG. 51. FIG. 55 illustrates a flow of the developer in a given area Z in the circulation path 38 shown in FIG. 51.

In the given area Z shown in FIG. 51, three different flows of developer, namely, a flow Mu entering the area Z from upstream, a flow Mk going downstream from the area Z, and a flow Ms falling from the surface of the development sleeve 34*a*, collected in the area Z, are present.

In the development device 3, when the amount of the developer present in the area Z (hereinafter "circulation path cell") is in equilibrium, the relation among the three flows of the developer can be expressed by the following formula A1.

$$Mk=Mu+Ms \quad \text{(A1)}$$

In other words, the amount of developer entering the circulation path cell Z equals to that of developer going out the circulation path cell Z.

Additionally, the amount of developer in the flow Mu is determined by multiplying a cross-section area Su of the developer in an upstream end portion in the circulation path cell Z in the developer transport direction with a transport velocity Vu in the upstream end portion in the circulation path cell Z, which can be expressed by formula A2 shown below.

$$Mu=Su\times Vu \quad (A2)$$

Similarly, the amount of developer in the flow Mk is determined by multiplying a cross-section area Sk of the developer in a downstream end portion in the circulation path cell Z in the developer transport direction with a transport velocity Vk in the downstream end portion in the circulation path cell Z, which can be expressed by formula A3 shown below.

$$Mk=Sk\times Vk \quad (A3)$$

When the values of the transport velocities Vu and Vk are identical, the cross-section area Sk of the developer in the downstream end portion is larger than the cross-section area Su of the developer in the upstream end portion by an area corresponding to the amount of developer falling from the development sleeve 34*a*. When the relation Vk=Vu=V is established, formula A4 shown below can be obtained.

$$Sk\times V=Su\times V+MS \quad (A4)$$

The above-described formula A4 can be converted into formula A5 shown below.

$$Sk=Su+Ms/V \quad (A5)$$

That is, the cross-section area Sk of the developer in the downstream end portion is larger than the cross-section area Su of the developer in the upstream end portion by an area corresponding "MsN".

Based on the above-described theory, the surface 32*f* of the developer is oblique in the development device 3 in the longitudinal direction.

Formula A6 shown below can be obtained from the formulas A1 through A3.

$$Sk\times Vk=Su\times Vu+Ms \quad (A6)$$

It is to be noted that the cross-section area Sk of the developer in the downstream end portion can be identical to the cross-section area Su of the developer in the upstream end portion (Sk=Su=S), that is, the height of the developer is not oblique but is constant, by configuring the development device 3 so that formula A7 shown below is established.

$$Vk=Vu+Ms/S \quad (A7)$$

The formula A7 means that the transport velocity Vk in the downstream end portion is increased from the transport velocity Vu in the upstream end portion by a value corresponding to "Ms/S". In other words, the surface 32*f* of the developer in the circulation path 38 can be uniform by increasing the transport velocity toward downstream in the developer transport direction in the circulation path 38.

Although the description above concerns the transport velocity of the developer in the circulation path 38, the transport velocity in the supply path is determined based on the similar theory.

Next, shortage of the developer, which can occur around the downstream end portion 37*b* in the supply path 37 in the developer transport direction, are described below.

Figure 56:
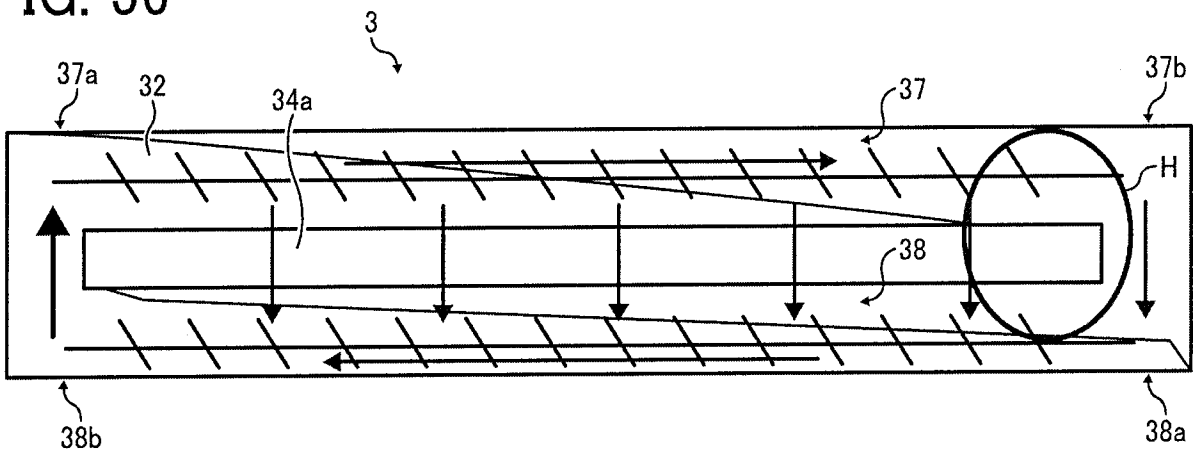
FIG. 56 illustrates the developer transport path in short of developer.

When the developer is transported at a similar velocity across the entire supply path 37, the amount of the developer decreases toward downstream in the supply path 37 as shown in FIG. 51, and accordingly the amount of the developer tends to be smaller around the downstream end portion 37*b*. If the amount of the developer is smaller than a certain amount round the downstream end portion 37*b*, the developer cannot be supplied to the development sleeve 34*a* from the supply path 37. As a result, the developer cannot be supplied to an area H positioned in a right side portion of the development sleeve 34*a* shown in FIG. 56, which is called shortage of the developer in this specification.

Figure 57:
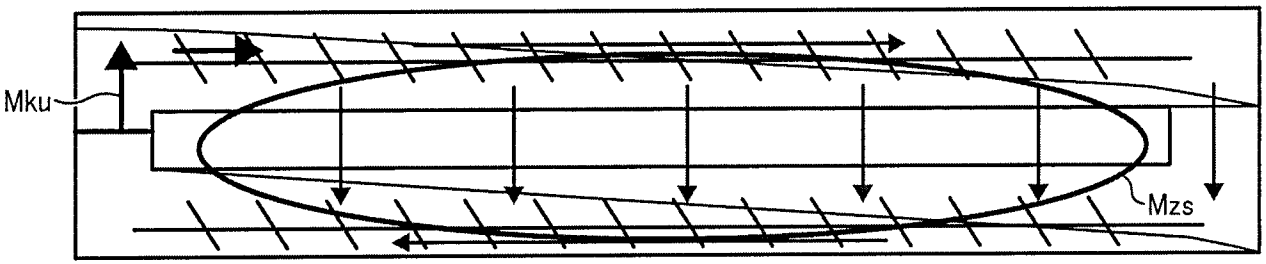
FIG. 57 illustrates conditions to prevent shortage of developer in the developer transport path.

Conditions to prevent the shortage of the developer are described below with reference to FIG. 57.

As the condition to prevent the shortage of the developer around the downstream end portion 37*b*, at least the relation expressed by formula A8 shown below should be established between the amount (Mku) of developer transported from the circulation path 38 to the supply path 37 per unit time and the amount (Mzs) of developer falling from the development sleeve 34*a* to the circulation path 3 per unit time shown in FIG. 57.

$$Mku>Mzs \quad (A8)$$

That is, when the transportation of the developer in the development device 3 is in equilibrium, the amount (Mku) of developer transported from the circulation path 38 to the supply path 37 per unit time should be greater than the amount (Mzs) of developer falling from the development sleeve 34*a* to the circulation path 3 per unit time. If the relation expressed by the formula A8 is not established, the developer runs short how fast the transport velocity of the developer in the supply path 37 except the upstream end portion 37*a*.

To prevent the shortage of developer, the amount of developer transported from the circulation path 38 through the bring-up port 41 to the supply path 37 per unit time should be greater than the amount of developer passing through the development range A per unit time, carried on the development sleeve 34*a*.

The relation between the lead angle β of the screw and the transport force of the screw is described above with reference to FIGS. 39 through 44 in relation to the feature (a) to inhibit the leakage and carrying over of the developer. Herein, the relation between the lead angle β of the screw and dispersibility of supplied toner is described below.

Figure 58:
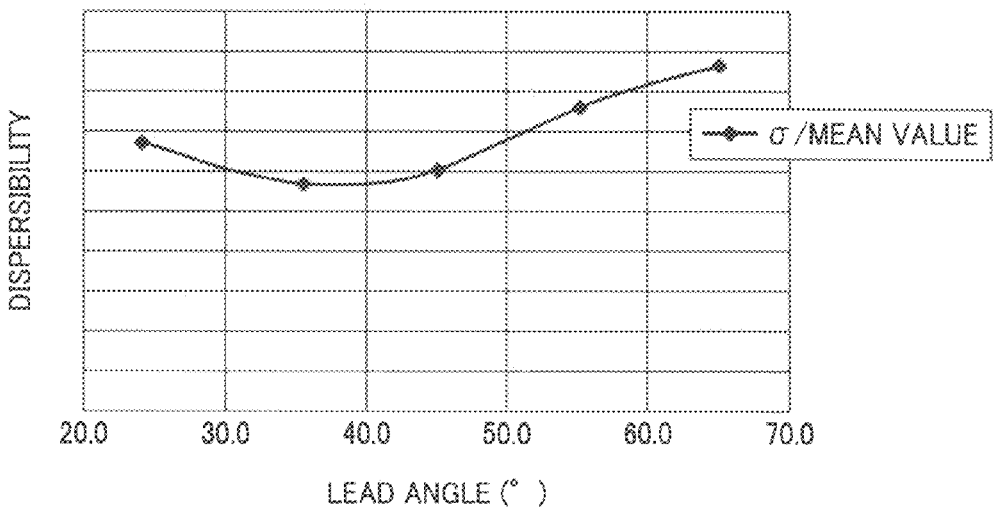
FIG. 58 is a graph illustrating the relation between the lead angle of the screw member and dispersibility of supplied toner.

FIG. 58 is a graph illustrating the relation between the lead angle β of the screw and dispersibility of supplied toner.

From the graph shown in FIG. 58, it can be known that the dispersibility of supplied toner is better when the lead angle f3 of the screw is larger. It is to be noted that the dispersibility of supplied toner means the degree by which the supplied toner is dispersed while the developer moves a unit distance in the axial direction of the screw.

Regarding the above-described feature (b) to keep the amount of developer relatively small around the downstream end in the circulation path 38, it is preferred that the bring-up port 41 is disposed away from the development sleeve 34*a* on the vertical plane perpendicular to the axial direction of the development sleeve 34*a* as described above with reference to FIGS. 45 and 46.

In addition, it is preferred that the distance indicated by arrow W in FIG. 41 between the bring-up port 41 and the development sleeve 34*a* in the axial direction of the development sleeve 34*a* be as long as possible.

As described above with reference to FIGS. 45 and 46, the developer falls from the supply path 37 through the gap in the bring-up port 41 to the circulation path 38Z unless the developer clogs the bring-up port 41.

Therefore, to bring up the developer through the bring-up port 41, a certain amount of developer should be accumulated in the bring-up portion 41*a* in the circulation path 38. Because accumulating the developer around the bring-up portion 41*a* can cause carrying over and leakage of developer, such inconveniences can be inhibited when the distance W (shown in FIG. 41) between the bring-up port 41 and the development sleeve 34*a* is relatively long.

However, the bring-up port 41 is preferably disposed close to the development sleeve 34*a* in the axial direction to keep the development device 3 relatively compact. Therefore, keeping the development device 3 relatively compact while inhibiting carrying over and leakage of developer cannot be attained by only setting the distance W between the bring-up port 41 and the development sleeve 34*a* properly.

To achieve both of these objectives, the opening area of the bring-up port 41 should be larger than the cross section of the circulation screw 40 because the amount of developer transported by the screw is determined by multiplying the cross section in which the developer is movable with the transport velocity as expressed by the above-described formulas A2 and A3. When the opening area of the bring-up port 41 is smaller than the cross section of the circulation screw 40, the developer moving through the bring-up port 41 needs to move at a velocity higher than the velocity at which the developer moves in an area where the circulation screw 40 gives a transport force to the developer. When the velocity of the developer moving through the bring-up port 41 is higher, a greater pressure is applied around the developer, and this pressure is transmitted to the bring-up portion 41*a* in the circulation path 38. As a result, the developer is likely to accumulate also around downstream end portion 38*b* (shown in FIG. 51) in the circulation path 38 in the developer transport direction, that is, the bring-up portion 41*a* and the upstream portion 41*b* (shown in FIG. 41).

In other words, when the bring-up port 41 serving as a first port has an opening area sufficiently large so that the developer packed while the circulation screw 40 makes one rotation can pass the bring-up port 41, clogging of the bring-up port 41 can be prevented, and stress to the developer can be reduced.

Figure 59:
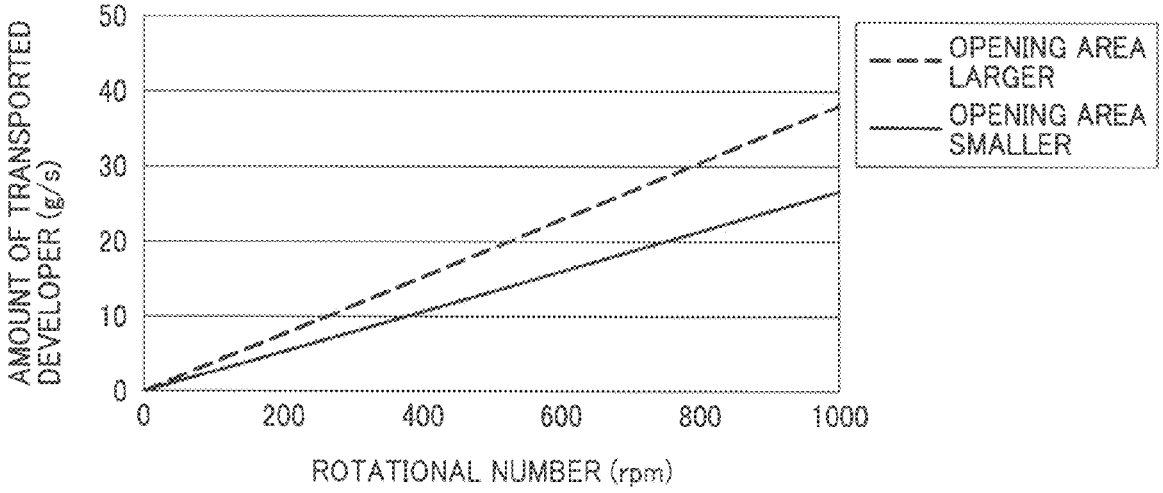
FIG. 59 is a graph illustrating the relation between the opening area of the bring-up port and the amount of transported developer.

FIG. 59 is a graph illustrating the relation between the opening area of the bring-up port 41 and the amount of transported developer.

In FIG. 59, the graph of "OPENING AREA SMALLER" is when the opening area of the bring-up port 41 is 90% of the cross section of the screw, and the graph of "OPENING AREA LARGER" is when the opening area of the bring-up port 41 is 220% of the cross section of the screw.

As shown in FIG. 59, even when the rotational number (transport force of the circulation screw 40) is identical, the mount of transported developer is larger when the opening area of the bring-up port 41 is larger. In other words, even when the pressure of the developer in the bring-up portion 41*a* is smaller, the amount of transported developer can be increased to a required amount by increasing the opening area of the bring-up port 41. Therefore, clogging of the developer in the bring-up portion 41*a* and the upstream portion 41*b* can be inhibited.

Dispersion of toner around the upstream end portion 38*a* in the circulation path 38 is described below.

The amount of developer contained in the casing 33 is smaller in the present embodiment than in typical development devices because the development device 3 according to the present embodiment is relatively compact. An enhanced ability to disperse toner is required when the amount of developer is thus smaller.

Table 3 shows specifications of development devices A and B whose capacity of containing developer in the development containing part is different. The development devices A and B consume an identical amount of toner when the number of output sheets per unit time is identical.

TABLE 3

| | Development device A | Development device B |
|---|---|---|
| Capacity of developer in developer containing part | 90 g | 270 g |
| Toner concentration | 8% | 8% |
| Amount of toner in developer containing part | 7.2% | 21.6% |
| Toner consumption | 0.44 g | 0.44 g |
| Ratio of toner consumption to amount of toner in developer containing part | 6.10 g | 2.04 g |

It is to be noted that in the table 3, the toner concentration is the amount of toner divided by the amount of developer, and the toner consumptions is the amount of toner consumed when A4-size solid images are recorded on sheets.

Referring to the table 3, the total amounts of developer contained in the development containing parts of the development devices A and B are 90 g and 270 g, respectively. Although the development devices A and B consume an identical amount of toner to form an identical image when the number of output sheets per unit time is identical, the ratio of toner consumption to the total amount of toner in the development containing part is different between the development devices A and B. For example, to form A4 full-size solid images, the ratio of toner consumption to the total amount of toner in the development containing part is 6% in the development device A and 2% in the development device B.

After images are output, the identical amount of toner to the toner consumption should be supplied to the developer containing part for subsequent image formation. Therefore, the amounts of toner supplied to the development devices A and B are respectively equivalent to 6% and 2% of the total amount of toner in the development containing part. Because the ratio of the amount of supplied toner to the total amount of toner is greater in the development device A than in the development device B, the development device A should have a higher ability to disperse the supplied toner in the developer.

Increasing the ability to disperse supplied toner in developer in the relatively compact development devise 3 is described below.

In the present embodiment, the toner supply position T is disposed in the upstream end portion 38*a* in the circulation path 38 as shown in FIG. 51. It is to be noted that, alternatively, the toner supply position may be disposed in a downstream end portion of the supply path 37, downstream from the position where the developer is supplied to the downstream end of the development sleeve 34*a* in the developer transport direction in the supply path 38.

To enhance the ability to disperse the supplied toner into the developer, the following processes (c), (d), and (e) should be performed.

(c) Dispersing the supplied toner in the longitudinal direction of the development sleeve 34*a*.

(d) Merging the dispersed toner into the developer.

(e) Bring the toner into contact with carrier particles to charge the toner electrically.

The process (c) should be performed around the upstream end portion 38*a* shown in FIG. 51 in the circulation path 38.

Figure 60:
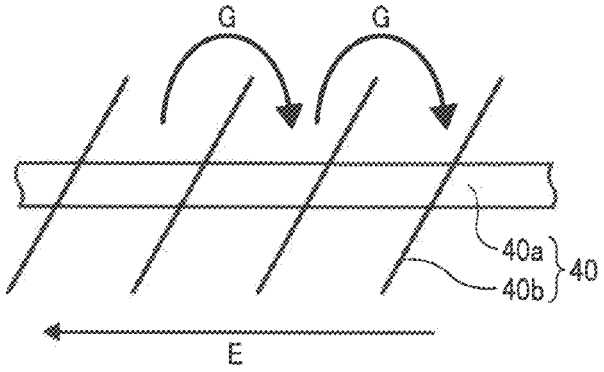
FIG. 60 illustrates a configuration to increase dispersibility of toner.

To perform the process (c) while the circulation screw 40 transports the developer, the toner should overstride the bladed screw spiral 40*b* as indicated by arrows G in FIG. 60. It is to be noted that, although FIG. 60 illustrates movement of toner overriding the screw spiral 40*b* in the direction opposite the develop transport direction indicated by arrow E shown in FIG. 60, this does not means that the toner moves in the direction opposite the develop transport direction. FIG. 60 means that, although a certain amount of toner is transported at a velocity identical to the transport velocity of the developer, a certain amount of toner is delayed for the distance equivalent to the pitch or pitches of the screw spiral 40*b*, dropping astern the screw spiral 40*b*.

Not only the supplied toner, but also a certain amount of developer is delayed, dropping astern the pitch of the screw spiral 40*b*. Consequently, the transport velocity of the developer is slowed around the upstream end portion 38*a* in the circulation path 38.

Figure 61:
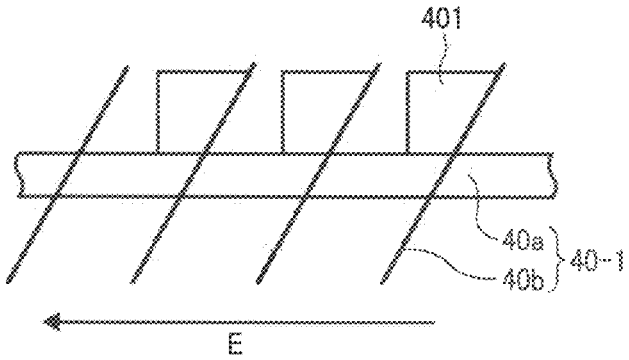
FIG. 61 illustrates a circulation screw provided with paddles.

FIG. 61 illustrates a configuration to enhance dispersibility of the supplied toner.

A circulation screw 40-1 shown in FIG. 61 includes paddles 401 provided in the pitches of the screw spiral 40*b*. The paddles 401 can flick the developer, which is transported by the circulation screw 40-1 in the axial direction, in the direction perpendicular to the axial direction. The velocity of developer flicked by the paddles 401 in the axial direction is substantially zero, and the circulation screw 40-1 rotates while the paddles 401 flick the developer. Therefore, when the flicked developer returns, the developer is delayed for a distance equivalent to the pitch of the screw spiral 40*b*. Based on the above-described theory, the supplied toner can be dispersed in the longitudinal direction. It is to be noted that providing the paddles 401 can decrease the transport velocity (e.g., transport ability of the circulation screw) in the axial direction. Therefore, enhancing the dispersibility around the upstream end portion 38*a* as well as slowing the transport velocity in that portion can be attained by providing the paddles 401 in the portion corresponding to the vicinity of the upstream end portion 38*a*.

It is to be noted that, when the paddles 401 extending in the direction of the screw shaft 40*a* are provided between the pitches of the screw spiral 40*b* as shown in FIG. 61, the length of the paddle 401 in the axial direction per unit length in the screw shaft may be increased toward upstream in the transport direction of the circulation screw 40 because the decrease in the developer transport ability as well as the increase in the dispersibility are more significant as the size of the paddle increases. More specifically, when the pitch of the screw spiral 40*b* is constant or substantially constant in the portion where the paddles 401 are provided, the length of each paddle 401 in the axial direction is increased toward upstream in the transport direction of the circulation screw 40. By contrast, when the pitch of the screw spiral 40*b* is not constant in the portion where the paddles 401 are provided, the length of the paddle(s) 401 in a given length in the axial direction is increased toward upstream in the transport direction of the circulation screw 40.

Alternatively, to enhance the dispersibility of the supplied toner, a screw, such as the screw 80 shown in FIG. 43, whose lead angle is greater may be used.

As described above with reference to FIG. 43, when the lead angle of the screw is greater, that is, the screw spiral 80*b* is more horizontal relative to the screw shaft 80*b*, upward force applied to the developer can be increased, that is, the developer can overstride the screw spiral 80*b* more easily. As a result, dispersibility of toner in the longitudinal direction can be enhanced. Further, as shown in FIG. 40, when the lead angle is greater than 45°, the greater the lead angle, the lower transport velocity is.

Therefore, in the present embodiment, the lead angle of the circulation screw 40 is set to an angle about 65° in the portion corresponding to the upstream end portion 38*a*, decreases toward downstream in the developer transport direction, and is set to an angle of about 45° in the vicinity of the downstream end in the circulation path 38 in the developer transport direction described in the eighth embodiment.

Figure 62:
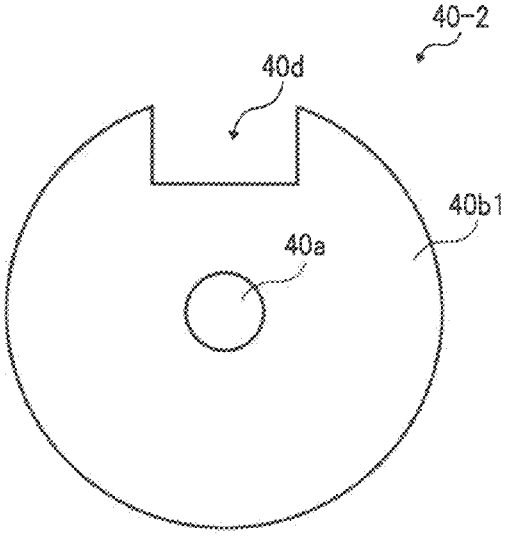
FIG. 62 illustrates a configuration of the circulation screw in which a bladed spiral is partly cut off.
Figure 63:
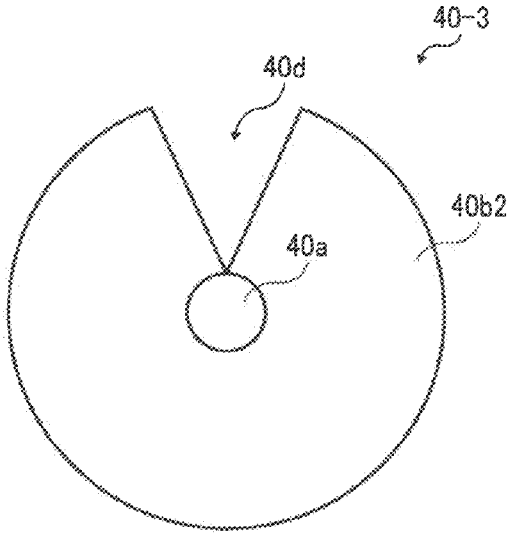
FIG. 63 illustrates another configuration of the circulation screw in which a bladed spiral is partly cut off.

It is to be noted that, alternatively, to enhance the dispersibility of the supplied toner, a circulation screw 40-2 shown in FIG. 62 in which a part of a screw spiral 40*b*1 is cut off, forming a cutout 40*d*, may be used. Since the supplied toner moves in an upper portion, that is, vicinity of surface 32*f* (shown in FIG. 51), of the developer layer in the development device 3, also the circulation screw 40-2 shown in FIG. 62 can delay the developer as described above with reference to FIG. 60. To slow the transport velocity of developer further from the velocity attained by the configuration shown in FIG. 62, a circulation screw 40-3 shown in FIG. 63 may be used. In the circulation screw 40-3, a part of a screw spiral 40*b*2 is cut off to an extent that a cutout 40*d*1 extends to a center portion of the screw spiral 40*b*2.

It is to be noted that, when the cutout 40*d* is formed in a portion of the screw spiral 40*b* downstream from the upstream end portion 38*a* of the circulation path 38 in the developer transport direction in addition to the upstream end portion 38*a*, the area of the cutout 40*d* in the upstream end portion 38*a* may be larger than that in the portion downstream from the upstream end portion 38*a* because the decrease in the developer transport ability as well as the increase in the dispersibility are more significant as the size of the paddle increases. Alternatively, the cutout 40*d* may be formed only in a portion of the screw spiral 40*b* in the upstream end portion 38*a* in the transport direction of the circulation screw 40.

Thus, the development device 3 according to the present embodiment should have such a configuration that the transport velocity can be slowed around the upstream end portion 38*a* while the supplied toner can be dispersed in the longitudinal direction.

Figure 64:
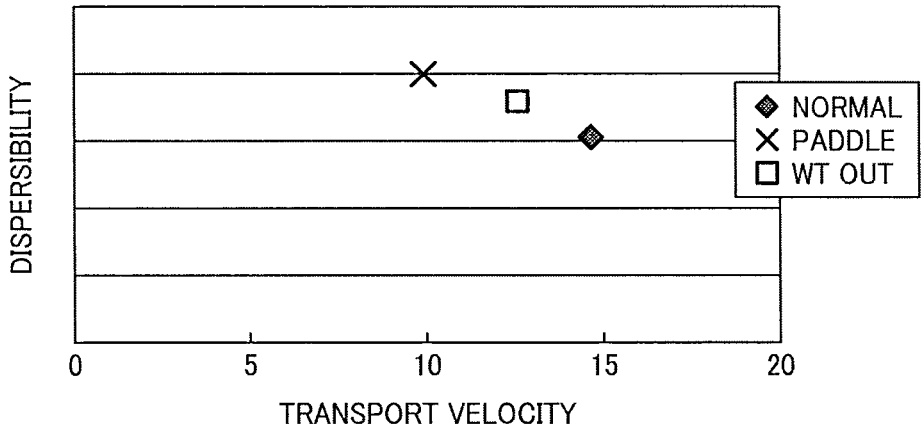
FIG. 64 is a graph illustrating toner dispersibility of various circulation screws whose shapes are different.

FIG. 64 is a graph in which the toner dispersibility and the transport velocity are compared among the circulation screw 40 shown in FIG. 60, for example, the circulation screw 40-1 with paddles 401 shown in FIG. 61, and the circulation screw 40-2 shown in FIG. 62. In FIG. 64, the circulation screws 40, 40-1, and 40-2 are represented by "NORMAL", "PADDLE", and "WT OUT", respectively.

All three types of the circulation screws used to obtain the graph shown in FIG. 64 have a lead angle of 35.5°, and the configurations thereof (e.g., diameter, pitch, and rotational number, etc.) are similar except the paddles 401 and the cutout 40*d*. As shown in the graph shown in FIG. 64, when the paddles are provided or the cutout is formed in the screw spiral, the transport velocity is slowed, and simultaneously dispersibility of toner is enhanced. The dispersibility of supplied toner means the degree by which the supplied toner is dispersed while the developer moves a unit distance in the axial direction of the screw.

As described above, in the present embodiment, because the fresh toner is supplied to the upstream end portion 38*a* in the circulation path 38 in the developer transport direction as shown in FIG. 51, the supplied toner tends to coagulate in the upstream end portion 38*a*. Because, initially, the coagulated toner should be loosened to agitate such coagulated toner while transporting, the toner should be better dispersed in the upstream end portion 38*a* than in the downstream end portion 38*b* in the developer transport direction in the circulation path 38. Thus, it is preferable to provide the paddles 401, cutout 40*d*, or the like on the upstream end portion of the circulation screw 40 in the developer transport direction. Additionally, it is preferable that the lead angle of the circulation screw 40 be increase toward upstream in the developer transport direction to increase the dispersibility of the toner as described above.

Next, above-described (d), merging the dispersed toner into the developer, is described below.

Figure 65:
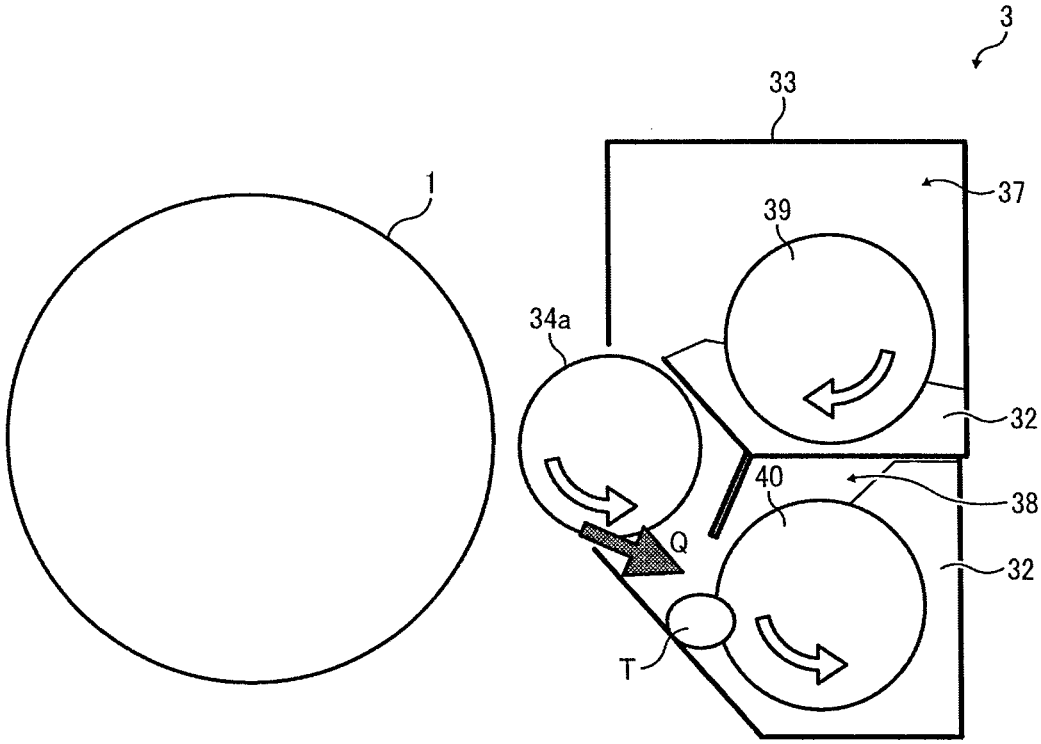
FIG. 65 is a cross-sectional diagram illustrating an upstream end portion of the circulation path in the developer transport direction.

FIG. 65 schematically illustrates a state of supplied toner T and the developer 32 around the upstream end portion 38*a* of the circulation path 38.

As indicated by arrow Q shown in FIG. 65, the developer 32 that has left the development sleeve 34*a* is collected in the circulation path 38. The developer 32 that has left the development sleeve 34*a* falls onto the supplied toner T, which moves in the upper portion of the developer layer in the circulation path. Flowing down the developer that has left the development sleeve 34*a* onto the supplied toner T can facilitate mixing the supplied toner T with the developer 32 in the circulation path 38.

The above-described process (e), bring the toner into contact with carrier particles, can be performed in the bring-up portion 41*a*. With the configuration described regarding the processes (c) and (d), the toner supplied to the casing 33 is dispersed in the developer contained in the circulation path 38. In the bring-up portion 41*a*, the pressure of the developer is increased to bring the developer upward, and this increased pressure of developer can increase the number of contact between the toner and carrier particles. Therefore, in the configuration of the development device 3 according to the present embodiment, the supplied toner can be dispersed in the developer sufficiently even when the development device 3 is relatively contact, which means that the capacity of the casing 33 to contain the developer is smaller.

Next, increasing the amount of developer on the upstream side in the circulation path 38 as well as on the downstream side in the supply path 37 is described below.

When the amount of developer moving in and the amount of developer moving out of a given area in the developer transport path per unit time are set, the amount of developer present in that area can be increased, that is, the surface of the developer layer in that area can be raised, by slowing the transport velocity of the developer in that area.

Therefore, the amount of developer on the upstream side in the circulation path 38 as well as that on the downstream side in the supply path 37 can be increased by slowing the transport velocity of the developer in those areas. Following effects (f) and (g) are available by increasing the amount of developer on the upstream side in the circulation path 38 as well as that on the downstream side in the supply path 37. Thus, by slowing the transport velocity of the developer in the circulation path 38 toward upstream in the circulation path 38 in the developer transport direction, and similarly, by increasing the transport velocity of the developer in the supply path 37 toward upstream in the supply path 37 in the developer transport direction, the surface of the developer can be uniform in the circulation path 38 and supply path 37, respectively.

(f) Expanding the life of the developer in the development device.

(g) Reducing fluctuations in the toner concentration in the developer in the development device caused by consumption and supply of toner.

Regarding the above-described effect (f), the life of the developer can be expanded by reducing the stress given to the developer around the developer regulator 35 even when the development device 3 is relatively compact as described in the first embodiment. Further, since the life of the developer is proportional to the amount of the developer in the development device 3, increasing the developer capacity of the casing 33 (e.g., developer containing part) can expand the life of the developer accordingly.

Figure 66:
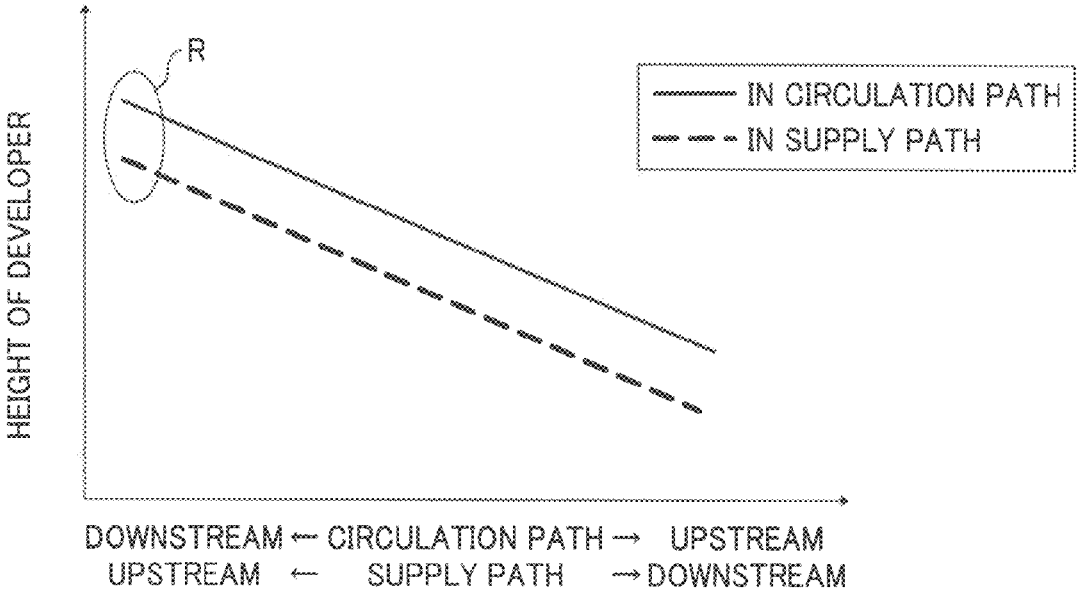
FIG. 66 is a graph illustrating the amount of developer at respective positions in the developer transport direction in the developer transport path when the transport velocity of the developer is constant across the entire developer transport path.

FIG. 66 illustrates the amount (height) of developer at respective positions in the developer transport direction in the supply path 37 and the circulation path 38 when the transport velocity of the developer is constant across the entire supply path 37 and the entire circulation path 38.

In FIG. 66, a vertical axis represents the amount (height) of developer and a horizontal axis represents the position in the supply path 37 and the circulation path 38 in the developer transport direction.

The graph shown in FIG. 66 is obtained when the lead angle of both the supply screw 39 and the circulation screw 40 is 45° and the configurations thereof are uniform. In this case, the surface 32*f* of the developer is oblique in the longitudinal direction as shown in FIG. 51.

It is to be noted that, because the developer is transported in the opposite directions in the supply path 37 and the circulation path 38, the right side in the graph of FIG. 66 is the downstream side in the supply path 37 and the upstream side in the circulation path 38.

Figure 67:
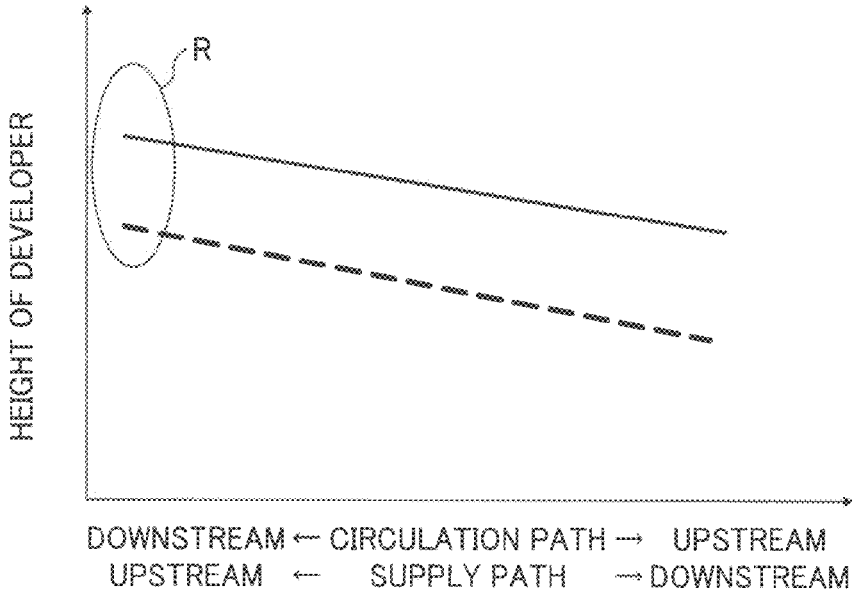
FIG. 67 is a graph illustrating the amount of developer at respective positions in the developer transport direction in the developer transport path when the transport velocity of the developer is varied depending on the position in the developer transport direction.

FIG. 67 illustrates the amount (height) of developer at respective positions in the developer transport direction in the supply path 37 and the circulation path 38 when the transport velocity of the developer is varied depending on the position in the developer transport direction therein.

More specifically, the lead angle of the circulation screw 40 is set to an angle of about 45° in the portion corresponding to the downstream end portion 38*b*, gradually increases toward upstream in the developer transport direction, and is set to an angle about 65° in the portion corresponding to the upstream end portion 38*a*. Similarly, the lead angle of the circulation screw 39 is set to an angle of about 45° in the portion corresponding to the upstream end portion 37*a*, gradually increases toward downstream in the developer transport direction, and is set to an angle about 65° in the portion corresponding to the downstream end portion 37*b*.

When the graphs shown in FIGS. 66 and 67 are compared, the amount of developer in a circle R, that is, the upstream end portion in the supply path 37 as well as the downstream end portion in the circulation path 38, is identical or similar in FIGS. 66 and 67 due to the conditions to send the developer from the circulation path 38 to the supply path 37 without leakage of developer or carrying over of developer. By contrast, the amount of developer in the downstream end portion in the supply path 37 as well as the upstream end portion in the circulation path 38 is larger in FIG. 67 than in FIG. 66.

By changing the configuration of the development device 3 from that described with reference to FIG. 66 to that described with reference to FIG. 67, the developer capacity of the casing 33 can be increased from 70 g to 90 g, and accordingly the life of the developer can be expanded by 30 percent. Further, the ratio of toner consumption to the total amount of toner in the development containing part when A4 full-size solid images are output can be reduced from 7.9 percent to 6.1 percent. Thus, even when the development device 3 is relatively compact, fluctuations in the toner concentration in the developer therein caused by consumption and supply of toner can be reduced, and accordingly fluctuations in image density can be reduced.

It is to be noted that the configuration of the developer transport paths in the development device 3 according to the eight through tenth embodiments is suitable for relatively compact development devices using a three-pole magnet roller and a development sleeve having a relatively small diameter as in the first through seventh embodiments. However, the configuration of the developer transport paths according to the eight through tenth embodiments is also applicable to development devices in which the number of magnetic poles each generating a magnetic field sufficient to carry the developer on the development sleeve is more than four as in the comparative example 2 shown in FIG. 11 in which the number of such magnetic poles is five. In other words, the configuration of the developer transport paths according to the eight through tenth embodiments is also applicable to development devises including the supply path and the circulation path disposed beneath the supply path. More specifically, in the supply path, the developer is supplied onto the development sleeve while transported in the axial direction of the development sleeve. The circulation path receives the developer from the downstream end portion of the supply path in the developer transport direction, and the developer is collected from the development sleeve in the circulation path while transported in the axial direction of the development sleeve in the opposite direction to the developer transport direction in the supply path. Then, the developer reached the downstream end portion of the circulation path is sent to the upstream end portion of the supply path in the developer transport direction.

It is to be noted that, in the above-described various embodiments, it is preferable that the amount of developer is set so that, when the circulation screw 40 is stopped, the surface 32*f* (shown in FIG. 51) of the developer layer in the circulation path 38 is lower than the horizontal axis 34*h* (shown in FIG. 8) extending horizontally from the center of rotation 34*p* (shown in FIG. 8) in the area of the circulation path 38 where the development sleeve 34*a* overlaps in the axial direction. In this configuration, carrying over of developer can be reduced due to the development sleeve 34*a* and the weight of developer itself.

Eleventh Embodiment

Next, a feature of agitating the developer upstream from the developer regulator 35 in the rotation direction of the development sleeve 34*a*, which is applicable to the development device 3 according to the first through tenth embodiments, is described below as an eleventh embodiment.

Figure 68:
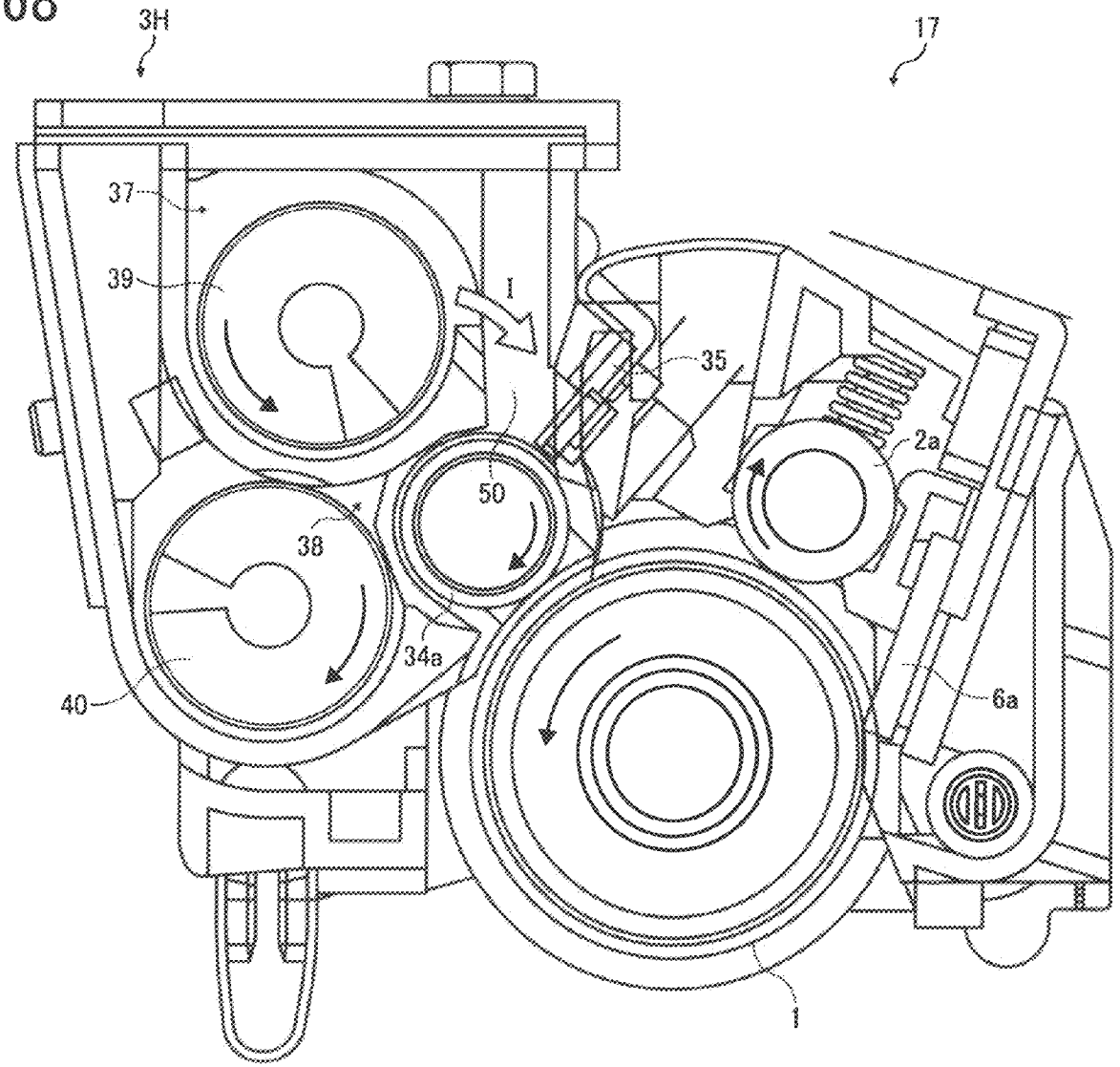
FIG. 68 illustrates a cross section of an image forming unit that is a process cartridge to which an eleventh embodiment is applicable.

FIG. 68 illustrates a cross section of the image forming unit 17 that is a process cartridge to which the eleventh embodiment is applicable.

As shown in FIG. 68, a development device 3H, a charging roller 2*a* of the charger 2 (shown in FIG. 1), and a cleaning blade 6*a* of the cleaner 6 (shown in FIG. 1) are provided around the photoconductor 1. The charging roller 2*a* is disposed contacting the photoconductor 1 or across a gap from the photoconductor 1. Alternatively, a brush or a scorotron charging member may be employed instead of the charging roller 2*a*.

Figure 69:
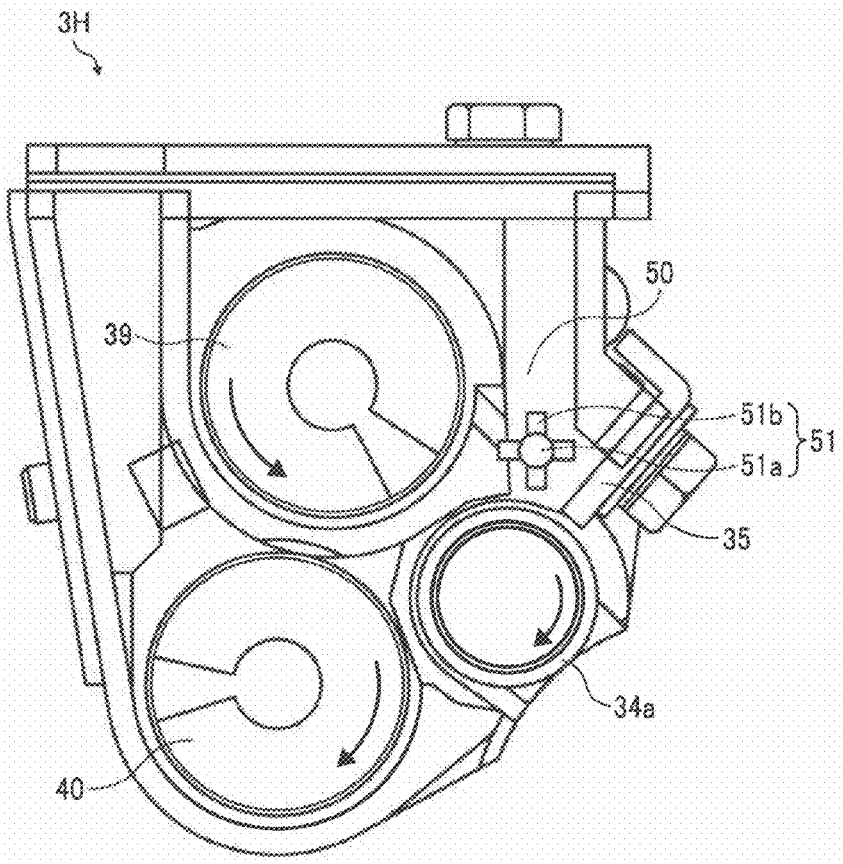
FIG. 69 is a cross-sectional diagram illustrates a configuration of a development device including a paddle as an agitation member.

The development device 3H has a similar configuration to that of the first through eleventh embodiments except that a paddle 51 shown in FIG. 69 is provided. That is, the paddle 51 is applicable to any of the first through eleventh embodiments.

Also in the present embodiment, the developer is poured from the supply path 37 down to the surface of development sleeve 34*a* under gravity as indicated by arrow I shown in FIG. 68. Therefore, even when the magnetic force of the pre-development pole N2 that contributes to attracting the developer and adjusting the amount of the developer is weaker, attracting developer to the development sleeve 34*a* and adjusting the amount of developer can be performed reliably. Additionally, to reduce stress to the developer, the magnetic force of the magnet forming the pre-development pole N2 is weaker compared to that of magnets typically used to form the developer regulation pole for adjusting the amount of developer. Therefore, the magnetic force of the magnetic field that affects the developer within a buffer area 50 that is an area upstream from the developer regulator 35 in the rotational direction of the development sleeve 34*a* is weaker, and thus the developer is kept softly in the buffer area 50.

The developer supplied from the supply path 37 by the supply screw 39 to the buffer area 50 may be wavy due to the pitch of the supply screw 39, making the amount of the supplied developer uneven. If the magnetic force of the developer regulation pole is as strong as that in typical development devices, a certain degree of pressure is applied to the developer in the buffer area, and the pressure equalizes the amount of the supplied developer.

Additionally, the developer may include loosely coagulated toner particles and/or carrier particles. If such coagulations clog the regulation gap, image failure in which toner is partly absent creating while lines or the like occur. If the pressure given to the developer in the buffer area is relatively strong, the pressure can dissolve such loose coagulations, thus preventing clogging of the regulation gap.

However, in the present embodiment, because the magnetic force of the magnetic field affecting the developer in the buffer area 50 is weaker, the pressure applied to the developer in the buffer area 50 is weaker, and accordingly the agitation effect of the magnetic force is lower. Therefore, if the amount of developer supplied by the supply screw 39 is wavy due to the pitch of the supply screw 39, the magnetic force is insufficient to eliminate unevenness in the amount of developer carried on the development sleeve 34*a*, resulting in unevenness in image density.

Further, if a certain amount of toner particles and/or carrier particles coagulates in the developer, such coagulation might clog the regulation gap, producing substandard images including white lines.

Figure 70:
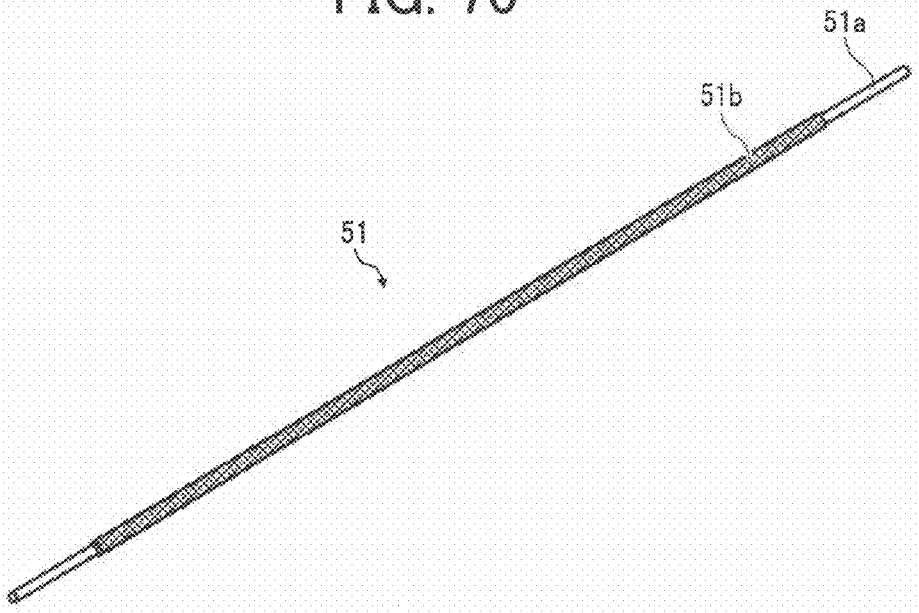
FIG. 70 is a perspective view of the paddle shown in FIG. 69.

To prevent this inconvenience, the development device 3H according to the present embodiment includes the paddle 51 serving as an agitation member as shown in FIG. 69. FIG. 70 is a perspective view of the paddle 51.

Referring to FIG. 69, blades 51*b* of the paddle 51 can rotate or swing around a rotation shaft 51*a*, thereby agitating the developer in the buffer area 50. Thus, unevenness in the amount of the supplied developer caused by the pitch of the supply screw 39 can be eliminated, and accordingly image density can be uniform. Even when toner particles and/or carrier particles in the developer coagulate, the paddle 51 can dissolve such coagulations, preventing clogging of the regulation gap. Consequently, substandard images including white lines can be prevented or reduced.

It is to be noted that the shape of the paddle 51 is not limited to that shown in FIG. 69. For example, the number of the blades 51*b* is not limited to four. The shape of the blades 51*b* may be continuous in the longitudinal direction of the paddle 51 as shown in FIG. 70 or may be fragmentary, alternatively.

Figure 71A:
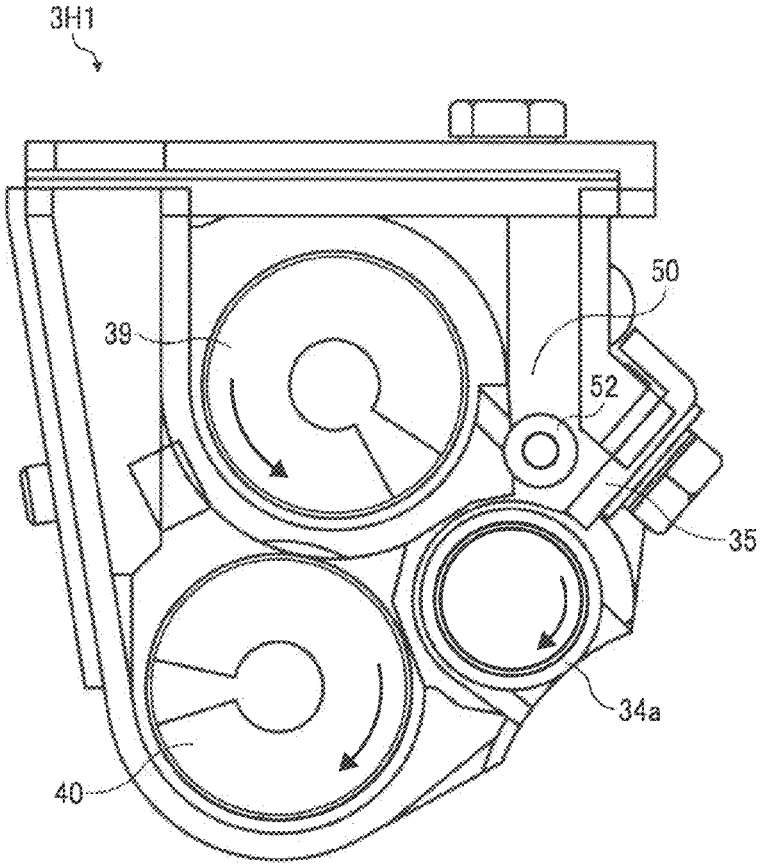
FIG. 71A is a cross-sectional diagram illustrates a configuration of a development device including a roller member as an agitation member.
Figure 71B:
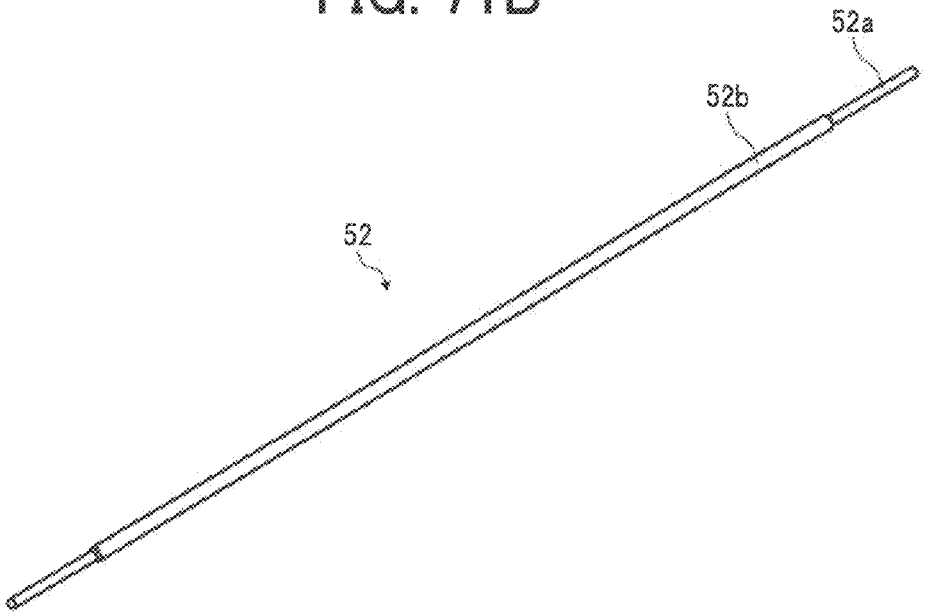
FIG. 71B is a perspective view of the roller member shown in FIG. 71A.

FIGS. 71A and 71B illustrates a configuration of a development device 3H1 using a roller member 52 as an agitation member instead of the paddle 51 as a variation of the eleventh embodiment. FIG. 71A is a cross-sectional view of the development device 3H1, and FIG. 71B is a perspective view of the roller member 52. Referring to FIGS. 71A and 71B, also when the roller member 52 is used instead of the paddle 51, by rotating or swinging a roller 52*b* around a rotation shaft 52*a*, the developer in the buffer area 50 can be agitated. Additionally, even when the developer coagulates, the roller member 52 can dissolve such coagulations.

It is to be noted that the material of the roller 52*b* is not limited to a specific material. For example, a metal roller or a sponge roller may be used as the roller 52*b*.

Figure 72A:
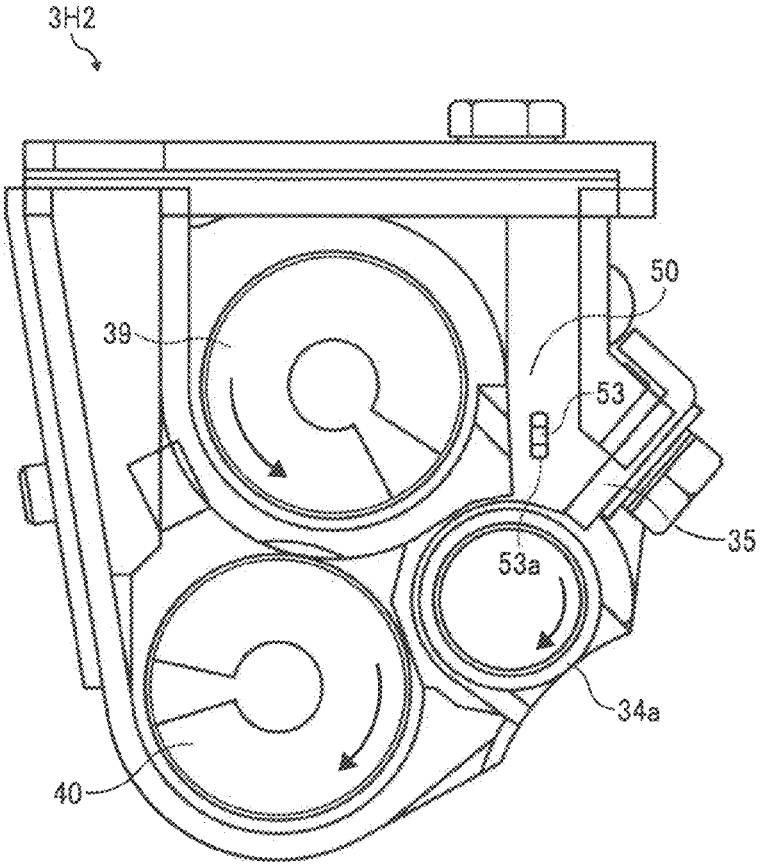
FIG. 72A is a cross-sectional diagram illustrates a configuration of a development device including a wire member as an agitation member.
Figure 72B:
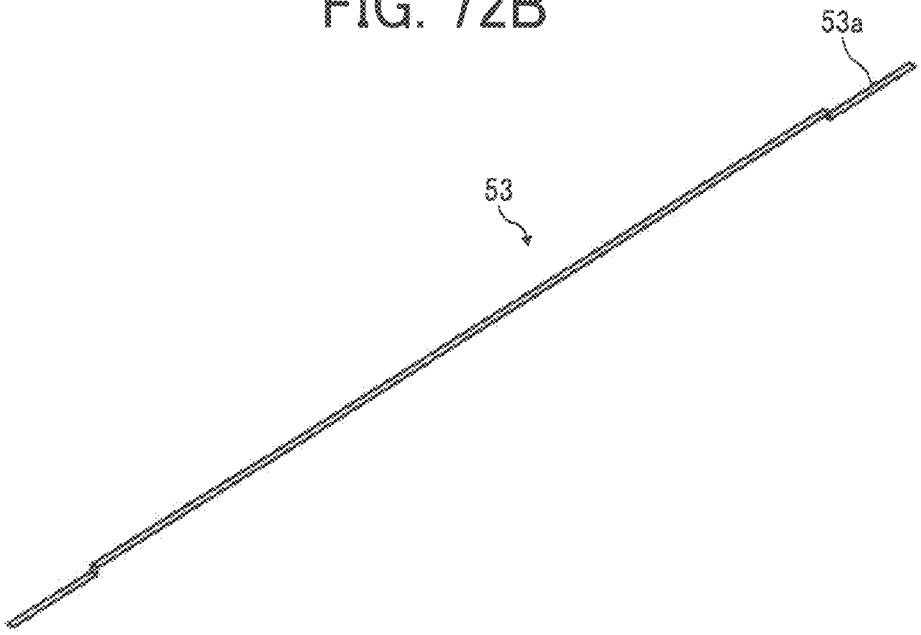
FIG. 72B is a perspective view of the wire member shown in FIG. 72A.

FIGS. 72A and 72B illustrate a configuration of a development device 3H2 using a wire member 53 as an agitation member according to another variation of the eleventh embodiment. FIG. 72A is a cross-sectional view of the development device 3H2, and FIG. 72B is a perspective view of the wire member 53.

Similarly, by rotating or swinging the wire member 53 around a rotation shaft 53*a*, the developer in the buffer area 50 can be agitated. Additionally, even when the developer includes coagulations, the wire member 53 can dissolve such coagulations.

Thus, in the eleventh embodiment and variations thereof, even when the supply screw 39 supplies the developer unevenly (including the case in which in developer supply is uneven in the longitudinal direction), the above-described agitation member can equalize the developer and loose coagulations of the developer in the buffer area 50. Therefore, the developer can be uniform upstream from the regulation gap, and a constant amount of developer can be supplied onto the development sleeve 34*a*. Therefore, unevenness in image density and image failure can be prevented or reduced.

It is to be noted that, although the developer regulator 35 is disposed above the development sleeve 34*a* in the above-described various embodiments, the developer regulator 35 can be disposed beneath the development sleeve 34*a* when the agitation member is provided as in the eleventh embodiment.

Twelfth Embodiment

A twelfth embodiment regarding a configuration of the development sleeve is described below. The feature of the twelfth embodiment is applicable to the development device 3 according to any one of the above-described first through eleventh embodiments.

If developer is brought up onto the development sleeve from beneath, the surface of the development sleeve should be rough to a such a degree that the developer can be kept thereon also mechanically. In such cases, surface treatment such as blast finishing of the development sleeve is necessary.

By contrast, the configuration in which the developer flows down onto the development sleeve 34*a*, as indicated by arrow I shown in FIG. 68, does not require a force to transport the developer upward.

Therefore, the development sleeve 34*a* of the present embodiment has a surface roughness Rz within a range from 1 μm to 8 μm, for example, because this range of surface roughness is sufficient for carrying the developer on the surface of the development sleeve 34*a*. The surface roughness Rz within a range from 1 μm to 8 μm can be attained by standard turning and may be attained by processing, such as aluminum extrusion, that does not include removal processing. The surface of the development sleeve 34*a* of the present embodiment may be attained through standard cutting without removal processing. It is to be noted that removal processing herein means processing to produce concavities on the surface, and the development sleeve 34*a* in the present embodiment does not require such surface processing. Standard cutting herein means cutting processing that is performed to make the diameter of the sleeve to a predetermined diameter when blast processing is not performed.

Therefore, manufacture of the development sleeve 34*a* can be simpler and easier, and accordingly the cost is lower.

In particular, when the diameter of the development sleeve is smaller (e.g., 10 mm) and the surface of the development sleeve should be treated to be able to bring up the developer from beneath, the cost of surface treatment is higher. By contrast, in the present embodiment, although the development sleeve 34*a* has a relatively small diameter, the surface of the development sleeve can be relatively smooth because the development sleeve does not require the force to bring up the developer. Thus, the processing cost of the development sleeve 34*a* can be reduced.

It is to be noted that, typical turning can attain a surface roughness of about 0.8 μm, and aluminum extrusion can attain a surface roughness of about 3.2 μm.

Additionally, wear of the development sleeve 34*a* can be slower when the surface is relatively smooth, thus expanding the operational life. Additionally, compared with typical development sleeves on which grooves are formed, developer particles can stand on end thereon more uniformly on the surface of the development sleeve 34*a*, and accordingly development efficiency can be higher.

Thirteenth Embodiment

A thirteenth embodiment regarding a driving gear to drive the development sleeve is described below. The feature of the thirteenth embodiment is applicable to the development device 3 according to any one of the above-described first through twelfth embodiments.

Figure 73:
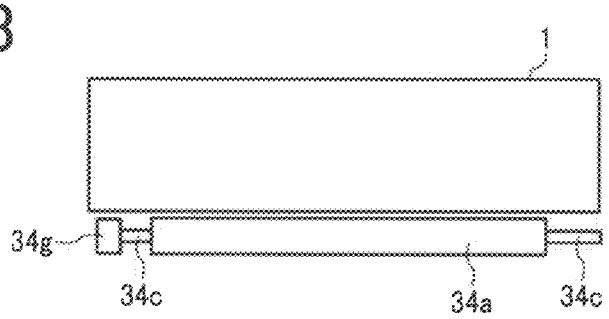
FIG. 73 schematically illustrates relative positions of a photoconductor, a development sleeve, and a development gear in an illustrative embodiment.

FIG. 73 schematically illustrates relative positions of the photoconductor 1, the development sleeve 34*a*, and a development gear 34*g* to transmit a driving force to the development sleeve 34*a*.

Figure 74:
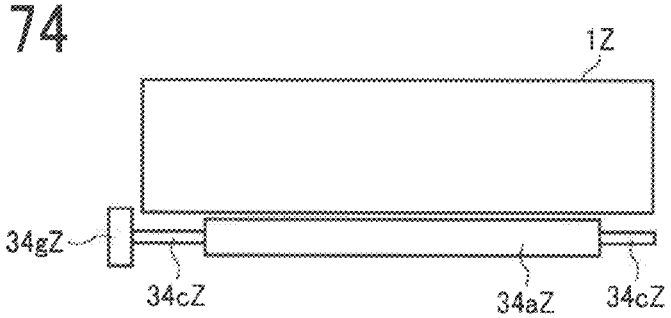
FIG. 74 schematically illustrates relative positions of a photoconductor, a development sleeve, and a development gear in a comparative example.

FIG. 74 schematically illustrates relative positions of a photoconductor 1Z, a development sleeve 34*a*Z, and a development gear 34*g*Z in a comparative development device.

When the module of the development gear 34*g*Z is larger or the number of its tooth is greater as in the comparative example shown in FIG. 74, the development gear 34*g*Z has an external diameter larger than that of the development sleeve 34*a*Z. Therefore, the development gear 34*g*Z cannot be disposed within an area facing the photoconductor 1Z in the longitudinal direction, thus increasing the size of the comparative development device.

By contrast, in the present embodiment, the external diameter of the development gear 34*g* is smaller than that of the development sleeve 34*a* and can be disposed within an area facing the photoconductor 1 in the longitudinal direction without interfering with the photoconductor 1, thus decreasing the size of the development device 3 in the longitudinal direction.

An example of a spur gear applicable to the development device 3 of the present embodiment is described below.

A diameter dk of the addendum circle of the spur gear can be obtained by the formula A9.

$$dk=do+2\cdot m \tag{A9}$$

wherein do represents a pitch diameter (z·m), m represents a module, and z represents the number of tooth.

When the external diameter of the development sleeve is 10 mm and the number of tooth as undercut limit is 17, from the formula A9, the diameter dk of the addendum circle can be 10 mm or less when the following condition is satisfied.

$$10=17\cdot m+2\cdot m$$

$$m=0.53$$

Therefore, the module should be 0.5 mm.

Although reducing the size of the module can increase the number of tooth, the strength of the gear decreases as the module becomes smaller. Accordingly, the gear might fail to transmit the driving force to the development sleeve 34*a* if the gear is extremely small. However, in the present embodiment, the load to the development sleeve 34*a* is reduced in the developer regulation portion, which faces the developer regulator 35, and accordingly the rotational torque of the development sleeve 34*a* is smaller. Consequently, the size of the module can be as small as 0.5 mm, for example.

Thus, the development gear 34*g* can have an external diameter smaller than that of the development sleeve 34*a*, thus compactness of the development device 3 can be attained.

Fourteenth Embodiment

A fourteenth embodiment regarding a preset seal is described below. The feature of the fourteenth embodiment is applicable to the development device 3 according to any one of the above-described first through thirteenth embodiments.

When development devices are shipped from factory, it is preferable that the developer is preliminarily set in the developer containing part thereof. Therefore, the development device 3 according to the present embodiment is provided with a preset seal to prevent leakage of developer from the casing 33 (developer containing part) during transportation.

Figure 75:
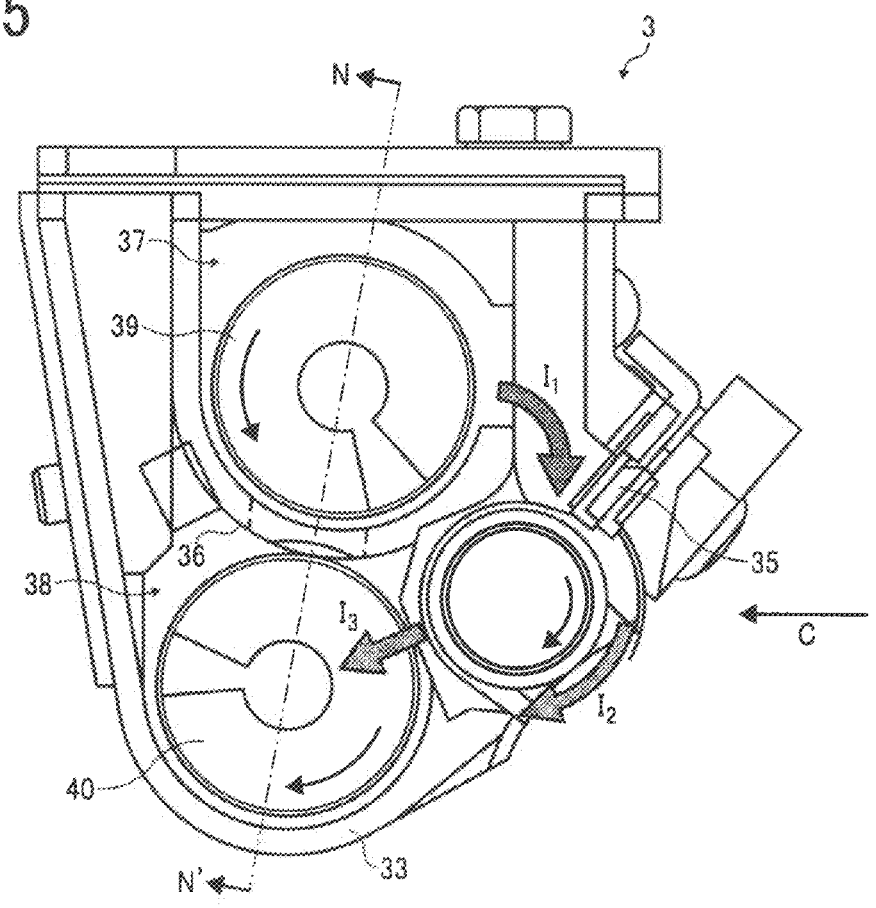
FIG. 75 illustrates flow of the developer on a cross section of the development device perpendicular to an axial direction.
Figure 76:
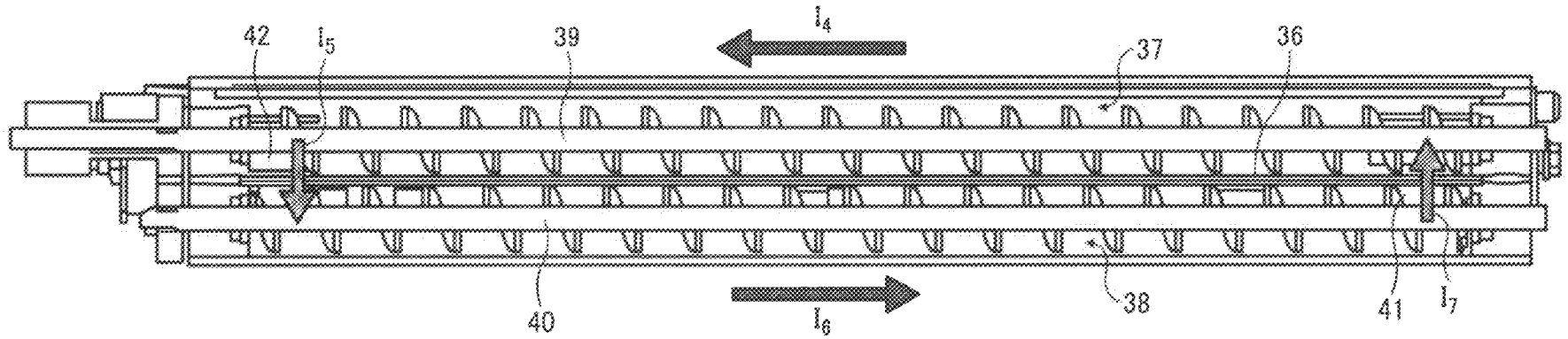
FIG. 76 illustrates an N-N' cross section of the development device shown in FIG. 75.

FIGS. 75 and 76 are cross sectional views illustrate flow of the developer inside the development device 3. FIG. 75 illustrates a cross section of the development device 3 in the direction perpendicular to the axial direction of the development device 3, and FIG. 76 is an N-N' cross section of the development device 3 viewed from the direction indicated by arrow C shown in FIG. 75.

It is to be noted that reference characters $I_1$ through $I_7$ represent the flow of the developer.

In a short side direction of the development device 3 perpendicular to its longitudinal direction, as shown in FIG. 75, the developer is circulated through the supply path 37, the surface of the development sleeve 34*a*, and the circulation path 38 in that order.

By contrast, in the longitudinal direction (axial direction of the development sleeve 34*a*), the developer is circulated from the circulation path 38 through the bring-up port 41, the supply path 37, and the falling port 42 again to the circulation path 38 in that order.

Figure 77A:
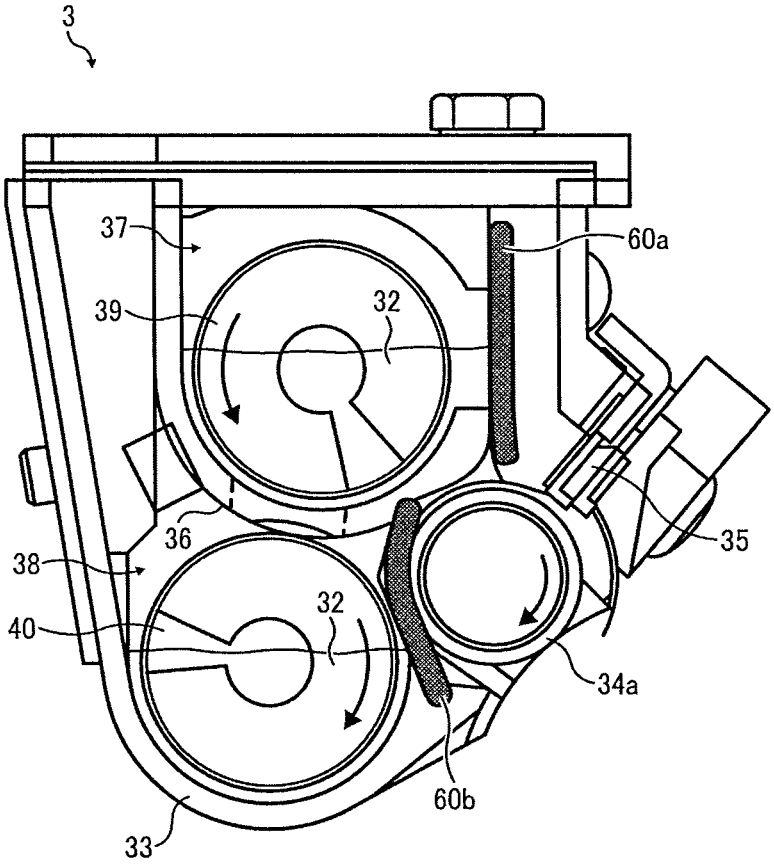
FIG. 77A is a cross sectional diagram illustrating a configuration in which two seam members respectively seal the supply path and the circulation path.
Figure 77B:
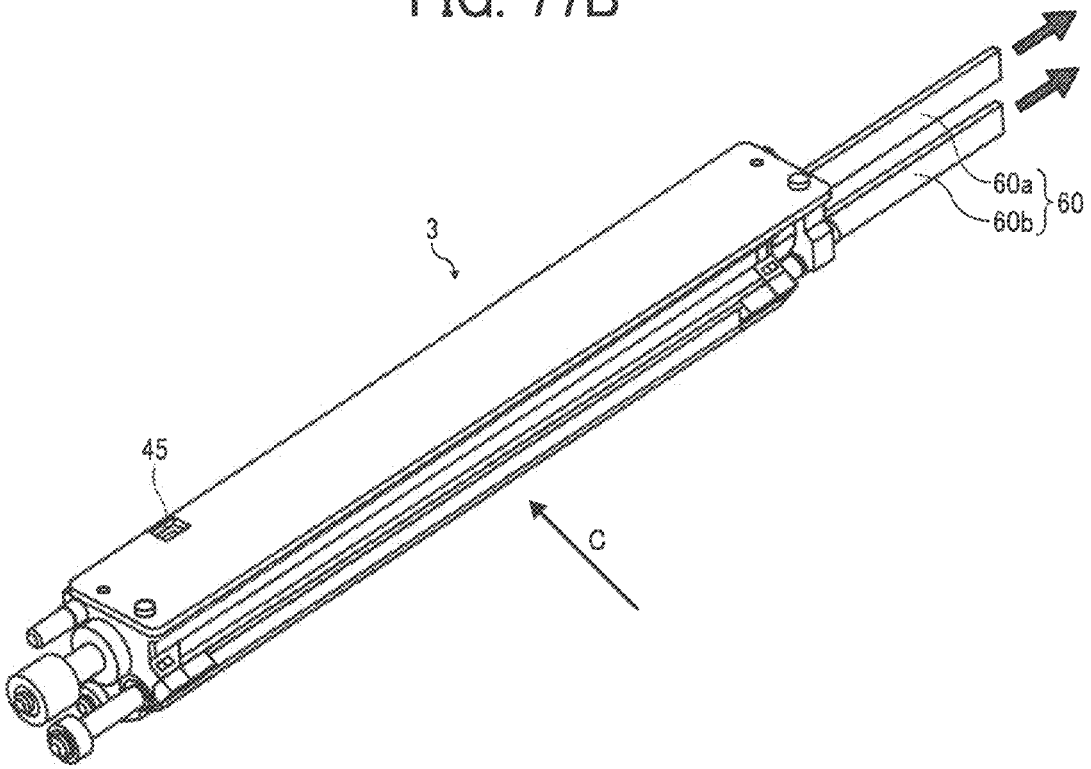
FIG. 77B illustrates a configuration in which the two seal members are pulled out from the development device separately.
Figure 77C:
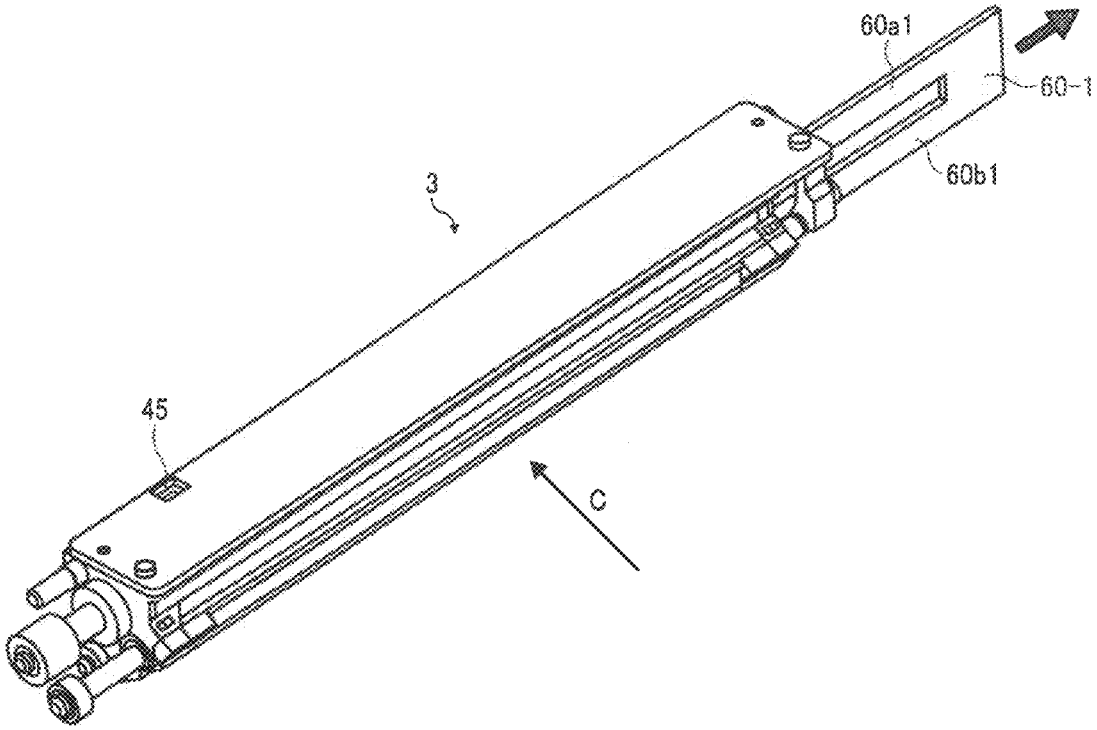
FIG. 77C illustrate a configuration in which the two seal members are united as a single member to be pulled out simultaneously from the development device.

FIGS. 77A, 77B, and 77C illustrate a first seal member 60*a* and a second seal member 60*b* respectively sealing a first communicating area between the supply path 37 and an area in which the development sleeve 34*a* is disposed and a second communicating area between the circulation path 38 and the area in which the development sleeve 34*a* is disposed. The first seal member 60*a* and the second seal member 60*b* together form a seal member 60 serving as the preset seal. As shown in FIG. 75, the developer flows in the first and second communicating areas in the directions indicated by arrows $I_1$ and $I_3$, respectively. FIG. 77A is a cross section of the development device 3, and FIG. 77B is a perspective view illustrating a configuration in which the first and second seal members 60*a* and 60*b* are separately pulled out from the development device 3. FIG. 77C illustrates a seal member 60-1 including a first seal member 60*a*1 and a second seal member 60*b*1 that are united as a single member to be pulled out simultaneously from the development device 3 as a variation of the preset seal. Thus, a common handle or grip may be formed in the united seal member 60-1 for users to remove the first seal member 60*a*1 and the second seal member 60*b*1 together from the development device 3 by pulling the handle or grip.

By providing the above described seal member, the developer can be preset in both the supply path 37 and the circulation path 38, and the development device 3 can be transported reliably without leakage of the developer.

Figure 78A:
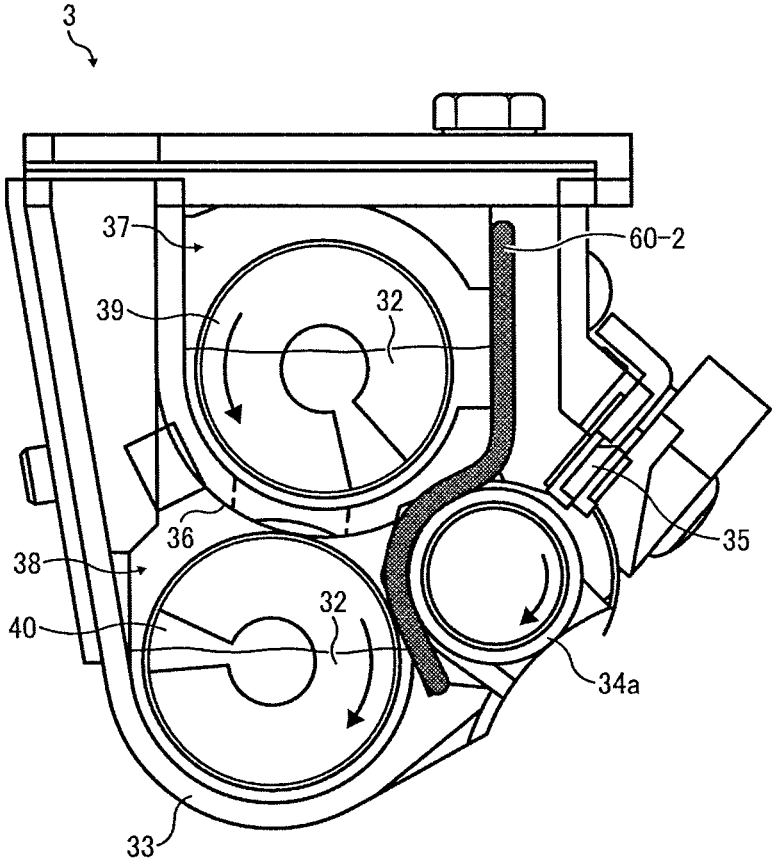
FIG. 78A is a cross sectional diagram illustrating a configuration in which a single seam member seals both the supply path and the circulation path.
Figure 78B:
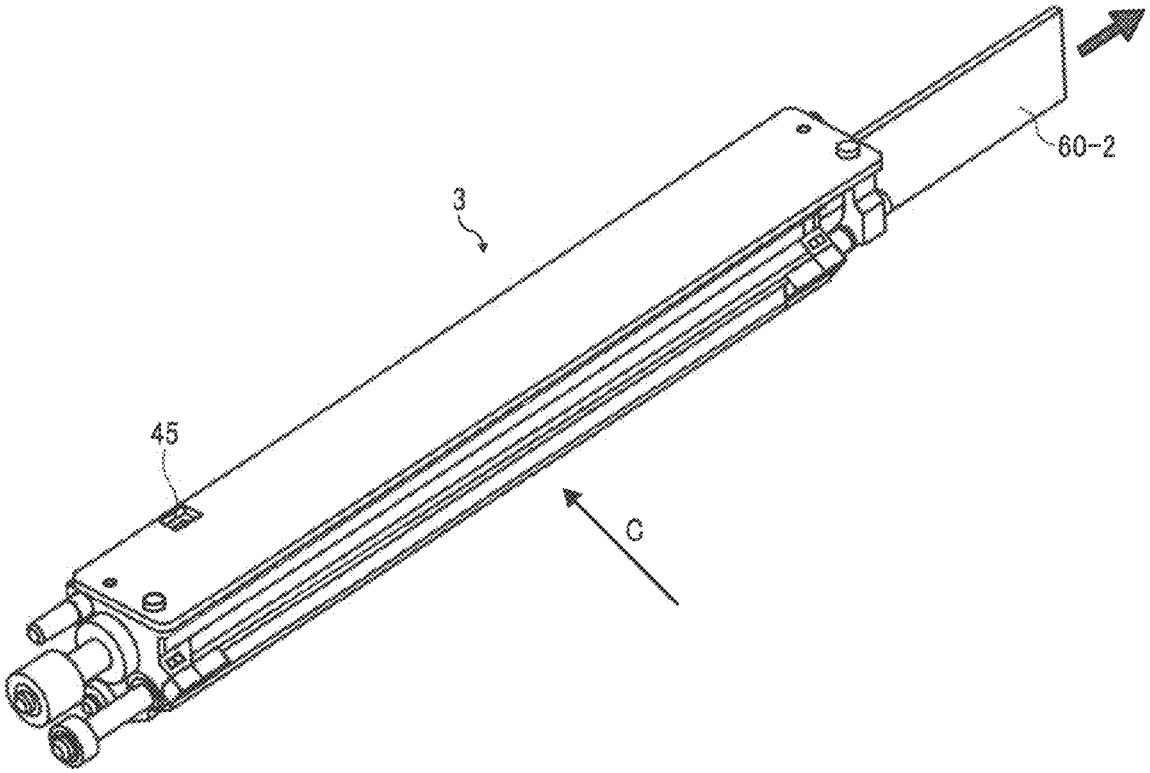
FIG. 78B illustrates a configuration in which the seal member is pulled out from the development device horizontally.
Figure 78C:
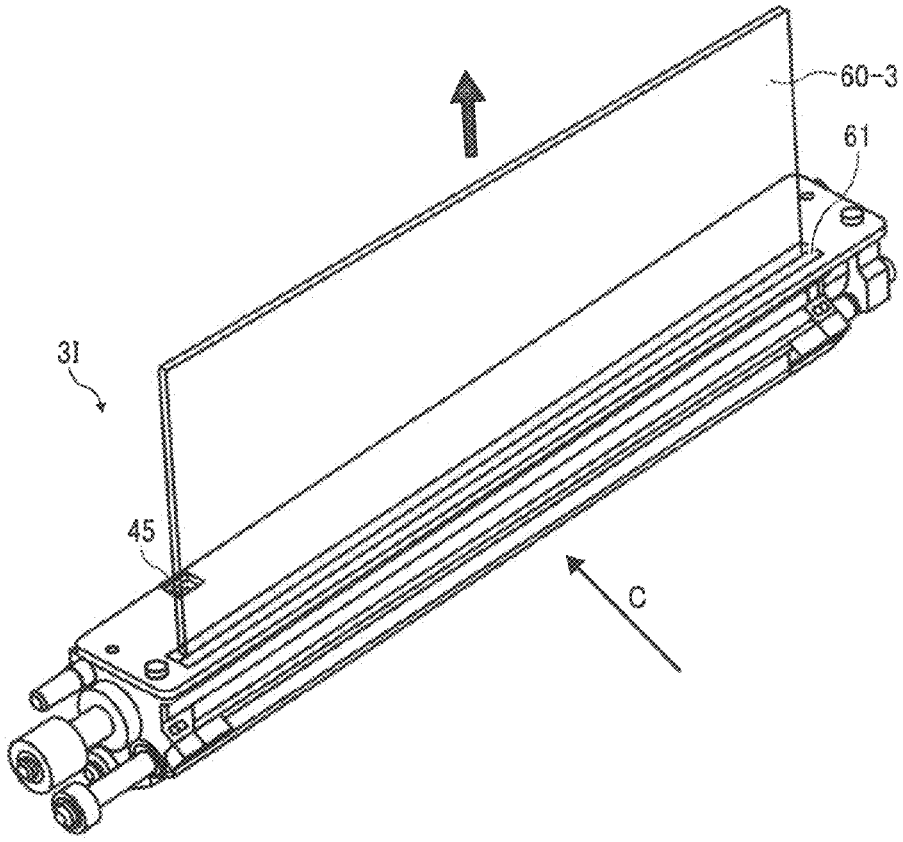
FIG. 78C illustrate a configuration in which the seal member is pulled out from the development device from above.

FIGS. 78A, 78B, and 78C illustrate a configuration in which a single seal member 60-2, as another variation of the preset seal, seals both the first communicating area between the supply path 37 and the area in which the development sleeve 34*a* is disposed and the second communicating area between the circulation path 38 and the area in which the development sleeve 34*a* is disposed. As shown in FIG. 75, the developer flows in the first and second communicating areas in the directions indicated by arrows $I_1$ and $I_3$, respectively. FIG. 78A is a cross-sectional view of the development device 3, and FIG. 78B is a perspective view illustrating a configuration of the development device 3 in which the seal member 60-2 is pulled out horizontally from the development device 3. FIG. 78C is a perspective view illustrating a configuration of a development device 3I in which a seal member 60-3 is pulled out upward therefrom.

It is to be noted that, in the configuration shown in FIG. 78C, the seal member 60-3 is pulled through a seal cleaning member 61 from the development device 3I to remove the developer adhering to the surface of the seal member 60-3. The seal cleaning member 61 is preferably formed with a material such as foamed polyurethane that has a certain degree of flexibility. In the configurations shown in FIGS. 78A through 78C, the developer can be preset in both the supply path 37 and the circulation path 38 similarly to the configurations shown in FIGS. 77A through 77C.

Figure 79A:
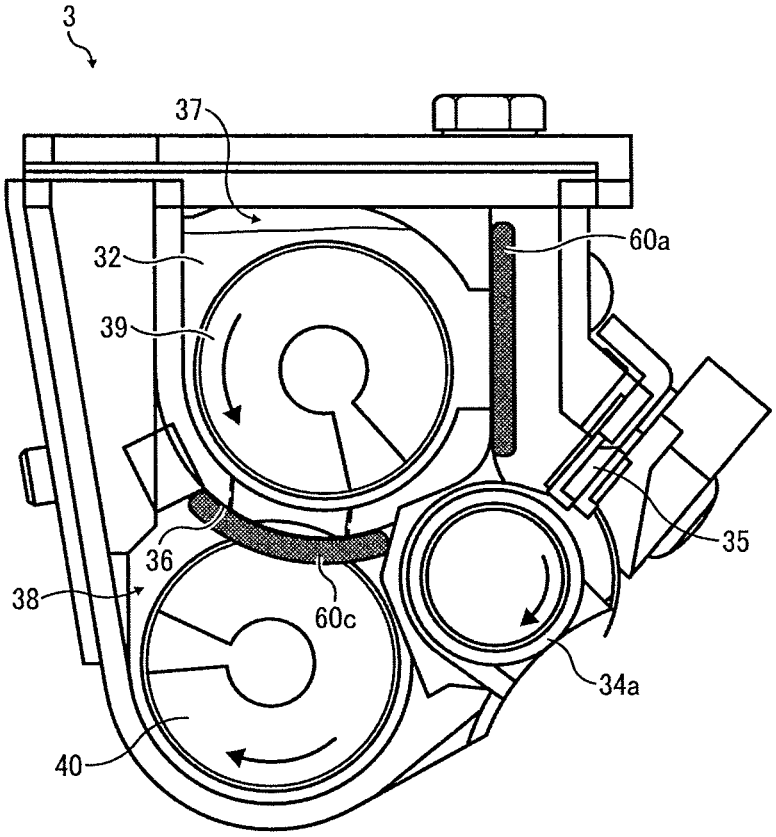
FIG. 79A is a cross sectional diagram illustrating a configuration in which two seam members seal the supply path.
Figure 79B:
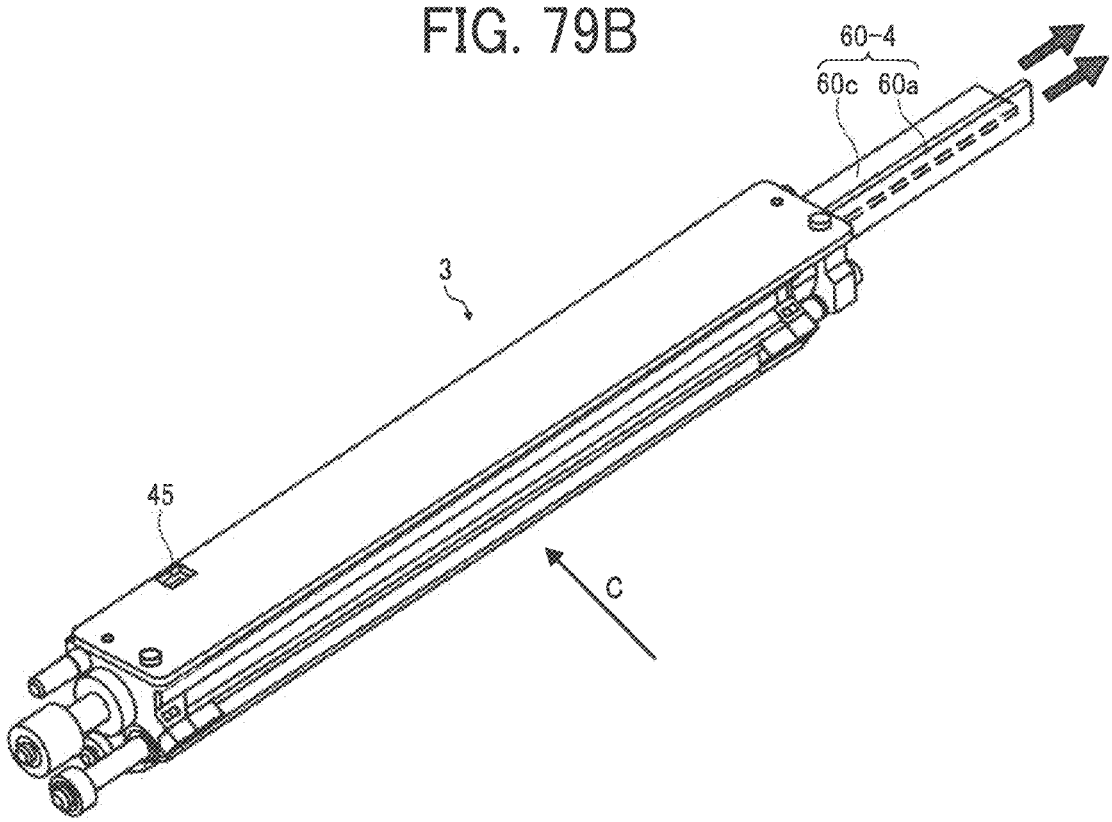
FIG. 79B illustrates a configuration in which the two seal members are pulled out from the development device separately.
Figure 79C:
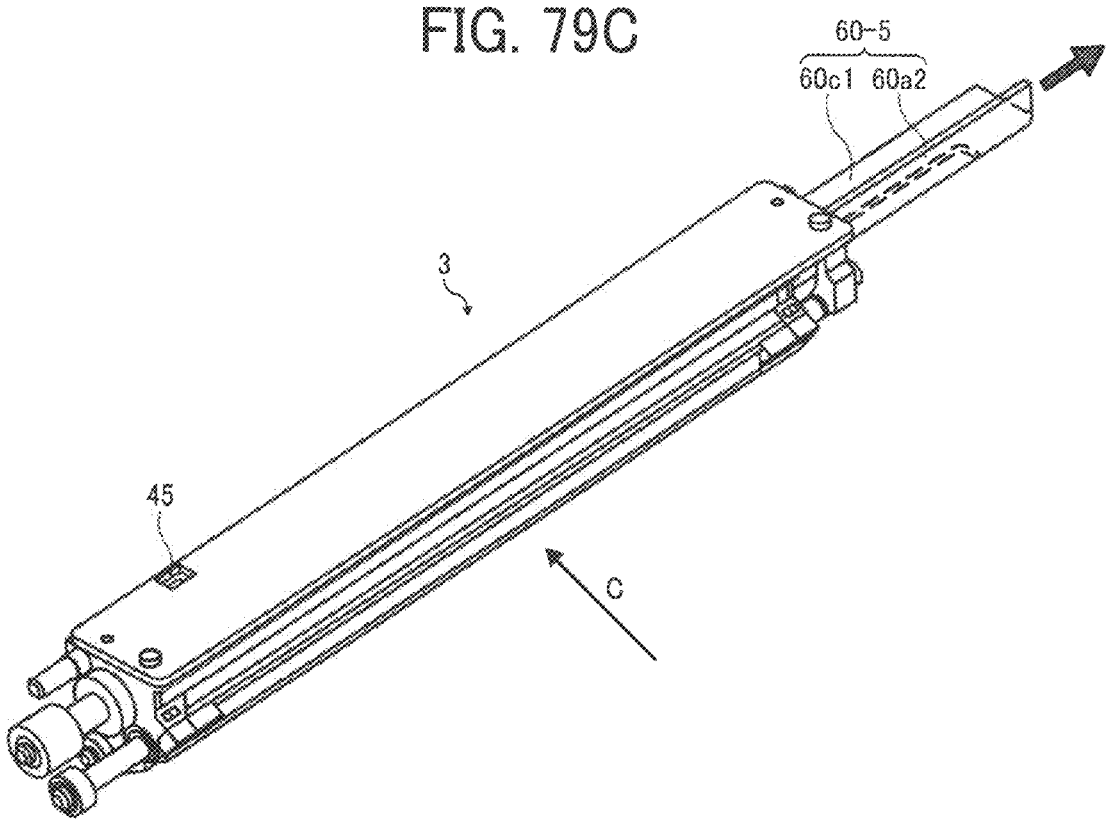
FIG. 79C illustrate a configuration in which the two seal members are united as a single member to be pulled out simultaneously from the development device.

FIGS. 79A, 79B, and 79C illustrate a configuration in which two seal members, together forming a preset seal, respectively seal the first communicating area between the supply path 37 and the area in which the development sleeve 34*a* is disposed and a third communicating area between the circulation path 38 and the supply path 37. The third communicating area includes the bring-up port 41 and the falling port 42 formed in the partition 36 shown in FIG. 76. As shown in FIGS. 75 and 76, the developer flows in the first communicating area in the direction indicated by arrows $I_1$ and in the third communicating area in the directions indicated by arrows $I_5$ and $I_7$, respectively. FIG. 79A is a cross section of the development device 3, and FIG. 79B illustrates a configuration in which a first seal member 60*a* and a third seal member 60*c* (forming a seal member 60-4) are separately pulled out from the development device 3.

FIG. 79C is a perspective view illustrating a seal member 60-5 that includes a united first seal member 60*a*2 and a third seal member 60*c*1 so that two seal members can be pulled out simultaneously from the development device 3. Thus, a common handle or grip may be formed in the united seal member 60-5 for users to remove the first seal member 60*a*2 and the third seal member 60*c*1 together from the development device 3 by pulling the handle or grip.

In the configurations shown in FIGS. 79A through 79C, the developer can be preset in the supply path 37.

Figure 80A:
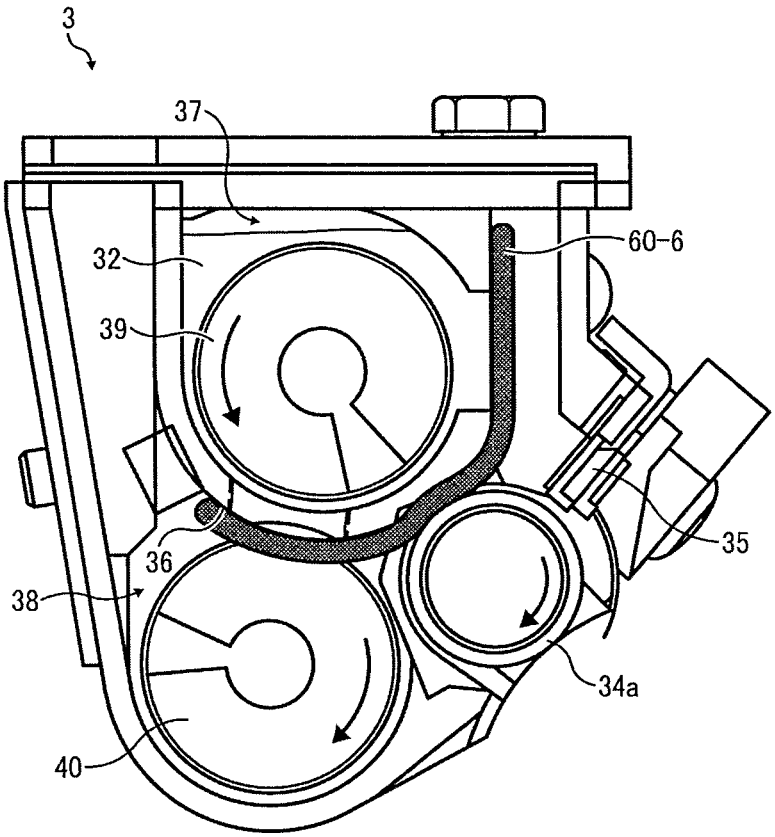
FIG. 80A is a cross sectional diagram illustrating a configuration in which a single seam member seals the supply path.
Figure 80B:
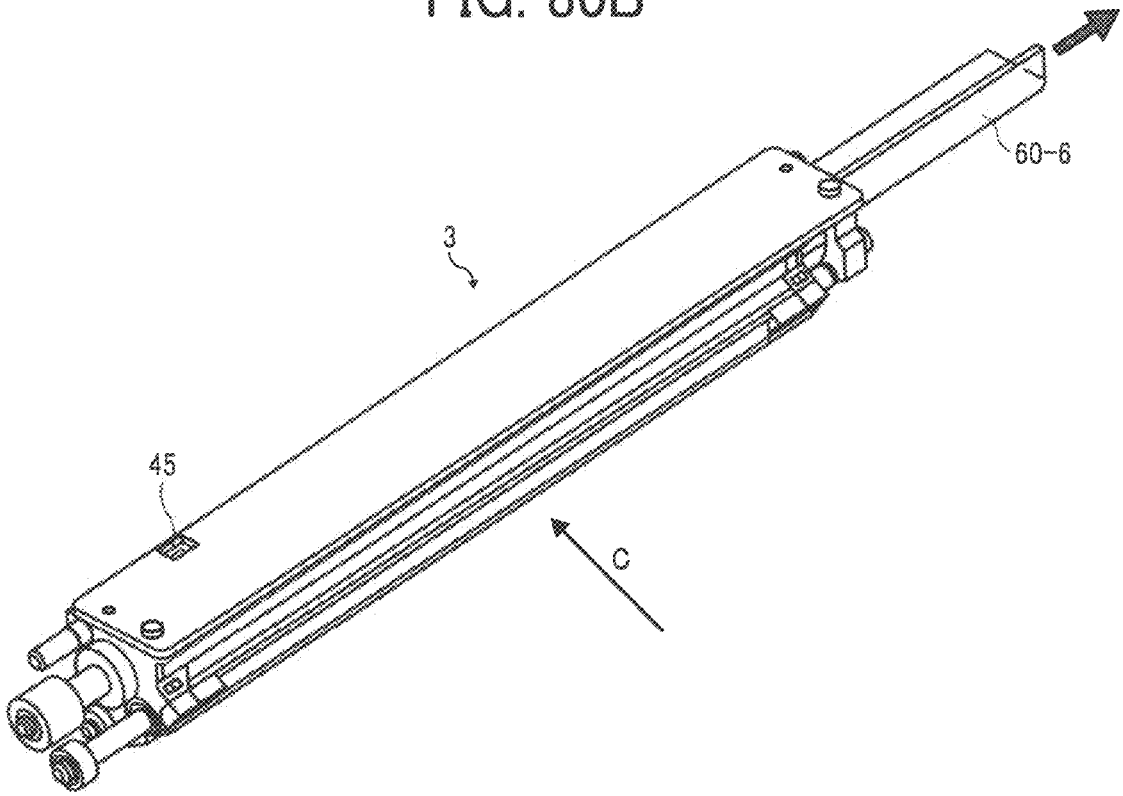
FIG. 80B illustrates a configuration in which the seal member is pulled out from the development device horizontally.
Figure 80C:
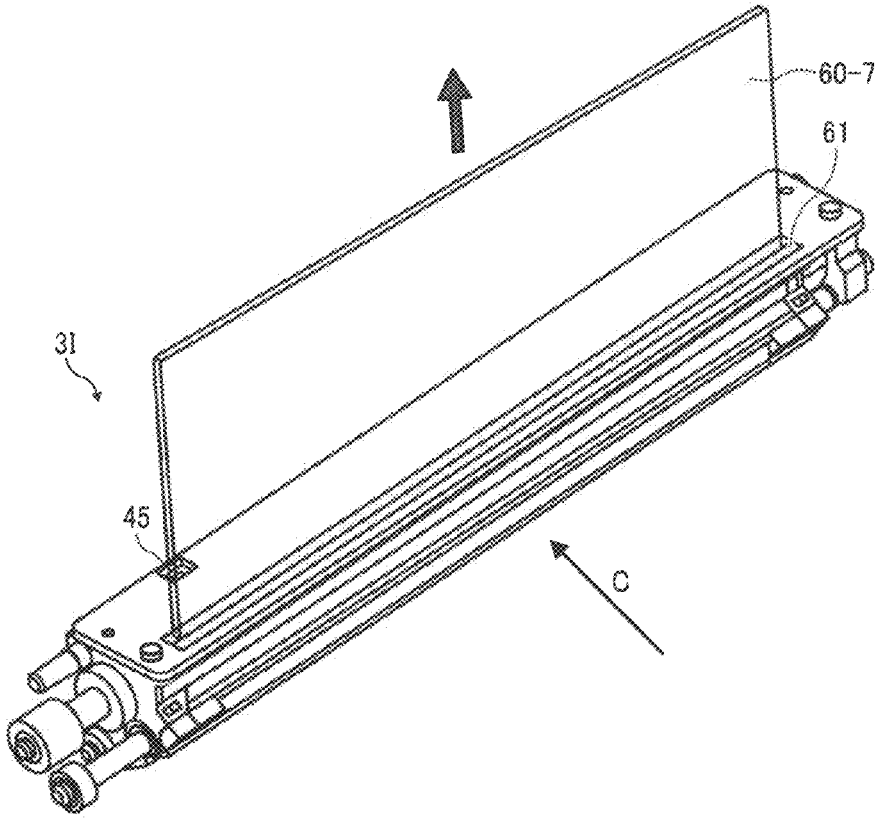
FIG. 80C illustrate a configuration in which the seal member is pulled out from the development device from above.

FIGS. 80A, 80B, and 80C illustrate a configuration in which a single seal member, as another variation of the preset seal, seals both the first communicating area between the supply path 37 and the area in which the development sleeve 34*a* is disposed and the third communicating area between the circulation path 38 and the supply path 37 (the bring-up port 41 and the falling port 42 formed in the partition 36). Similarly, the developer flows in the first communicating area in the direction indicated by arrows $I_1$ and in the third communicating area in the directions indicated by arrows $I_5$ and $I_7$, respectively. FIG. 80A is a cross section of the development device 3, and FIG. 80B is a perspective view illustrating a configuration of the development device 3 in which a seal member 60-6 is pulled out horizontally from the development device 3. FIG. 80C is a perspective view illustrating a configuration of the development device 3I in which a seal member 60-7 is pulled out upward therefrom.

It is to be noted that, in the configuration shown in FIG. 80C, the seal member 60-3 is pulled through the seal cleaning member 61 from the development device 3I to remove the developer adhering to the surface of the seal member 60-3 similarly to the configuration shown in FIG. 78C. In the configurations shown in FIGS. 80A through 80C, the developer can be preset in the supply path 37 similarly to the configurations shown in FIGS. 79A through 79C.

Figure 81A:
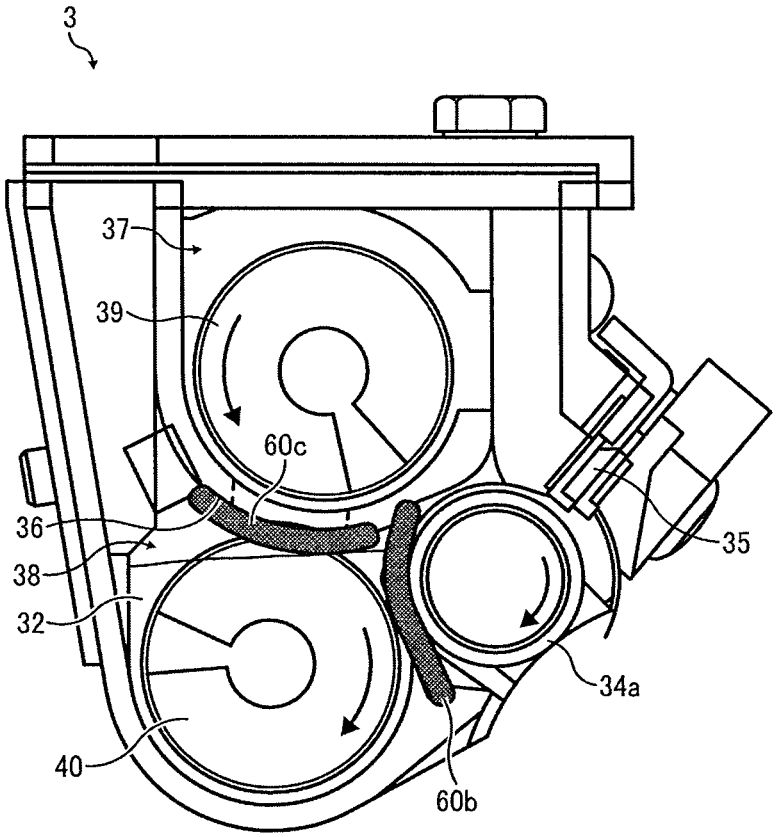
FIG. 81A is a cross sectional diagram illustrating a configuration in which two seam members seal the circulation path.
Figure 81B:
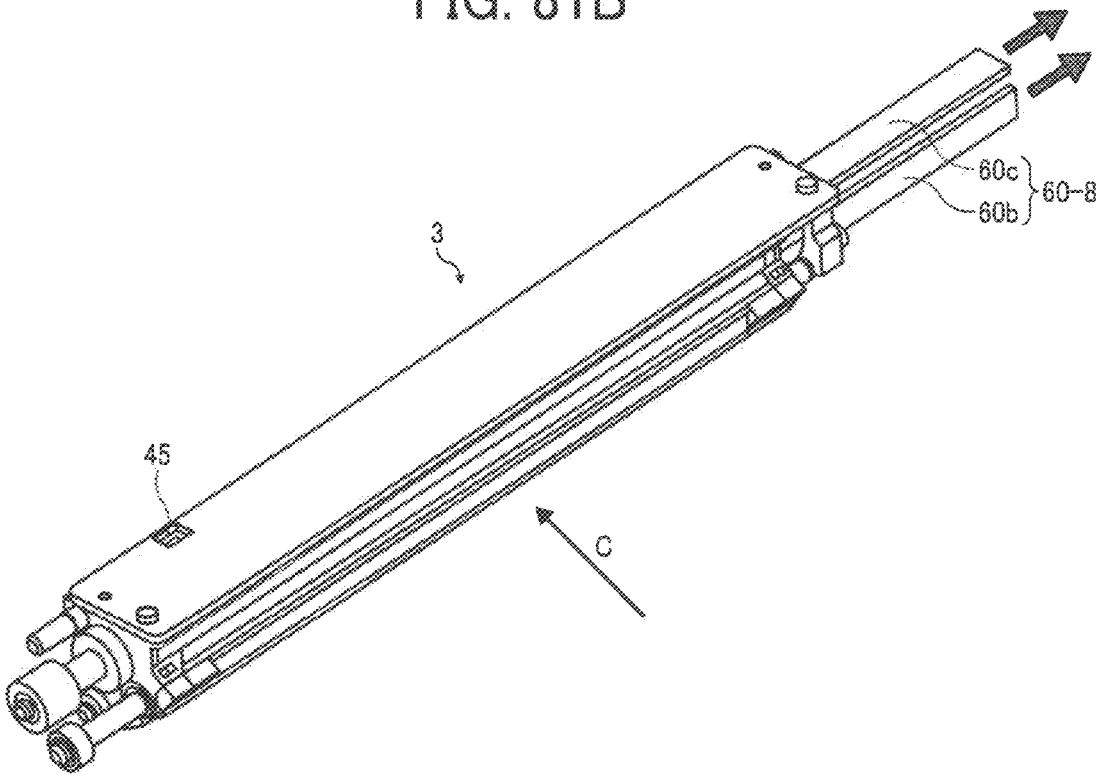
FIG. 81B illustrates a configuration in which the two seal members are pulled out from the development device separately.
Figure 81C:
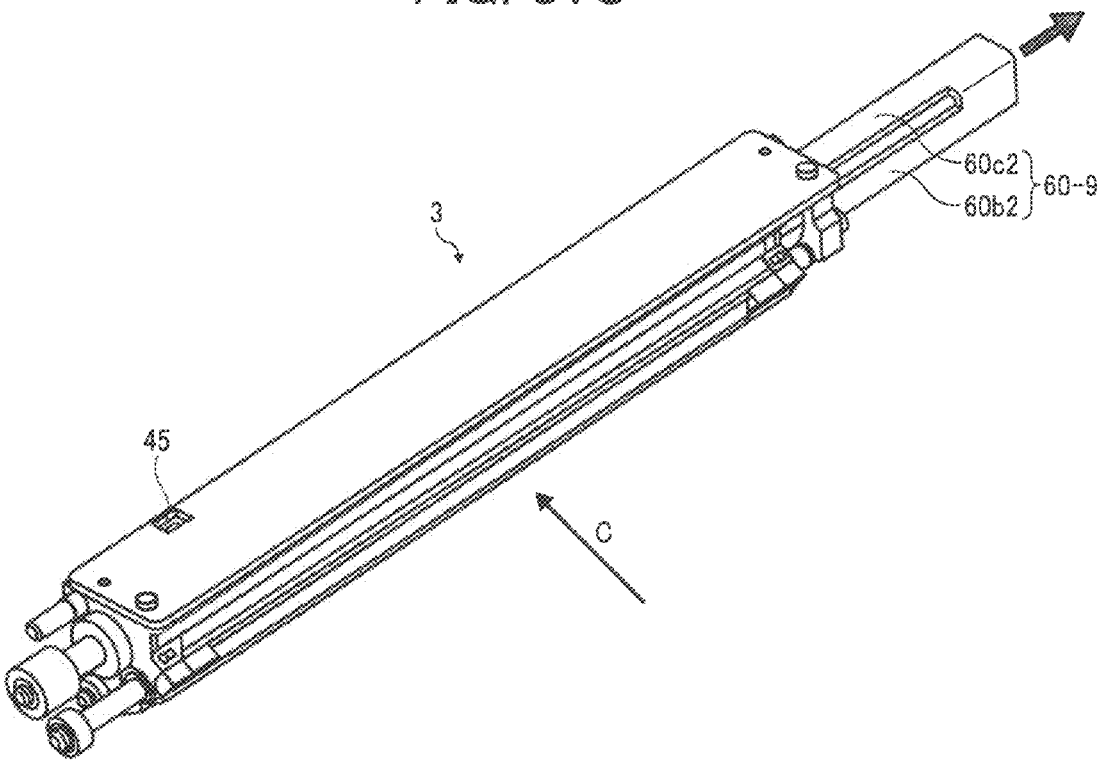
FIG. 81C illustrate a configuration in which the two seal members are united as a single member to be pulled out simultaneously from the development device.

FIGS. 81A, 81B, and 81C illustrate a configuration in which two seal members, together forming a preset seal, respectively seal the second communicating area between the circulation path 38 and the area in which the development sleeve 34*a* is disposed, and the third communicating area between the circulation path 38 and the supply path 37 (the bring-up port 41 and the falling port 42 formed in the partition 36 shown in FIG. 76). As shown in FIGS. 75 and 76, the developer flows in the second communicating area in the direction indicated by arrows $I_3$ and in the third communicating area in the directions indicated by arrows $I_5$ and $I_7$, respectively. FIG. 81A is a cross section of the development device 3, and FIG. 81B illustrates a configuration in which a second seal member 60*b* and a third seal member 60*c* (forming a seal member 60-8) are separately pulled out from the development device 3.

FIG. 81C is a perspective view illustrating a second seal member 60*b*2 and a third seal member 60*c*2 together forming a united single seal member 60-9 so that two seal members 60*b*2 and 60*c*2 can be pulled out simultaneously from the development device 3. Thus, a common handle or grip may be formed in the united seal member 60-9 for users to remove the second seal member 60*b*2 and the third seal member 60*c*2 together from the development device 3 by pulling the handle or grip.

In the configurations shown in FIGS. 81A through 81C, the developer can be preset in the circulation path 38.

Figure 82A:
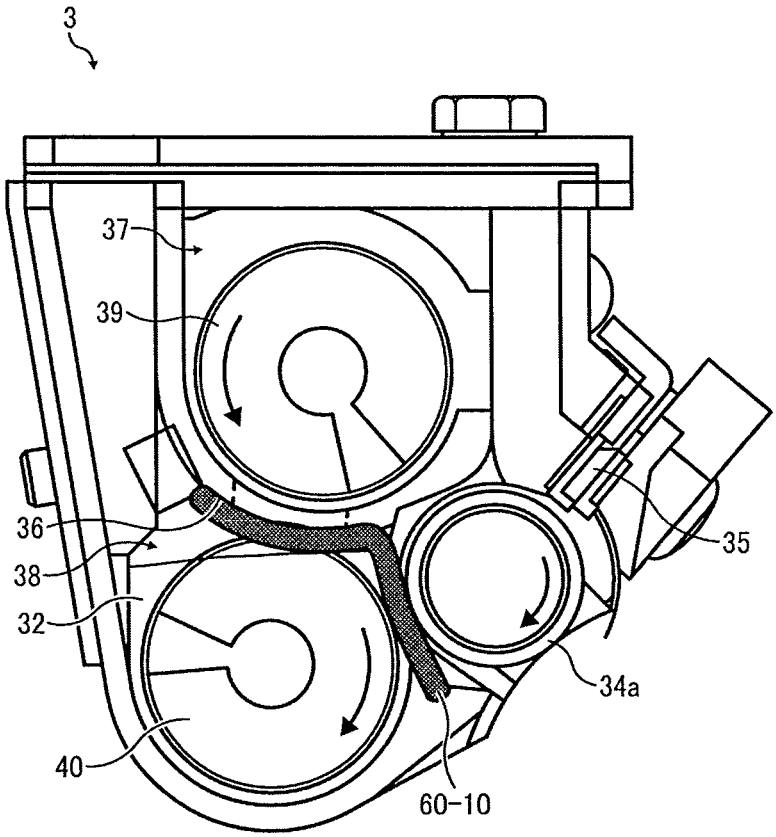
FIG. 82A is a cross sectional diagram illustrating a configuration in which a single seam member seals the circulation path.
Figure 82B:
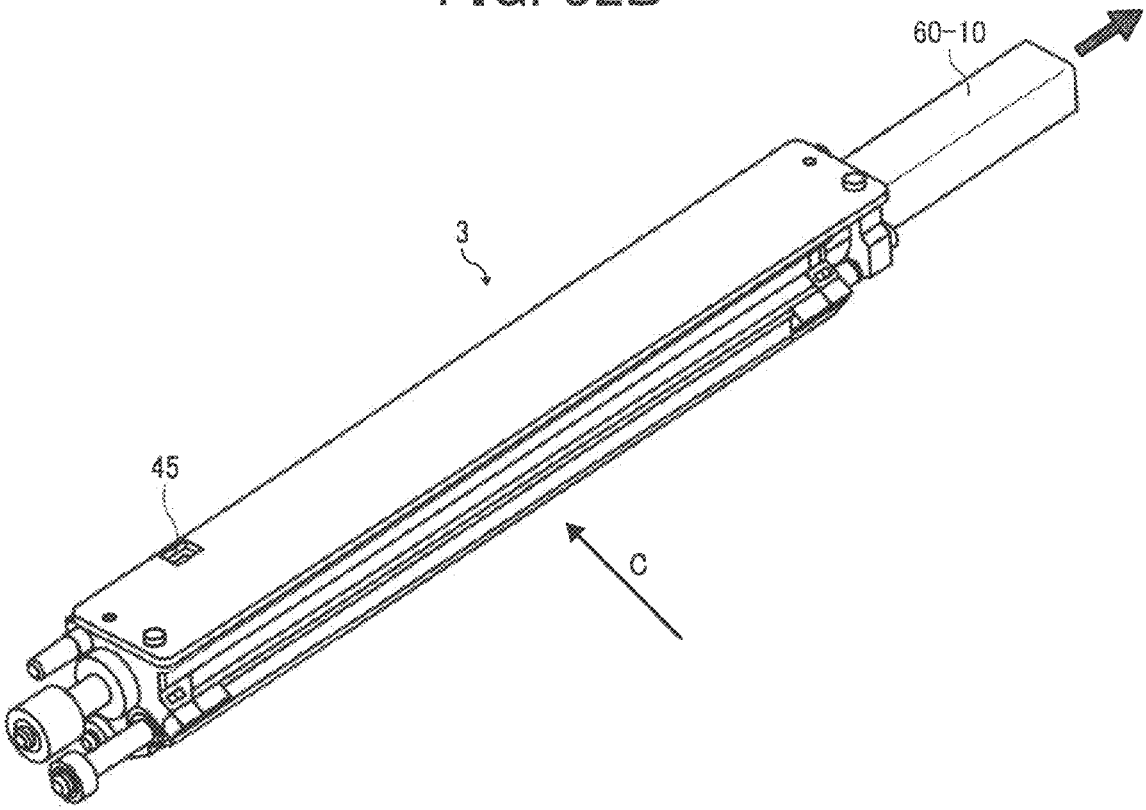
FIG. 82B illustrates a configuration in which the seal member is pulled out from the development device horizontally.
Figure 82C:
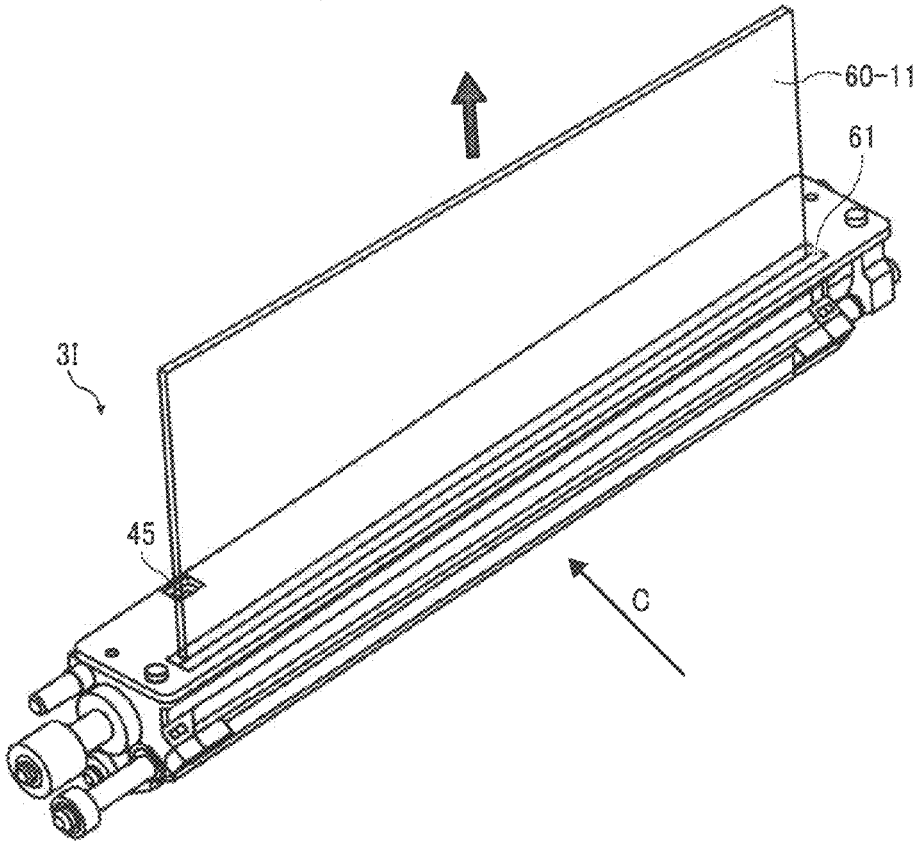
FIG. 82C illustrate a configuration in which the seal member is pulled out from the development device from above.

FIGS. 82A, 82B, and 82C illustrate a configuration in which a single seal member, as another variation of the preset seal, seals both the second communicating area between the circulation path 38 and the area in which the development sleeve 34*a* is disposed, and the third communicating area between the circulation path 38 and the supply path 37 (the bring-up port 41 and the falling port 42 formed in the partition 36 shown in FIG. 76). Similarly, the developer flows in the second communicating area in the direction indicated by arrows $I_3$ and in the third communicating area in the directions indicated by arrows $I_5$ and $I_7$, respectively. FIG. 82A is a cross section of the development device 3, and FIG. 82B is a perspective view illustrating a configuration of the development device 3 in which a seal member 60-10 is pulled out horizontally from the development device 3. FIG. 82C is a perspective view illustrating a configuration of the development device 3I in which a seal member 60-11 is pulled out upward therefrom.

The seal member 60-11 is pulled through the seal cleaning member 61 from the development device 3I to remove the developer adhering to the surface of the seal member 60-11 similarly to the configurations shown in FIGS. 78C and 80C. In the configurations shown in FIGS. 82A through 82C, the developer can be preset in the supply path 38 similarly to the configurations shown in FIGS. 81A through 81C.

It is to be noted that, although the configurations shown in FIGS. 77A through 82C concern searing the development device with the sealing member, the sealing member described above may be used in process cartridges.

In addition, although the seal cleaning member 61 is used only when the seal member is pulled out upward from the development device 3 in the description above, it is preferable that the seal cleaning member 61 is provided in the configuration in which the seal member is pulled out horizontally.

Thus, by sealing the space in which the development sleeve 34*a* is provided and the third communication area between the supply path 37 and the circulation path 38, leakage of the developer can be prevented during transportation even when the developer is preset therein. When the development device is used as a replacement part, because package thereof can be kept clean, users do not have a feeling of discomfort.

Additionally, scattering of the developer inside the image forming apparatus can be prevented, and accordingly image failure and malfunction of the apparatus thereby can be prevented.

In the above described embodiment and variations thereof, the seal member 60 is thermally welded to the casing forming an edge portion of the communicating area to be sealed in the longitudinal direction, thus sealing the communicating area. The seal member 60 is folded on a first side in the longitudinal direction, opposite a second side from which the seal member 60 is pulled out from the development device 3. The seal member 60 is removed out from the development device 3 by pulling a second end portion of the seal member 60 that is not welded to the casing and is disposed on the opposite side of the welded side across the folded portion. By pulling the folded seal member 60, not the seal member 60 is removed entirely at once, but the seal member 60 can be removed gradually from the second end portion from the development device 3. Therefore, the force necessary to remove the seal member 60 can be reduced. Accordingly, the force applied to the seal member 60 while being pulled is reduced, which can reduce the risk of damaging the sealing member 60 to such an extent that the seam member 60 cannot be removed while pulling the seal member 60.

It is to be noted that the seal member 60 is not necessarily folded when welded. Sealing of the communicating area is not limited to thermal welding but can be any configuration as long as the seal member can reliably seal the communicating area and can be pulled out from the development device 3.

It is to be noted that the configuration according to the fourteenth embodiment is applicable to relatively compact development devices using a three-pole magnet roller and a development sleeve of reduced diameter as in the first through seventh embodiments. However, the configuration of the fourteenth embodiments is also applicable to development devices in which the number of developer-carrying magnetic poles to generate a magnetic field to keep the developer on the development sleeve is more than four, for example, five as in the comparative example 2 shown in FIG. 11. In other words, the configuration of the fourteenth embodiment is also applicable to development devises including the supply path and the circulation path disposed beneath the supply path. More specifically, in the supply path, the developer is supplied onto the development sleeve while transported in the axial direction of the development sleeve. The circulation path receives the developer from the downstream end portion of the supply path in the developer transport direction, and the developer is collected from the development sleeve in the circulation path while transported in the axial direction of the development sleeve in the opposite direction to the developer transport direction in the supply path. Then, the developer reached the downstream end portion of the circulation path is sent to the upstream end portion of the supply path in the developer transport direction.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device, comprising:

a developer containing part containing two-component developer including toner and magnetic carrier particles;

a cylindrical developer carrier to carry by rotation the developer supplied from the developer containing part to a development range where the developer carrier faces an image carrier;

a first developer transport member disposed in the developer containing part, to supply the developer to the developer carrier while transporting the developer in an axial direction of the developer carrier; and a magnetic field generator disposed inside the developer carrier, having three developer-carrying magnetic poles each capable of generating a magnetic field to keep the developer on a circumferential surface of the developer carrier, the three developer-carrying magnetic poles consisting of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, wherein the second magnetic field causes the developer supplied from the developer containing part to be attracted to the circumferential surface of the developer carrier at a developer attraction position, the first magnetic field and the second magnetic field keep the developer on the circumferential surface of the developer carrier from the developer attraction position to the development range, and the first magnetic field and the third magnetic field keep the developer on the circumferential surface of the developer carrier from the development range to a release position where the developer is separated from the developer carrier, and each of the developer-carrying magnetic poles has a maximum density of magnetic flux in a normal direction to the circumferential surface of the developer carrier of 10 mT or greater.

2. The development device according to claim 1, wherein, when positions where magnetic flux density in a normal direction to the circumferential surface of the developer carrier is maximum in the pre-development pole, the development pole, and the post-development pole are respectively referred to as a pre-development magnetic flux density peak position, a development magnetic flux density peak position, and a post-development magnetic flux density peak position, and an angle θ3 is formed by a first line connecting a center of rotation of the developer carrier and the post-development magnetic flux density peak position and a second line connecting a center of rotation of the developer carrier and the pre-development magnetic flux density peak position, with the angle θ3 extending from the first line to the second line on a virtual plane perpendicular to an axial direction of the developer carrier so as to not include the development magnetic flux density peak position, the angle θ3 is not smaller than 180°.

3. The development device according to claim 1, further comprising:

a partition dividing the developer containing part into a supply part including a first developer supply member and a circulation part disposed beneath the supply part; and a second developer transport member disposed in the circulation part, to transport the developer in the circulation part in the axial direction of the developer carrier.

4. The development device according to claim 3, wherein an end portion of the partition on a side closer to the developer carrier is disposed above the developer carrier, and the developer moves by gravity from the end portion of the partition to the circumferential surface of the developer carrier.

5. The development device according to claim 4, wherein the developer attraction position at which the developer supplied from the developer containing part contacts the circumferential surface of the developer carrier is disposed downstream, in a direction in which the developer carrier rotates, from a point on the circumferential surface of the developer carrier at the top of the rotation of the developer carrier.

6. The development device according to claim 4, wherein the developer attraction position is disposed upstream, in a direction in which the developer carrier rotates, from a point on the circumferential surface of the developer carrier at the top of the rotation of the developer carrier, and a pre-development magnetic flux density peak position where magnetic flux density in a normal direction to the circumferential surface of the developer carrier is maximum in the pre-development pole is disposed upstream, in the direction in which the developer carrier rotates, from the point on the circumferential surface of the developer carrier at the tope top of the rotation thereof.

7. The development device according to claim 3, wherein a first communication port and a second communication port through which the supply part and the circulation part communicate with each other are respectively formed in an upstream end portion and a downstream portion of the partition in a direction in which the first developer transport member transports the developer, and the second developer transport member transports the developer in a direction opposite the direction in which the first developer transport member transports the developer.

8. The development device according to claim 7, wherein the first communication port is disposed on a side away from the developer carrier.

9. The development device according to claim 1, wherein a peak of magnetic flux density in a normal direction to the circumferential surface of the developer carrier in the second magnetic field generated by the pre-development pole is not greater than 40 mT.

10. The development device according to claim 1, wherein, when $Br_1$ represents a peak value of magnetic flux density at a position where magnetic flux density in a normal direction to the circumferential surface of the developer carrier is maximum in the first magnetic field generated by the development pole, and $Br_2$ represents a peak value of magnetic flux density at a position where magnetic flux density in a normal direction to the circumferential surface of the developer carrier is maximum in the third magnetic field generated by the post-development pole, $Br_1>Br_2$.

11. The development device according to claim 1, further comprising a range on the circumferential surface of the developer carrier where magnetic force in a direction tangential to the circumferential surface of the developer carrier is zero, disposed downstream from a post-development magnetic flux density peak position where magnetic flux density in a normal direction to the circumferential surface of the developer carrier is maximum in the third magnetic field generated by the post-development pole in a direction in which the developer carrier rotates and upstream from a pre-development magnetic flux density peak position where magnetic flux density in a normal direction to the circumferential surface of the developer carrier is maximum in the second magnetic field generated by the pre-development pole in a direction in which the developer carrier rotates, wherein an angle formed by a line connecting a given point in the range where magnetic force in the tangent direction is zero and a center of rotation of the developer carrier and a horizontal line is not greater than 50°.

12. An image forming apparatus, comprising:

an image carrier on which a latent image is formed;

a charging member disposed adjacent to the image carrier, to charge a surface of the image carrier; and the development device according to claim 1 disposed adjacent to the image carrier, to develop the latent image into a toner image.

13. A development device, comprising:

a developer containing part containing two-component developer including toner and magnetic carrier particles;

a cylindrical developer carrier to carry by rotation the developer supplied from the developer containing part to a development range where the developer carrier faces an image carrier;

a first developer transport member disposed in the developer containing part, to supply the developer to the developer carrier while transporting the developer in an axial direction of the developer carrier; and a magnetic field generator disposed inside the developer carrier, having three developer-carrying magnetic poles each capable of generating a magnetic field to keep the developer on a circumferential surface of the developer carrier, the three developer-carrying magnetic poles consisting of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, wherein the second magnetic field causes the developer supplied from the developer containing part to be attracted to the circumferential surface of the developer carrier at a developer attraction position, the first magnetic field and the second magnetic field keep the developer on the circumferential surface of the developer carrier from the developer attraction position to the development range, and the first magnetic field and the third magnetic field keep the developer on the circumferential surface of the developer carrier from the development range to a release position where the developer is separated from the developer carrier, and when positions where magnetic flux density in a normal direction to the circumferential surface of the developer carrier is maximum in the pre-development pole, the development pole, and the post-development pole are respectively referred to as a pre-development magnetic flux density peak position, a development magnetic flux density peak position, and a post-development magnetic flux density peak position, and an angle θ3 is formed by a first line connecting a center of rotation of the developer carrier and the post-development magnetic flux density peak position and a second line connecting a center of rotation of the developer carrier and the pre-development magnetic flux density peak position, with the angle θ3 extending from the first line to the second line on a virtual plane perpendicular to an axial direction of the developer carrier so as to not include the development magnetic flux density peak position, the angle θ3 is not smaller than 180°.

14. The development device according to claim 13, further comprising:

a partition dividing the developer containing part into a supply part including a first developer supply member and a circulation part disposed beneath the supply part; and a second developer transport member disposed in the circulation part, to transport the developer in the circulation part in the axial direction of the developer carrier.

15. The development device according to claim 14, wherein an end portion of the partition on a side closer to the developer carrier is disposed above the developer carrier, and the developer moves by gravity from the end portion of the partition to the circumferential surface of the developer carrier.

16. The development device according to claim 15, wherein the developer attraction position at which the developer supplied from the developer containing part contacts the circumferential surface of the developer carrier is disposed downstream, in a direction in which the developer carrier rotates, from a point on the circumferential surface of the developer carrier at the top of the rotation of the developer carrier.

17. The development device according to claim 15, wherein the developer attraction position is disposed upstream, in a direction in which the developer carrier rotates, from a point on the circumferential surface of the developer carrier at the top of the rotation of the developer carrier, and a pre-development magnetic flux density peak position where magnetic flux density in a normal direction to the circumferential surface of the developer carrier is maximum in the pre-development pole is disposed upstream, in the direction in which the developer carrier rotates, from the point on the circumferential surface of the developer carrier at the top of the rotation thereof.

18. The development device according to claim 14, wherein a first communication port and a second communication port through which the supply part and the circulation part communicate with each other are respectively formed in an upstream end portion and a downstream portion of the partition in a direction in which the first developer transport member transports the developer, and the second developer transport member transports the developer in a direction opposite the direction in which the first developer transport member transports the developer.

19. The development device according to claim 18, wherein the first communication port is disposed on a side away from the developer carrier.

20. The development device according to claim 13, wherein a peak of magnetic flux density in a normal direction to the circumferential surface of the developer carrier in the second magnetic field generated by the pre-development pole is not greater than 40 mT.

21. The development device according to claim 13, wherein, when $Br_1$ represents a peak value of magnetic flux density at a position where magnetic flux density in a normal direction to the circumferential surface of the developer carrier is maximum in the first magnetic field generated by the development pole, and $Br_2$ represents a peak value of magnetic flux density at a position where magnetic flux density in a normal direction to the circumferential surface of the developer carrier is maximum in the third magnetic field generated by the post-development pole, $Br_1>Br_2$.

22. The development device according to claim 13, further comprising a range on the circumferential surface of the developer carrier where magnetic force in a direction tangential to the circumferential surface of the developer carrier is zero, disposed downstream from a post-development magnetic flux density peak position where magnetic flux density in a normal direction to the circumferential surface of the developer carrier is maximum in the third magnetic field generated by the post-development pole in a direction in which the developer carrier rotates and upstream from a pre-development magnetic flux density peak position where magnetic flux density in a normal direction to the circumferential surface of the developer carrier is maximum in the second magnetic field generated by the pre-development pole in a direction in which the developer carrier rotates, wherein an angle formed by a line connecting a given point in the range where magnetic force in the tangent direction is zero and a center of rotation of the developer carrier and a horizontal line is not greater than 50°.

23. An image forming apparatus, comprising:

an image carrier on which a latent image is formed;

a charging member disposed adjacent to the image carrier, to charge a surface of the image carrier; and the development device according to claim 13 disposed adjacent to the image carrier, to develop the latent image into a toner image.

24. A development device, comprising:

a developer containing part containing two-component developer including toner and magnetic carrier particles;

a cylindrical developer carrier to carry by rotation the developer supplied from the developer containing part to a development range where the developer carrier faces an image carrier;

a first developer transport member disposed in the developer containing part, to supply the developer to the developer carrier while transporting the developer in an axial direction of the developer carrier;

a magnetic field generator disposed inside the developer carrier, having three developer-carrying magnetic poles each capable of generating a magnetic field to keep the developer on a circumferential surface of the developer carrier, the three developer-carrying magnetic poles consisting of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, wherein the second magnetic field causes the developer supplied from the developer containing part to be attracted to the circumferential surface of the developer carrier at a developer attraction position, the first magnetic field and the second magnetic field keep the developer on the circumferential surface of the developer carrier from the developer attraction position to the development range, and the first magnetic field and the third magnetic field keep the developer on the circumferential surface of the developer carrier from the development range to a release position where the developer is separated from the developer carrier;

a partition dividing the developer containing part into a supply part including a first developer supply member and a circulation part disposed beneath the supply part; and a second developer transport member disposed in the circulation part, to transport the developer in the circulation part in the axial direction of the developer carrier, wherein an end portion of the partition on a side closer to the developer carrier is disposed above the developer carrier, and the developer moves by gravity from the end portion of the partition to the circumferential surface of the developer carrier.

25. The development device according to claim 24, wherein the developer attraction position at which the developer supplied from the developer containing part contacts the circumferential surface of the developer carrier is disposed downstream, in a direction in which the developer carrier rotates, from a point on the circumferential surface of the developer carrier at the top of the rotation of the developer carrier.

26. The development device according to claim 24, wherein the developer attraction position is disposed upstream, in a direction in which the developer carrier rotates, from a point on the circumferential surface of the developer carrier at the top of the rotation of the developer carrier, and a pre-development magnetic flux density peak position where magnetic flux density in a normal direction to the circumferential surface of the developer carrier is maximum in the pre-development pole is disposed upstream, in the direction in which the developer carrier rotates, from the point on the circumferential surface of the developer carrier at the top of the rotation thereof.

27. The development device according to claim 24, wherein a first communication port and a second communication port through which the supply part and the circulation part communicate with each other are respectively formed in an upstream end portion and a downstream portion of the partition in a direction in which the first developer transport member transports the developer, and the second developer transport member transports the developer in a direction opposite the direction in which the first developer transport member transports the developer.

28. The development device according to claim 27, wherein the first communication port is disposed on a side away from the developer carrier.

29. The development device according to claim 24, wherein a peak of magnetic flux density in a normal direction to the circumferential surface of the developer carrier in the second magnetic field generated by the pre-development pole is not greater than 40 mT.

30. The development device according to claim 24, wherein, when $Br_1$ represents a peak value of magnetic flux density at a position where magnetic flux density in a normal direction to the circumferential surface of the developer carrier is maximum in the first magnetic field generated by the development pole, and $Br_2$ represents a peak value of magnetic flux density at a position where magnetic flux density in a normal direction to the circumferential surface of the developer carrier is maximum in the third magnetic field generated by the post-development pole, $Br_1>Br_2$.

31. The development device according to claim 24, further comprising a range on the circumferential surface of the developer carrier where magnetic force in a direction tangential to the circumferential surface of the developer carrier is zero, disposed downstream from a post-development magnetic flux density peak position where magnetic flux density in a normal direction to the circumferential surface of the developer carrier is maximum in the third magnetic field generated by the post-development pole in a direction in which the developer carrier rotates and upstream from a pre-development magnetic flux density peak position where magnetic flux density in a normal direction to the circumferential surface of the developer carrier is maximum in the second magnetic field generated by the pre-development pole in a direction in which the developer carrier rotates, wherein an angle formed by a line connecting a given point in the range where magnetic force in the tangent direction is zero and a center of rotation of the developer carrier and a horizontal line is not greater than 50°.

32. An image forming apparatus, comprising:

an image carrier on which a latent image is formed;

a charging member disposed adjacent to the image carrier, to charge a surface of the image carrier; and the development device according to claim 24 disposed adjacent to the image carrier, to develop the latent image into a toner image.

33. A development device, comprising:

a developer containing part containing two-component developer including toner and magnetic carrier particles;

a cylindrical developer carrier to carry by rotation the developer supplied from the developer containing part to a development range where the developer carrier faces an image carrier;

a first developer transport member disposed in the developer containing part, to supply the developer to the developer carrier while transporting the developer in an axial direction of the developer carrier; and a magnetic field generator disposed inside the developer carrier, having three developer-carrying magnetic poles each capable of generating a magnetic field to keep the developer on a circumferential surface of the developer carrier, the three developer-carrying magnetic poles consisting of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, wherein the second magnetic field causes the developer supplied from the developer containing part to be attracted to the circumferential surface of the developer carrier at a developer attraction position, the first magnetic field and the second magnetic field keep the developer on the circumferential surface of the developer carrier from the developer attraction position to the development range, and the first magnetic field and the third magnetic field keep the developer on the circumferential surface of the developer carrier from the development range to a release position where the developer is separated from the developer carrier, and a peak of magnetic flux density in a normal direction to the circumferential surface of the developer carrier in the second magnetic field generated by the pre-development pole is not greater than 40 mT.

34. The development device according to claim 33, further comprising:

a partition dividing the developer containing part into a supply part including a first developer supply member and a circulation part disposed beneath the supply part; and a second developer transport member disposed in the circulation part, to transport the developer in the circulation part in the axial direction of the developer carrier.

35. The development device according to claim 34, wherein an end portion of the partition on a side closer to the developer carrier is disposed above the developer carrier, the developer moves by gravity from the end portion of the partition to the circumferential surface of the developer carrier, and the developer attraction position at which the developer supplied from the developer containing part contacts the circumferential surface of the developer carrier is disposed downstream, in a direction in which the developer carrier rotates, from a point on the circumferential surface of the developer carrier at the top of the rotation of the developer carrier.

36. The development device according to claim 34, wherein an end portion of the partition on a side closer to the developer carrier is disposed above the developer carrier, the developer moves by gravity from the end portion of the partition to the circumferential surface of the developer carrier, the developer attraction position is disposed upstream, in a direction in which the developer carrier rotates, from a point on the circumferential surface of the developer carrier at the top of the rotation of the developer carrier, and a pre-development magnetic flux density peak position where magnetic flux density in a normal direction to the circumferential surface of the developer carrier is maximum in the pre-development pole is disposed upstream, in the direction in which the developer carrier rotates, from the point on the circumferential surface of the developer carrier at the top of the rotation thereof.

37. The development device according to claim 34, wherein a first communication port and a second communication port through which the supply part and the circulation part communicate with each other are respectively formed in an upstream end portion and a downstream portion of the partition in a direction in which the first developer transport member transports the developer, and the second developer transport member transports the developer in a direction opposite the direction in which the first developer transport member transports the developer.

38. The development device according to claim 37, wherein the first communication port is disposed on a side away from the developer carrier.

39. The development device according to claim 33, wherein, when $Br_1$ represents a peak value of magnetic flux density at a position where magnetic flux density in a normal direction to the circumferential surface of the developer carrier is maximum in the first magnetic field generated by the development pole, and $Br_2$ represents a peak value of magnetic flux density at a position where magnetic flux density in a normal direction to the circumferential surface of the developer carrier is maximum in the third magnetic field generated by the post-development pole, $Br_1>Br_2$.

40. The development device according to claim 33, further comprising a range on the circumferential surface of the developer carrier where magnetic force in a direction tangential to the circumferential surface of the developer carrier is zero, disposed downstream from a post-development magnetic flux density peak position where magnetic flux density in a normal direction to the circumferential surface of the developer carrier is maximum in the third magnetic field generated by the post-development pole in a direction in which the developer carrier rotates and upstream from a pre-development magnetic flux density peak position where magnetic flux density in a normal direction to the circumferential surface of the developer carrier is maximum in the second magnetic field generated by the pre-development pole in a direction in which the developer carrier rotates, wherein an angle formed by a line connecting a given point in the range where magnetic force in the tangent direction is zero and a center of rotation of the developer carrier and a horizontal line is not greater than 50°.

41. An image forming apparatus, comprising:

an image carrier on which a latent image is formed;

a charging member disposed adjacent to the image carrier, to charge a surface of the image carrier; and the development device according to claim 33 disposed adjacent to the image carrier, to develop the latent image into a toner image.

42. A development device, comprising:

a developer containing part containing two-component developer including toner and magnetic carrier particles;

a cylindrical developer carrier to carry by rotation the developer supplied from the developer containing part to a development range where the developer carrier faces an image carrier;

a first developer transport member disposed in the developer containing part, to supply the developer to the developer carrier while transporting the developer in an axial direction of the developer carrier; and a magnetic field generator disposed inside the developer carrier, having three developer-carrying magnetic poles each capable of generating a magnetic field to keep the developer on a circumferential surface of the developer carrier, the three developer-carrying magnetic poles consisting of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, wherein the second magnetic field causes the developer supplied from the developer containing part to be attracted to the circumferential surface of the developer carrier at a developer attraction position, the first magnetic field and the second magnetic field keep the developer on the circumferential surface of the developer carrier from the developer attraction position to the development range, and the first magnetic field and the third magnetic field keep the developer on the circumferential surface of the developer carrier from the development range to a release position where the developer is separated from the developer carrier, and when $Br_1$ represents a peak value of magnetic flux density at a position where magnetic flux density in a normal direction to the circumferential surface of the developer carrier is maximum in the first magnetic field generated by the development pole, and $Br_2$ represents a peak value of magnetic flux density at a position where magnetic flux density in a normal direction to the circumferential surface of the developer carrier is maximum in the third magnetic field generated by the post-development pole, $Br_1>Br_2$.

43. The development device according to claim 42, further comprising:

a partition dividing the developer containing part into a supply part including a first developer supply member and a circulation part disposed beneath the supply part; and a second developer transport member disposed in the circulation part, to transport the developer in the circulation part in the axial direction of the developer carrier.

44. The development device according to claim 43, wherein an end portion of the partition on a side closer to the developer carrier is disposed above the developer carrier, the developer moves by gravity from the end portion of the partition to the circumferential surface of the developer carrier, and the developer attraction position at which the developer supplied from the developer containing part contacts the circumferential surface of the developer carrier is disposed downstream, in a direction in which the developer carrier rotates, from a point on the circumferential surface of the developer carrier at the top of the rotation of the developer carrier.

45. The development device according to claim 43, wherein an end portion of the partition on a side closer to the developer carrier is disposed above the developer carrier, the developer moves by gravity from the end portion of the partition to the circumferential surface of the developer carrier, the developer attraction position is disposed upstream, in a direction in which the developer carrier rotates, from a point on the circumferential surface of the developer carrier at the top of the rotation of the developer carrier, and a pre-development magnetic flux density peak position where magnetic flux density in a normal direction to the circumferential surface of the developer carrier is maximum in the pre-development pole is disposed upstream, in the direction in which the developer carrier rotates, from the point on the circumferential surface of the developer carrier at the top of the rotation thereof.

46. The development device according to claim 43, wherein a first communication port and a second communication port through which the supply part and the circulation part communicate with each other are respectively formed in an upstream end portion and a downstream portion of the partition in a direction in which the first developer transport member transports the developer, and the second developer transport member transports the developer in a direction opposite the direction in which the first developer transport member transports the developer.

47. The development device according to claim 46, wherein the first communication port is disposed on a side away from the developer carrier.

48. The development device according to claim 42, further comprising a range on the circumferential surface of the developer carrier where magnetic force in a direction tangential to the circumferential surface of the developer carrier is zero, disposed downstream from a post-development magnetic flux density peak position where magnetic flux density in a normal direction to the circumferential surface of the developer carrier is maximum in the third magnetic field generated by the post-development pole in a direction in which the developer carrier rotates and upstream from a pre-development magnetic flux density peak position where magnetic flux density in a normal direction to the circumferential surface of the developer carrier is maximum in the second magnetic field generated by the pre-development pole in a direction in which the developer carrier rotates, wherein an angle formed by a line connecting a given point in the range where magnetic force in the tangent direction is zero and a center of rotation of the developer carrier and a horizontal line is not greater than 50°.

49. An image forming apparatus, comprising:

an image carrier on which a latent image is formed;

a charging member disposed adjacent to the image carrier, to charge a surface of the image carrier; and the development device according to claim 42 disposed adjacent to the image carrier, to develop the latent image into a toner image.

50. A development device, comprising:

a developer containing part containing two-component developer including toner and magnetic carrier particles;

a cylindrical developer carrier to carry by rotation the developer supplied from the developer containing part to a development range where the developer carrier faces an image carrier;

a first developer transport member disposed in the developer containing part, to supply the developer to the developer carrier while transporting the developer in an axial direction of the developer carrier;

a magnetic field generator disposed inside the developer carrier, having three developer-carrying magnetic poles each capable of generating a magnetic field to keep the developer on a circumferential surface of the developer carrier, the three developer-carrying magnetic poles consisting of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, wherein the second magnetic field causes the developer supplied from the developer containing part to be attracted to the circumferential surface of the developer carrier at a developer attraction position, the first magnetic field and the second magnetic field keep the developer on the circumferential surface of the developer carrier from the developer attraction position to the development range, and the first magnetic field and the third magnetic field keep the developer on the circumferential surface of the developer carrier from the development range to a release position where the developer is separated from the developer carrier; and a range on the circumferential surface of the developer carrier where magnetic force in a direction tangential to the circumferential surface of the developer carrier is zero, disposed downstream from a post-development magnetic flux density peak position where magnetic flux density in a normal direction to the circumferential surface of the developer carrier is maximum in the third magnetic field generated by the post-development pole in a direction in which the developer carrier rotates and upstream from a pre-development magnetic flux density peak position where magnetic flux density in a normal direction to the circumferential surface of the developer carrier is maximum in the second magnetic field generated by the pre-development pole in a direction in which the developer carrier rotates, wherein an angle formed by a line connecting a given point in the range where magnetic force in the tangent direction is zero and a center of rotation of the developer carrier and a horizontal line is not greater than 50°.

51. The development device according to claim 50, further comprising:

a partition dividing the developer containing part into a supply part including a first developer supply member and a circulation part disposed beneath the supply part; and a second developer transport member disposed in the circulation part, to transport the developer in the circulation part in the axial direction of the developer carrier.

52. The development device according to claim 51, wherein an end portion of the partition on a side closer to the developer carrier is disposed above the developer carrier, the developer moves by gravity from the end portion of the partition to the circumferential surface of the developer carrier, and the developer attraction position at which the developer supplied from the developer containing part contacts the circumferential surface of the developer carrier is disposed downstream, in a direction in which the developer carrier rotates, from a point on the circumferential surface of the developer carrier at the top of the rotation of the developer carrier.

53. The development device according to claim 51, wherein an end portion of the partition on a side closer to the developer carrier is disposed above the developer carrier, the developer moves by gravity from the end portion of the partition to the circumferential surface of the developer carrier, the developer attraction position is disposed upstream, in a direction in which the developer carrier rotates, from a point on the circumferential surface of the developer carrier at the top of the rotation of the developer carrier, and a pre-development magnetic flux density peak position where magnetic flux density in a normal direction to the circumferential surface of the developer carrier is maximum in the pre-development pole is disposed upstream, in the direction in which the developer carrier rotates, from the point on the circumferential surface of the developer carrier at the top of the rotation thereof.

54. The development device according to claim 51, wherein a first communication port and a second communication port through which the supply part and the circulation part communicate with each other are respectively formed in an upstream end portion and a downstream portion of the partition in a direction in which the first developer transport member transports the developer, and the second developer transport member transports the developer in a direction opposite the direction in which the first developer transport member transports the developer.

55. The development device according to claim 54, wherein the first communication port is disposed on a side away from the developer carrier.

56. An image forming apparatus, comprising:

an image carrier on which a latent image is formed;

a charging member disposed adjacent to the image carrier, to charge a surface of the image carrier; and the development device according to claim 50 disposed adjacent to the image carrier, to develop the latent image into a toner image.

57. A development device, comprising:

a developer containing part containing two-component developer including toner and magnetic carrier particles;

a cylindrical developer carrier to carry by rotation the developer supplied from the developer containing part to a development range where the developer carrier faces an image carrier;

a first developer transport member disposed in the developer containing part, to supply the developer to the developer carrier while transporting the developer in an axial direction of the developer carrier;

a magnetic field generator disposed inside the developer carrier, having three developer-carrying magnetic poles each capable of generating a magnetic field to keep the developer on a circumferential surface of the developer carrier, the three developer-carrying magnetic poles consisting of a development pole to generate a first magnetic field in the development range, a pre-development pole to generate a second magnetic field to transport the developer supplied from the developer containing part to the development range, and a post-development pole to generate a third magnetic field disposed between the first magnetic field and the second magnetic field, wherein the second magnetic field causes the developer supplied from the developer containing part to be attracted to the circumferential surface of the developer carrier at a developer attraction position, the first magnetic field and the second magnetic field keep the developer on the circumferential surface of the developer carrier from the developer attraction position to the development range, and the first magnetic field and the third magnetic field keep the developer on the circumferential surface of the developer carrier from the development range to a release position where the developer is separated from the developer carrier, each of the developer-carrying magnetic poles has a maximum density of magnetic flux in a normal direction to the circumferential surface of the developer carrier of 10 mT or greater;

a partition dividing the developer containing part into a supply part including a first developer supply member and a circulation part disposed beneath the supply part; and a second developer transport member disposed in the circulation part, to transport the developer in the circulation part in the axial direction of the developer carrier, wherein an end portion of the partition on a side closer to the developer carrier is disposed above the developer carrier, the developer moves by gravity from the end portion of the partition to the circumferential surface of the developer carrier, and when $Br_1$ represents a peak value of magnetic flux density at a position where magnetic flux density in a normal direction to the circumferential surface of the developer carrier is maximum in the first magnetic field generated by the development pole, and $Br_2$ represents a peak value of magnetic flux density at a position where magnetic flux density in a normal direction to the circumferential surface of the developer carrier is maximum in the third magnetic field generated by the post-development pole, $Br_1 > Br_2$.

58. An image forming apparatus, comprising:

an image carrier on which a latent image is formed;

a charging member disposed adjacent to the image carrier, to charge a surface of the image carrier; and the development device according to claim 57 disposed adjacent to the image carrier, to develop the latent image into a toner image.

* * * * *